US006897884B2

(12) United States Patent
Tsuge et al.

(10) Patent No.: US 6,897,884 B2
(45) Date of Patent: May 24, 2005

(54) MATRIX DISPLAY AND ITS DRIVE METHOD

(75) Inventors: Hitoshi Tsuge, Osaka (JP); Atsuhiro Yamano, Hyogo (JP); Hiroshi Takahara, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 292 days.

(21) Appl. No.: 10/221,633

(22) PCT Filed: Dec. 27, 2001

(86) PCT No.: PCT/JP01/11512

§ 371 (c)(1),
(2), (4) Date: Sep. 13, 2002

(87) PCT Pub. No.: WO02/052534

PCT Pub. Date: Jul. 4, 2002

(65) Prior Publication Data

US 2003/0048238 A1 Mar. 13, 2003

(30) Foreign Application Priority Data

| | | |
|---|---|---|
| Dec. 27, 2000 | (JP) | 2000-397706 |
| Mar. 1, 2001 | (JP) | 2001-56499 |
| May 28, 2001 | (JP) | 2001-158731 |
| Jun. 25, 2001 | (JP) | 2001-190958 |

(51) Int. Cl.[7] ..... G09G 5/00

(52) U.S. Cl. ..... 345/690; 345/204; 345/89; 345/63; 345/77; 345/100

(58) Field of Search ..... 345/690, 204, 345/63, 77, 89, 100

(56) References Cited

U.S. PATENT DOCUMENTS

| | | | | |
|---|---|---|---|---|
| 5,583,530 | A | 12/1996 | Mano et al. | |
| 6,057,809 | A * | 5/2000 | Singhal et al. | 345/3.3 |
| 6,072,451 | A * | 6/2000 | Mano et al. | 345/89 |
| 2003/0193464 | A1 * | 10/2003 | Yamano et al. | 345/89 |

FOREIGN PATENT DOCUMENTS

| | | | |
|---|---|---|---|
| JP | 63-182695 | 7/1988 | |
| JP | 2-196292 | 8/1990 | |
| JP | 10-161610 | 6/1998 | |
| WO | WO-02/052534 A1 * | 7/2002 | G09G/3/20 |
| WO | WO-02/054375 A1 * | 7/2002 | G09G/3/36 |

* cited by examiner

*Primary Examiner*—Lun-yi Lao
(74) *Attorney, Agent, or Firm*—RatnerPrestia

(57) ABSTRACT

In a display device capable of low power and multi-color displaying without raising a frame rate due to increase of display gradations in number by combining a gradation representation through a FRC and a gradation representation system using a pulse width modulation or pulse height modulation method, the gradation representation is executed by a method of pulse width or pulse height modulation in one frame using lower significant N bits to a video signal of M bits, and the display of the gradations is performed by the FRC of the present invention using more significant M−N bits and further using $2^{M-N}-1$ frames, and thus the number of the frames required for FRC is reduced to decrease a frame frequency to thereby realize a gradation display with reduction of electric power and suppression of flickers.

4 Claims, 54 Drawing Sheets

Fig.6
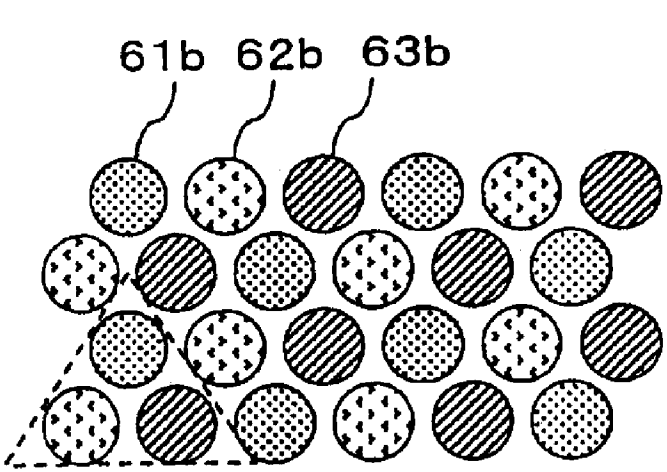
(b)
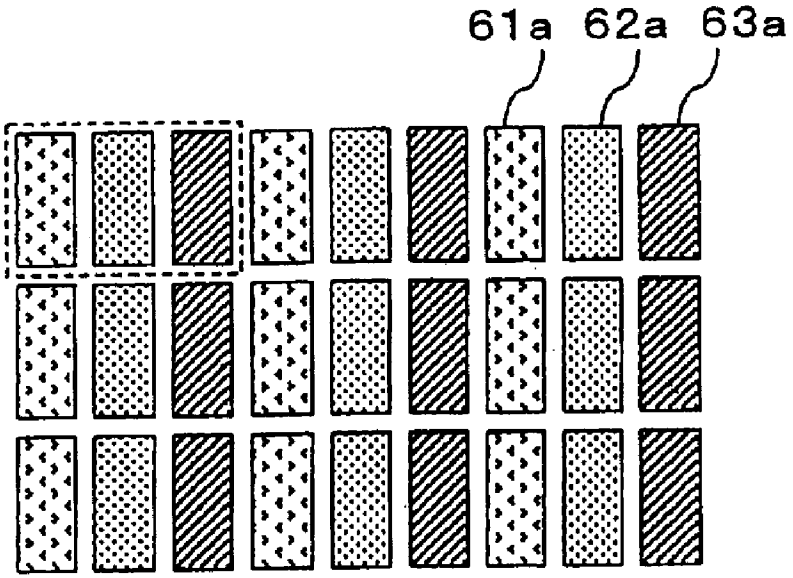
(a)

EXAMPLE OF 5 GRADATION DISPLAY

Fig.19

| GRADATION | FRAME SHIFT | LINE SHIFT | EVEN LINE SHIFT | G SHIFT | B SHIFT |
|---|---|---|---|---|---|
| 1 AND 14 | 7 | 1 | 3 | 8 | 7 |
| 2 AND 6 AND 13 | 3 | 1 | 1 | 4 | 3 |
| 3 AND 12 | 1 | 5 | 2 | 2 | 1 |
| 4 AND 11 | 3 | 1 | 3 | 0 | 3 |
| 5 AND 10 | 1 | 2 | 1 | 2 | 1 |
| 7 AND 9 | 7 | 2 | 3 | 8 | 7 |
| 8 | 1 | 1 | 1 | 0 | 1 |

Fig.24

INITIAL VALUE OF GRADATION REGISTER

| GRADATION REGISTER | VALUE |
|---|---|
| ka[3:0] | 1000 |
| kb[3:0] | 1010 |

Fig.26

TRUTH TABLE OF GRADATION DECODING SECTION 231

| HIGH-ORDER 2-BIT VALUE OF INPUT VIDEO SIGNAL 13 D[5:4] | OUTPUT OF REGISTER ka | OUTPUT OF REGISTER kb | Q[3:0] |
|---|---|---|---|
| 00 | 0 | X | 0000 |
| 00 | 1 | X | D[3:0] |
| 01 | 0 | 0 | 0000 |
| 01 | 0 | 1 | D[3:0] |
| 01 | 1 | 1 | 1111 |
| 10 | 0 | 0 | 1111 |
| 10 | 0 | 1 | D[3:0] |
| 10 | 1 | 1 | 0000 |
| 11 | 0 | X | 1111 |
| 11 | 1 | X | D[3:0] |

*Fig.31*

GRADATION DECODING SECTION

| VIDEO SIGNAL HIGH-ORDER M-N BIT DATA | REGISTER VALUE | OUTPUT |
|---|---|---|
| 0 | REGISTER 0[y]=1 | LOWER-ORDER N-BIT DATA OUTPUT |
| | REGISTER 0[y]=0 | N-BIT ALL 0 |
| X ($1 \leqq X \leqq 2^{M-N-1}-1$) | REGISTER X[y]≠REGISTER X-1[y] | LOWER-ORDER N-BIT DATA OUTPUT |
| | REGISTER X[y]=REGISTER X-1[y]=1 | N-BIT ALL 1 |
| | REGISTER X[y]=REGISTER X-1[y]=0 | N-BIT ALL 0 |
| X ($2^{M-N-1} \leqq X \leqq 2^{M-N}-2$) | REGISTER X[y]≠REGISTER X-1[y] | LOWER-ORDER N-BIT DATA OUTPUT |
| | REGISTER X[y]=REGISTER X-1[y]=1 | N-BIT ALL 0 |
| | REGISTER X[y]=REGISTER X-1[y]=0 | N-BIT ALL 1 |
| $2^{M-N}-1$ | REGISTER 0[y]=1 | N-BIT ALL 1 |
| | REGISTER 0[y]=0 | LOWER-ORDER N-BIT DATA OUTPUT |

$0 \leqq y \leqq 2^{M-N}-1$ (a) WAVEFORM EXAMPLE OF SEGMENT SIGNAL LINE OF PRIOR ART (b) WAVEFORM EXAMPLE OF SEGMENT SIGNAL LINE OF PRESENT INVENTION Fig.35
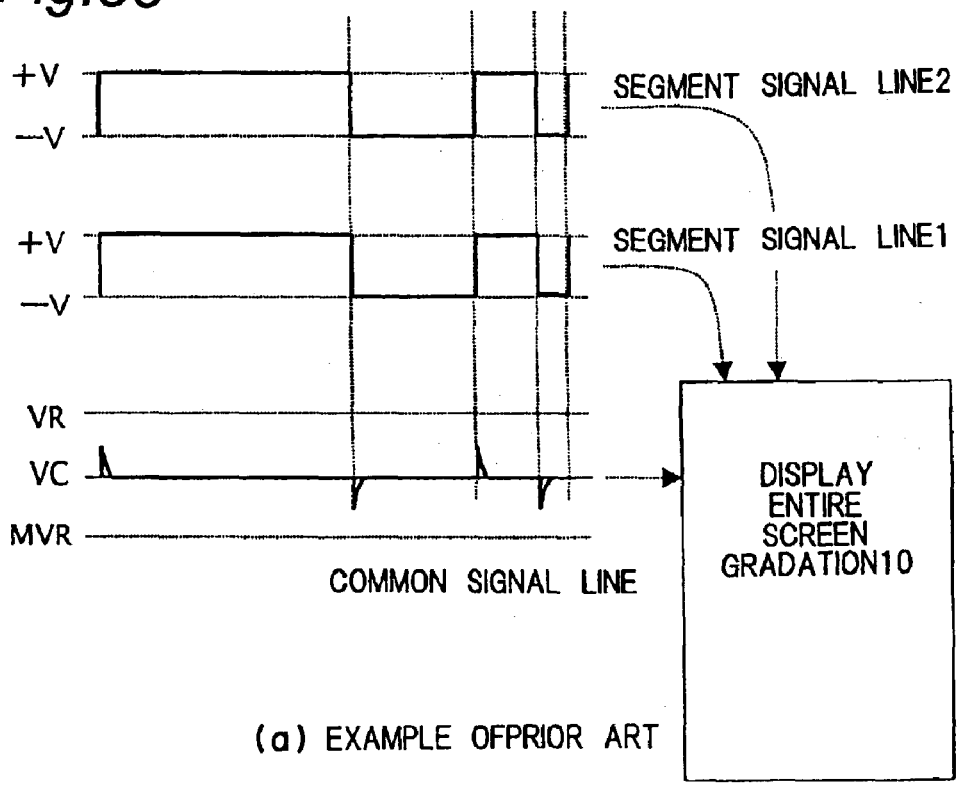
(a) EXAMPLE OFPRIOR ART
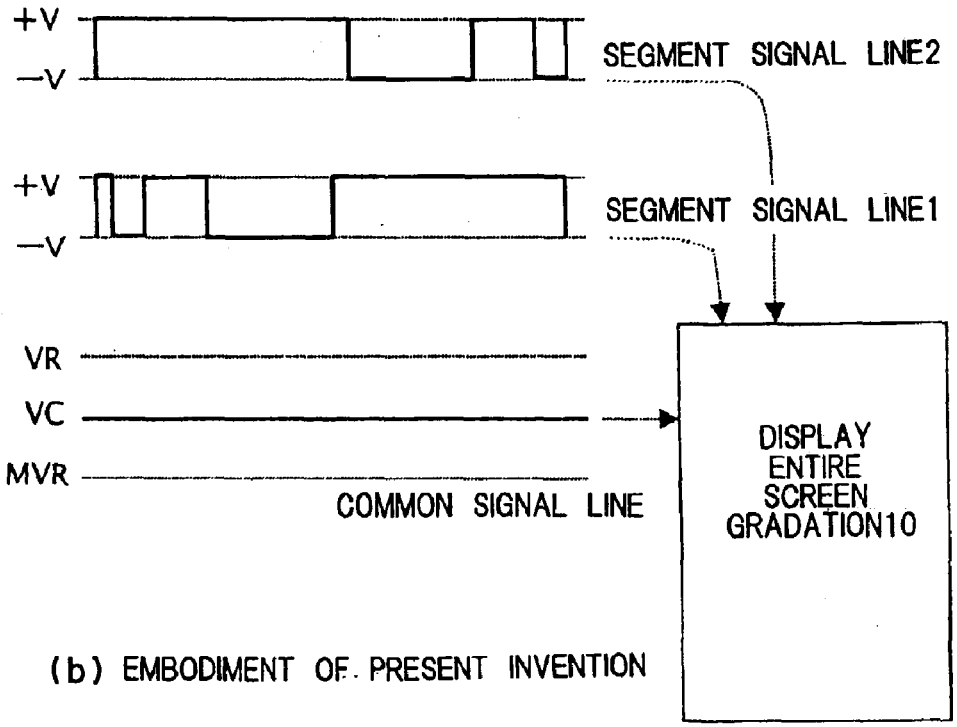
(b) EMBODIMENT OF PRESENT INVENTION DISPLAY DATA LINE15
D1[3:0]
D2[3:0]
D3[3:0]
D4[3:0]
MSB OF EACH ROW
LSB OF EACH ROW
ORTHOGONAL FUNCTION H[3:0]
Ex-NOR
Adder
351a
351b
351c
351d
352a
352b
352c
352d
D1[3]
D1[2]
D1[1]
D1[0]
D4[3]
D4[2]
D4[1]
D4[0]
q1
q2
q3
q4
swmv2[0]
swmv1[0]
swvc[0]
swv1[0]
swv2[0]
swmv2[1]
swmv1[1]
swvc[1]
swv1[1]
swv2[1]
swmv2[2]
swmv1[2]
swvc[2]
swv1[2]
swv2[2]
swmv2[3]
swmv1[3]
swvc[3]
swv1[3]
swv2[3]
swmv2[3:0]
swmv1[3:0]
swvc[3:0]
swv1[3:0]
swv2[3:0]
Counter
353
Selector
354
-V2
-V1
Vc
V1
V2
SEGMENT SIGNAL LINE

Fig.37

| q1+q2+q3+q4 | swv2 | swv1 | swvc | swmv1 | swmv2 |
|---|---|---|---|---|---|
| 0 | 0 | 0 | 0 | 0 | 1 |
| 1 | 0 | 0 | 0 | 1 | 0 |
| 2 | 0 | 0 | 1 | 0 | 0 |
| 3 | 0 | 1 | 0 | 0 | 0 |
| 4 | 1 | 0 | 0 | 0 | 0 |

Fig.38
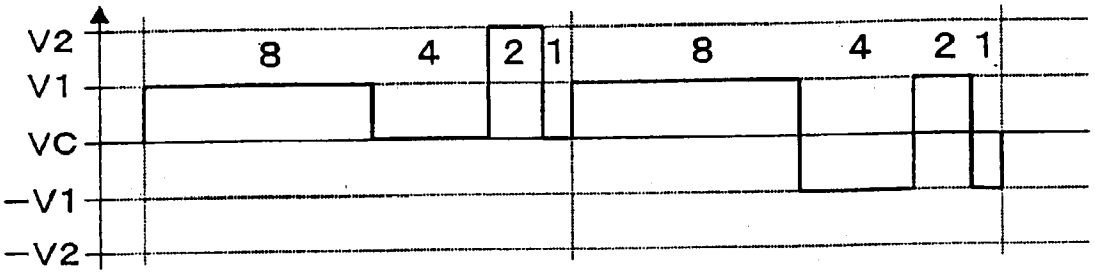
(a) WAVEFORM EXAMPLE OF SEGMENT SIGNAL LINE OF PRIOR ART
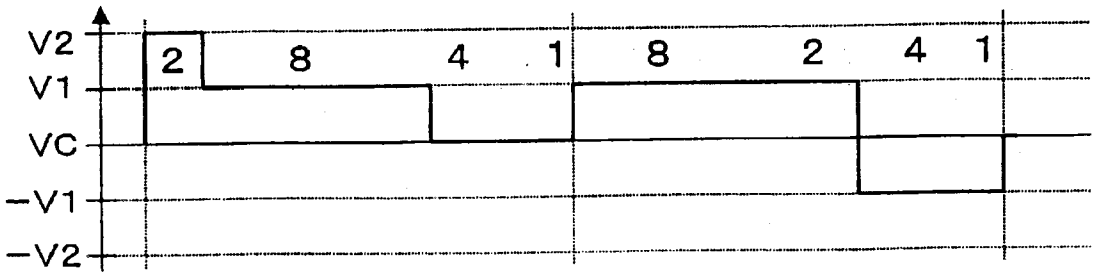
(b) WAVEFORM EXAMPLE OF SEGMENT SIGNAL LINE OF PRESENT INVENTION

*Fig.39*
OUTPUT OF GRADATION DECODING SECTION 231 WHEN INPUT IS 4-BIT DATA
| Data/Flame | 1 | 2 | 3 | 4 | |
|---|---|---|---|---|---|
| 00xx | xx | 00 | 00 | 00 | INPUT GRADATION 0~3 |
| 01xx | 11 | 00 | xx | 00 | INPUT GRADATION 4~7 |
| 10xx | 00 | 11 | xx | 11 | INPUT GRADATION 8~11 |
| 11xx | xx | 11 | 11 | 11 | INPUT GRADATION 12~15 |
XX : ANY ONE OF 00,01,10,11
(a)
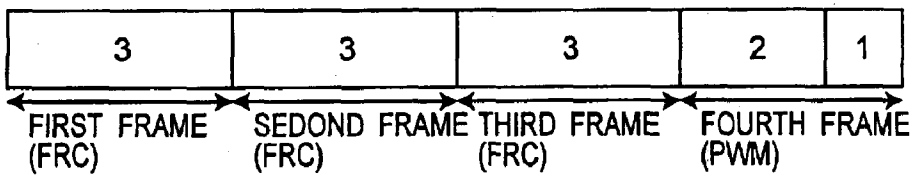
3+3+3+2+1=12 AND RESULTS IN 13 GRADATION DISPLAY OF 0~12
※ NUMERALS INDICATE PULSE WIDTH
(b)
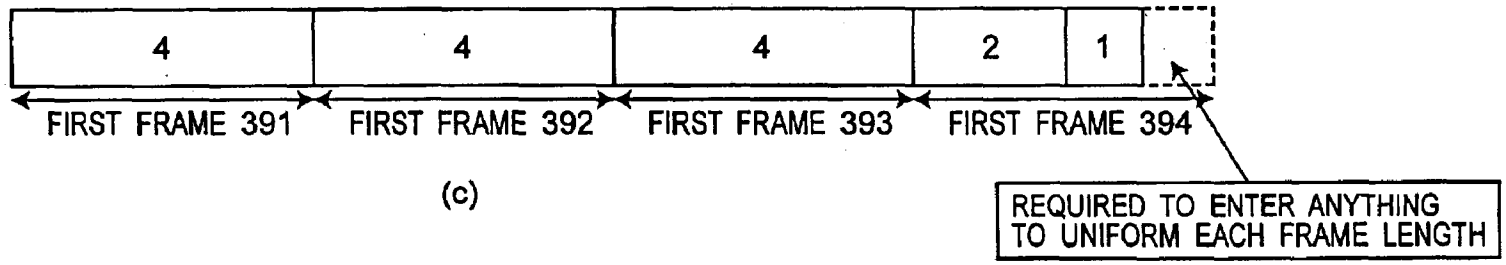
(c)

Fig.40

| INPUT DATA [3:0] | FIRST FRAME | SECOND FRAME | THIRD FRAME | FOURTH FRAME |
|---|---|---|---|---|
| 0000 | 0(OFF) | 0(OFF) | 0(OFF) | 0(PWM) |
| 0001 | 0 | 0 | 0 | 1 |
| 0010 | 0 | 0 | 0 | 2 |
| 0011 | 0 | 0 | 0 | 3 |
| 0100 | 0 | 0 | 4(ON) | 0 |
| 0101 | 0 | 0 | 4 | 1 |
| 0110 | 0 | 0 | 4 | 2 |
| 0111 | 0 | 0 | 4 | 3 |
| 1000 | 0 | 4(ON) | 4 | 0 |
| 1001 | 0 | 4 | 4 | 1 |
| 1010 | 0 | 4 | 4 | 2 |
| 1011 | 0 | 4 | 4 | 3 |
| 1100 | 4(ON) | 4 | 4 | 0 |
| 1101 | 4 | 4 | 4 | 1 |
| 1110 | 4 | 4 | 4 | 2 |
| 1111 | 4 | 4 | 4 | 3 |

Fig.42

| S[3:2] | Ka[y] | Kb[y] | C |
|---|---|---|---|
| 00 | 0 | X | 0 |
| | 1 | X | 0 |
| 01 | 0 | 0 | 0 |
| | 0 | 1 | 0 |
| | 1 | 0 | 0 |
| | 1 | 1 | 1 |
| 10 | 0 | 0 | 1 |
| | 0 | 1 | 0 |
| | 1 | 0 | 0 |
| | 1 | 1 | 0 |
| 11 | 0 | X | 1 |
| | 1 | X | 0 |

RELATION OF S AND D IS AS SHOWN IN FIG.39(a)

*Fig.53*

INPUT/OUTPUT RELATION OF GRADATION DECODING SECTION 524

| VIDEO SIGNAL HIGH-ORDER M-N BIT DATA | REGISTER VALUE | OUTPUT D[N-1:0] | OUTPUT D[N] |
|---|---|---|---|
| 0 | REGISTER 0[y]=1 | LOWER-ORDER N-BIT DATA OUTPUT | 0 |
| | REGISTER 0[y]=0 | N-BIT ALL 0 | 0 |
| X ($1 \leqq X \leqq 2^{M-N-1}-1$) | REGISTER X[y]≠REGISTER X-1[y] | LOWER-ORDER N-BIT DATA OUTPUT | 0 |
| | REGISTER X[y]=REGISTER X-1[y]=1 | OPTION | 1 |
| | REGISTER X[y]=REGISTER X-1[y]=0 | N-BIT ALL 0 | 0 |
| X ($2^{M-N-1} \leqq X \leqq 2^{M-N}-2$) | REGISTER X[y]≠REGISTER X-1[y] | LOWER-ORDER N-BIT DATA OUTPUT | 0 |
| | REGISTER X[y]=REGISTER X-1[y]=1 | N-BIT ALL 0 | 0 |
| | REGISTER X[y]=REGISTER X-1[y]=0 | OPTION | 1 |
| $2^{M-N}-1$ | REGISTER 0[y]=1 | OPTION | 1 |
| | REGISTER 0[y]=0 | LOWER-ORDER N-BIT DATA OUTPUT | 0 |

$0 \leqq y \leqq 2^{M-N}-1$

Fig.54

| D[N] | D[N-1:0] | SEGMENT SIGNAL LINE OUTPUT |
|---|---|---|
| 1 | OPTION | $V_{2N}$ |
| 0 | 0 | $V_0$ |
| | 1 | $V_1$ |
| | 2 | $V_2$ |
| | 3 | $V_3$ |
| | ⋮ | ⋮ |
| | 2N-1 | V2N-1 |

MATRIX DISPLAY AND ITS DRIVE METHOD

TECHNICAL FIELD

The present invention relates to a display device having a matrix-like pixel structure and a method for driving the same or the like.

BACKGROUND ART

As one of gradation display systems, there is a frame rate control system (FRC) for performing gradation expression by using a plurality of frames and controlling a column voltage every frame. In the case where the gradation display is performed under the frame rate control, flickers are reduced by preventing the number of ON and OFF patterns from varying.

In the case of performing gradation expression under the FRC (Frame Rate Control), when the number of display gradations increases, flickers easily occur because a gradation occurs in which the ratio between the number of times of ON and the number of times of OFF decreases. Though there is a method of reducing the number of flickers by increasing a frame rate, power consumption increases. For example, though gradations are expressed by seven frames in the case of 256-color display, 15 frames are necessary for 4,096-color display, and in order to simply equalize flicker levels, it is necessary to almost double a frame rate. On the other hand, power sources are limited in the case of mobile terminals including a portable telephone and it is requested to reduce power consumption. Moreover, a circuit for preventing a flicker must be simple from the viewpoint of requests for reduction of display-device frame in size and reduction of cost. Moreover, to realize multi-color, a frame frequency exceeds 200 Hz and it is impossible to reduce power consumption by the FRC.

Moreover, in realizing multi-color by the pulse-width modulation method, a problem occurs that power consumption is increased because the number of times of charge and discharge of a segment signal line is increased due to the increase of the number of pulses to be applied in one horizontal scanning period, or a waveform deterioration due to a product of a capacity of a wiring resistance and a resistance thereof deteriorates the gradation characteristic because a display device has a capacitive load in general and a pulse width is narrowed.

The present invention has been made to solve the above problems, and in order for driving at a low frame frequency, different ON/OFF patterns are used every N line, every frame, every display color, and between even rows and odd rows in the FRC. In order to realize the multi-color and reduction in power supply, a gradation expression by the FRC and a gradation expression system by the pulse-width modulation (PWM) method or pulse-height modulation (PHM) method are combined to thereby suppress the increase of the frame rate due to the increase of the number of the display gradations, and the present invention has its object to provide a display device, capable of realizing low power and displaying multi-color.

DISCLOSURE OF INVENTION

In order to attain the object mentioned above, a matrix type display device according to a first aspect of the present invention is a matrix type display device performing gradation display under a frame rate control to display at least two different colors, wherein a gradation register section is shift-processed every row or every frame based on a control signal, and the outputs of said gradation register section are changed every display color by the shift processing by a number of the shift processing sections which the number is equal to a number of the display colors—1, and gradation selecting circuits provided on every segment signal lines are connected with the outputs of said shift processing sections or said register section, and said gradation selecting circuits perform the gradation display with display patterns different every display color, using the outputs of said shift processing sections or said register section at the same time.

A method for driving a matrix type display device according to a second aspect of the present invention is a method for driving a matrix type display device performing gradation display under a frame rate control, wherein gradation registers provided for every gradation are shift-processed every N rows or every frame, and shift sections are connected to the outputs of said gradation registers to perform further shift-processing for the data corresponding to even number rows among the N rows, and output the outputs of said gradation registers without any change for the data corresponding to odd number rows, and gradation processing is performed by gradation selecting circuits provided on every segment signal lines, using the outputs of the gradation registers at the same time, thereby displaying ON/OFF patterns different between the even number rows and the odd number rows among a set of N rows.

A method for driving a matrix type display device according to a third aspect of the present invention is a method for driving a matrix type display device performing gradation display under a frame rate control to display at least two different colors, wherein gradation register sections are shift-processed every N rows or every frame based on a control signal, and a first shift section is connected to the outputs of said gradation registers to perform further shift processing for the data corresponding to even number rows among the N rows, and output the outputs of said gradation registers without any change for the data corresponding to odd number rows, and the shift processing to said first shift section is performed every display color by a number of second shift processing sections which the number is equal to a number of display colors−1, and gradation selecting circuits provided on every segment signal lines are connected to the outputs of said second shift processing section or said first section, whereby said gradation selecting circuits perform gradation display with display patterns different between the even number rows and the odd number rows among a set of further N rows every display color, using the outputs of said shift processing sections or said register sections at the same time.

A matrix type display device according to a fourth aspect of the present invention, comprises: gradation registers; a shift control signal section for shift-processing said gradation registers every N rows or every frame; a first shift section performing the shift-processing for data of even number rows among a set of N rows for the outputs of said gradation registers, wherein the outputs of said first shift section are distributed according to display colors (X colors); a second shift section performing the shift-processing for at least X−1 pieces of the outputs among the distributed X pieces outputs of said first shift section; and gradation selecting circuits provided on every segment signal lines, connected with the outputs of said second shift section or said first shift section, wherein said gradation selecting circuits perform the gradation display using the outputs of said first shift section or said second shift section at the same time, to thereby perform the gradation display with display patterns different every N rows, every frame, between even number rows and odd number rows of a set of N rows, and every display color.

A method for driving a matrix type display device according to a fifth aspect of the present invention is a method for driving a matrix type display device having a data input of a plurality of bit widths (M bits), when assuming that M and N are natural numbers meeting M>N, executing a gradation process for said M-bit data input under a frame rate control with $2^{M-N}-1$ frames using the high-order M−N bits input; and executing a gradation process for one frame different from said $2^{M-N}-1$ frames according to pulse width modulation or pulse height modulation using the input lower-order N bits.

A semiconductor circuit for driving a matrix type display device is a semiconductor circuit for driving a matrix type display device having a data input of a plurality of bit widths (M bits), when assuming that M and N are natural numbers meeting M>N, for said M-bit date input, comprises: a gradation register circuit comprised of a plurality of registers; a gradation control section for performing shift-processing of the gradation registers of said gradation register circuit in accordance with a horizontal sync signal and a vertical sync signal; and a data decoding section for converting the M-bit data input into N-bit data, wherein said data decoding section performs the gradation process under a frame rate control with $2^{M-N}-1$ frames by using said gradation register circuit and high-order M−N-bit input, and performs the gradation process for one frame different from said $2^{M-N}-1$ frames in accordance with pulse-width modulation or pulse-height modulation using the input lower-order N bits, to thereby perform gradation display using the $2^{M-N}$ frames.

A matrix display device according to a seventh aspect of the present invention is a matrix display device having an M-bit data input to simultaneously select a plurality rows (L rows) of common signal lines, which comprises: a plurality of gradation register circuits; a gradation control section for performing shift-processing of gradation registers of said gradation register circuits in accordance with a horizontal sync signal or a vertical sync signal; a data decoding section for converting M-bit data into N bits by inter-frame-thinning the M-bit data in accordance with outputs of said gradation register circuits; an orthogonal-function generation section; N pieces of operation sections for respective segment signal lines for computing said orthogonal function and said N-bit data; a selection section for selecting one of outputs of said N operation sections; a RAM for holding a shift amount of at least either of even rows and odd rows among a set of L rows; a RAM for shifting every set of L rows; data rewrite means for rewriting said RAM; and L+1 pieces of N-bit registers serving as outputs of said operation sections, wherein any one of bits corresponding to weights of input bits of the L+1 registers is set to 1 and the remaining bits are set to 0 in accordance with operation results of said operation sections, and wherein said selection section refers to L+1 register values and selects outputs of said operation sections in a descending order of segment voltage values or in an ascending order thereof in one horizontal scanning period in accordance with the register values.

A method for driving a display device according to an eighth aspect of the present invention is a method for driving a display device performing gradation display using M-bit input data, which executes a first frame using N-bit data (N<M) and a plurality of second frames using (M−N)-bit data, wherein the number of frames F obtained by adding the first frame and the second frames is equal to $2^{M-N}$, and the number of gradations of the first frame is equal to a number obtained by the number of gradations of each of the second frames−1.

A method for driving a display device according to ninth aspect of the present invention is a method for driving a display device performing gradation display using M-bit input data, which executes a first frame using N-bit data (N<M) and a plurality of second frames using (M−N)-bit data, wherein the number of frames F obtained by adding the first frame and the second frames is equal to $2^{M-N}$, the number of gradations of the first frame is equal to a number obtained by the number of gradations of each of the second frames-1, a gradation display method for the first frame is a pulse-width modulation method or a pulse-height modulation method, and a gradation display method for the second frames is a frame rate control.

A method for driving a matrix type display device according to a tenth aspect of the present invention is a method for driving a matrix type display device having a data input of a plurality of bit widths (M bits), which comprises, when assuming that M and N meet M>N and are integers, for the M-bit data input, a gradation register circuit comprised of a plurality of registers, a data decoding section converting the M-bit data input into N-bit data and performing gradation processing with $2^{M-N}-1$ frames under a frame rate control using said gradation register circuit and high-order (M−N)-bit input, performing gradation processing for one frame different from said $2^{M-N}-1$ frames using the input N bits through pulse width modulation, further outputting one bit different from said N-bit output, said one-bit output being the same output as one bit of said frame rate control output while performing the gradation processing under the frame rate control, outputting 0 when performing the gradation process through the pulse width modulation, dividing one frame into $2^N$ sub-frames, performing gradation display in accordance with said N-bit output in the period of $2^N-1$ sub-frames, and performing display on the basis of said one-bit output in one period different from the period of said $2^N-1$ sub-frames, so that $2^M$ gradation display is performed using $2^{M-N}$ frames.

A matrix type display device according to an eleventh aspect of the present invention is a method for driving a matrix type display device having a data input of a plurality of bit widths (M bits) and simultaneously selecting common signal lines of a plurality of lines (L lines, where L is an integer of 2 or more), which comprises: one or more gradation register circuits; FRC determination means for determining whether or not the frame rate control is performed in accordance with an output of said gradation register circuits; a data decoding section for converting the M-bit data into N bits; an orthogonal-function generation section for generating each element of an orthogonal function; N pieces of arithmetic sections for each segment signal line for performing operations of said orthogonal function and said N-bit data; a ROM for storing previously-calculated L pieces of data 0 and L pieces of said orthogonal-function elements, operation results of L pieces of data 1 and L pieces of said orthogonal-function elements; and a selection section for selecting one of outputs of said N arithmetic sections or said ROM, wherein said selection section outputs one of outputs of said plurality of arithmetic sections during one frame period, in accordance with the result of said FRC determination means, or selectively outputs the outputs of said arithmetic sections in accordance with the weight of said N-bit data serving as inputs of said arithmetic sections during the $(2^N-1)/2^N$ period of one frame and selectively outputs the data in said ROM during the $1/2^N$ period of one frame.

A matrix type display device according to a twelfth aspect of the present invention is a method for driving a matrix type display device having a data input of a plurality of bit widths (M bits), which comprises: one or more register circuits; FRC determination means for determining whether or not a frame rate control is performed in accordance with outputs of said gradation register circuits; a data decoding section for converting M-bit data into N bits; an orthogonal-function generation section; N pieces of arithmetic sections for each segment signal line for performing operations of said orthogonal function and said N-bit data; and a selection section for selecting one of outputs of said N arithmetic sections; wherein said selection section outputs one of the outputs of said arithmetic devices during one frame, in accordance with the result by said FRC determination means, or selectively outputs the outputs of said plurality of arithmetic sections in accordance with the weight of said N-bit data serving as inputs of said arithmetic sections so as to apply a voltage when no common signal line is selected during the $1/2^N$period of one frame.

A method for driving a display device according to a thirteenth aspect of the present invention is a method for driving a display device performing gradation display using M-bit input data, which executes a first frame using N(N<M)-bit data and a plurality of second frames using (M−N)-bit data, wherein, the number of frames F obtained by adding the first frame and the second frames is equal to $2^{M-N}$, and the number of gradations of the first frame is equal to a number obtained by the number of frames of each of the second frames-1, and voltage values to be applied to the display section of said display device are changed using the data for one gradation different from the data for the number of gradations of each of said second frames-1 gradations, so that brightness of all display gradations are changed.

A method for driving a display device according to a fourteenth aspect of the present invention is a method for driving a display device performing gradation display using M-bit input data, which executes a first frame using N(N<M)-bit data and a plurality of second frames using (M−N)-bit data; wherein, the number of frames F obtained by adding the first frame and the second frames is equal to $2^{M-N}$, and the number of gradations to be possibly displayed with said first frame is equal to $2^N+1$, and which optionally selects $2^N$ gradations which can be expressed using said N-bit data among said $2^N+1$ gradations in accordance with said display device and different display colors, so that brightness-to-gradation characteristics are adjustable.

A method for driving a display device according to a fifteenth aspect of the present invention is a method for driving a display device performing gradation display using M-bit input data, which executes a first frame using N(N<M)-bit data and a plurality of second frames using (M−N)-bit data, wherein, the number of frames F obtained by adding the first frame and the second frames is equal to $2^{M-N}$, and the number of gradations of the first frame is equal to a number obtained by the number of frames of each of the second frames-1, and a voltage irrespective of a display gradation is applied using the data for one gradation different from the data for the number of gradations of each of said second frames-1 gradations, so that voltage values to be applied to segment signal lines and common signal lines in the same gradation are changed.

A method for driving a display device according to a sixteenth aspect of the present invention is a method for driving a display device performing gradation display using M-bit input data, which executes a first frame using N(N<M)-bit data and a plurality of second frames using (M−N)-bit data, wherein, the number of frames F obtained by adding the first frame and the second frames is equal to $2^{M-N}$, and the number of gradations of the first frame is equal to a number obtained by the number of frames of each of the second frames-1, and which inputs values different every primary color to the data for one gradation different from the data for the number of gradations of each of said second frames-1 gradations, and changes voltage values to be applied to the display section of said display device every display primary color, so that brightness is adjusted between different display primary colors.

A matrix type display device according to a seventeenth aspect of the present invention is a matrix type display device having a data input of M bits, which comprises: at least $2^{M-N-1}$ pieces of plural gradation registers; a gradation register circuit executing shift-processing to said gradation registers based on a shift amount indication signal by a shift control signal; and a gradation decoding section for converting the M-bit data to N-bit data, wherein said plurality of registers have the numbers of bits of 1 or 0 which are different one by one in turn in a rate between 0 and 1 from $1/(2^{M-N}-1)$ to 1/1, and assuming that 1 indicates ON and 0 indicates OFF, in the case where high-order (M−N)-bit data of said M-bit input data is except for 0 or $2^{M-N}-1$, said gradation decoding section refers to values of a gradation register A having a number of 1 pieces which is equal to the value of the high-order (M−N)-bit data and a gradation register B having a number of 1 pieces which is larger by one than the value of the high-order (M−N)-bit data among said plurality of gradation registers, in the case where the value of said gradation register A is not equal to the value of said gradation register B, the lower-order N-bit value of the M-bit data is outputted, in the case where the value of said gradation register A is equal to the value of said gradation register B, when the most significant bit of said M-bit input data is 0, the value same as said gradation register A or gradation register B is outputted for the entire N bits, when the most significant bit of said M-bit input data is 1, the value inverse to said gradation register A or gradation register B is outputted for the entire N bits, and when assuming that said plurality of gradation registers having one piece of 1 are registers C, in the case where said M-bit input data is 0, the lower-order N-bits of the M-bit input data are outputted when the value of said gradation registers C is 1, and all of the N bits 0 are outputted when the value is 0, in the case where said M-bit input data is 1, the lower-order N-bits of the M-bit input data are outputted when the value of said gradation registers C is 0, and all of the N bits 1 are outputted when the value is 1, and gradation display is performed according to pulse-width modulation or pulse-height modulation with the N-bit output of said gradation decoding section.

A method for driving a matrix type display device according to an eighteenth aspect of the present invention is a method for driving a matrix type display device having a data input of a plurality of bit widths (M bits), and when assuming that M and N meet M>N and are integers, for the M-bit data input, which comprises: a gradation register circuit comprised of a plurality of registers; a gradation control section for shift-processing the gradation registers of said gradation register circuit in accordance with a horizontal sync signal or a vertical sync signal; and a data decoding section for converting the M-bit data input to the N-bit data, wherein said data decoding section executes a gradation process under a frame rate control with $2^{M-N}-1$ frames by using said gradation register circuit and a high-order (M–N)-bit input, and executes a gradation process according to pulse-height modulation for one frame different from said $2^{M-N}-1$ frames using the input N bits, and further outputs one bit different from said N-bit output, wherein said one-bit output outputs the same output as one bit of said frame-rate-control output while performing a gradation process according to the frame rate control, and outputs 0 when performing a gradation process according to the pulse-height modulation, and wherein intensity of a signal to be output to a segment signal line is decided in accordance with the sum of said N-bit output and said one-bit output.

BRIEF DESCRIPTION OF DRAWINGS

FIG. 6 shows pixel arrangement examples in the first embodiment of the present invention where (*a*) shows a stripe arrangement, and (*b*) shows a delta arrangement;

FIG. 19 is a diagram showing a shift amount having the least flicker in each gradation i the case of using the gradation register shown in FIG. 10;

FIG. 24 is a view showing initial values of gradation registers in the third embodiment of the present invention;

FIG. 26 is a view showing a relationship of inputs and outputs of the gradation decoding section in the third embodiment of the present invention;

FIG. 31 is a view showing a relationship of inputs and outputs of the gradation decoding section in the third embodiment of the present invention;

FIG. 35(*b*) is a waveform of a segment signal line input at the time of pulse-width modulation in the third embodiment of the present invention, and (*a*) is a view showing a comparison with a conventional example thereof;

FIG. 37 is a view showing an input/output relationship of an adder section of FIG. 36;

FIG. 38(*b*) is an output waveform of a segment signal line in the case of performing PWM by a multi-line simultaneous selection method in the third embodiment of the present invention, and (*a*) is a view showing a comparison with a conventional example thereof;

FIGS. 39(*a*), 39(*b*) and 39(*c*) are diagrams showing a relationship between the outputs of the gradation decoding section and a displayable gradations number with respect to 4-bit input data according to the fourth embodiment of the present invention;

FIG. 40 is a view showing a relationship of output values in each frame with respect to each input gradation in the case of performing a gradation display in the fourth embodiment of the present invention;

FIG. 42 is a view showing an input/output relationship of a gradation decoding section in the fourth embodiment of the present invention;

FIG. 53 is a view showing an input/output relationship of a gradation decoding section shown in FIG. 52; and FIG. 54 is a view showing an input/output relationship of a voltage output section shown in FIG. 52.

BEST MODE FOR CARRYING OUT THE INVENTION

The following describes the embodiments of the present invention with reference to the appended drawings. It is noted that similar components are designated by the same reference numbers in the appended drawings.

(Embodiment 1)

Figure 1:
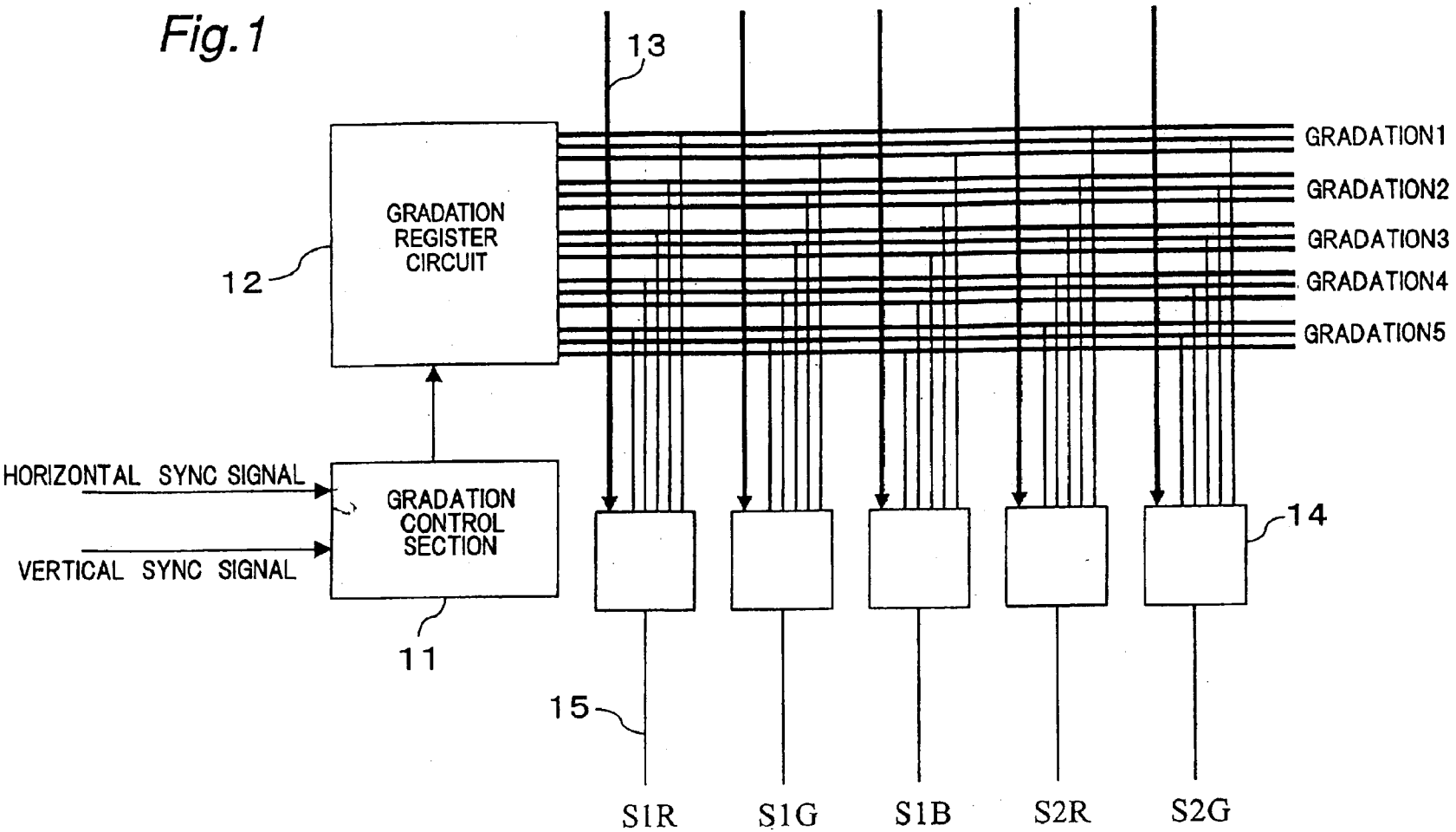
FIG. 1 is a block diagram showing a construction of a gradation control according to a first embodiment of the present invention.

FIG. 1 shows a block diagram for outputting an ON or OFF signal to segment signal lines for performing a gradation display through a frame modulation (FRC) with respect to a video signal input 13.

Figure 2:
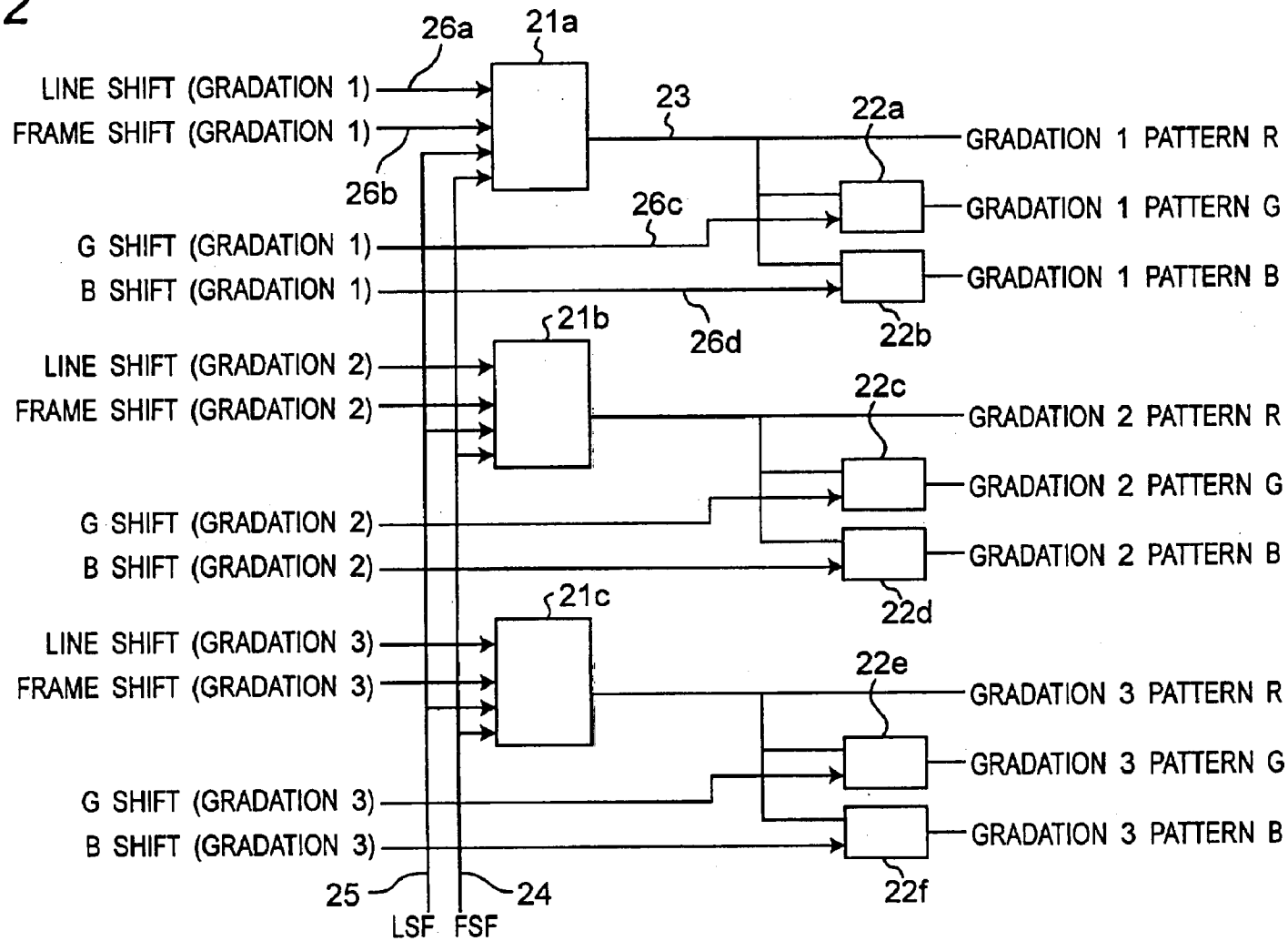
FIG. 2 is a block diagram showing an internal construction of a gradation register circuit in FIG. 1.

12 is a gradation register circuit for outputting FRC data corresponding to each gradation, 14 is a gradation selection section, and 15 is a display data line. As shown in FIG. 2, the gradation register circuit 12 includes a gradation register section 21 (21*a*, 21*b*, 21*c*) which generates gradation pattern data 23 and a reference position changing section 22 (22*a* to 22*f*). That is, there are included registers which are different every gradation or every different ratios of ON and OFF frames, and the registers are shifted by bits given as a frame shift or line shift serving as a shift amount designation signal 26 which designates an amount of shifting the registers according to a frame shift control signal 24 or a line shift control signal 25 every frame or every line. In the present invention, although the explanation is made with a shift amount when shifting to the right, a similar effect can be obtained when shifting to the left. This is because, (left shift amount)=(all bits number)−(left shift amount), and this is merely a difference in numeric expression.

Figure 3:
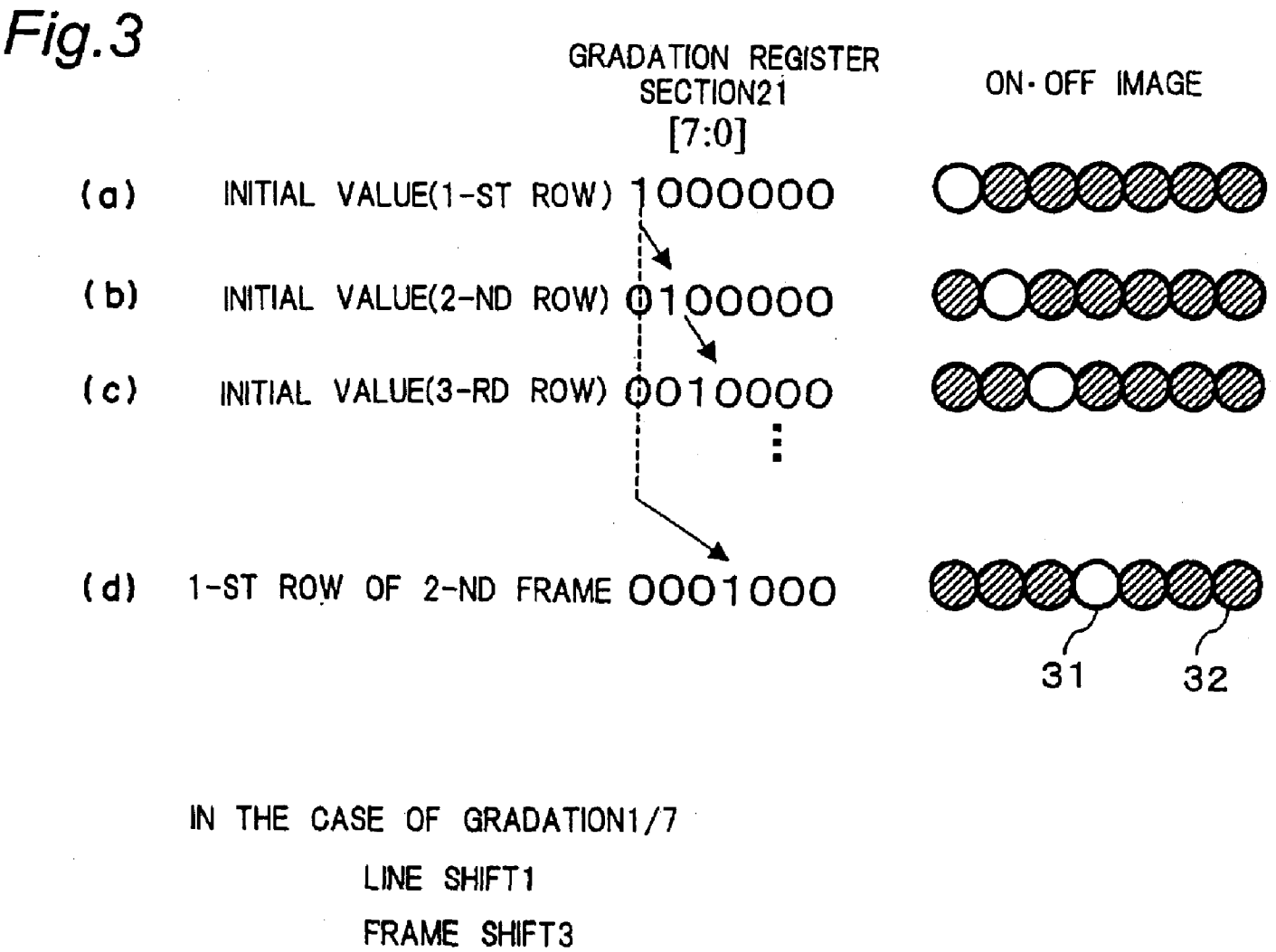
FIG. 3 is an explanatory view showing a shift process and an ON/OFF image of a gradation register section shown in FIG. 2.

FIG. 3 shows states of the registers to be shifted. This shows an operation performed in the gradation register section 21 in FIG. 2. This is a case of gradation 1/7 where a shift amount (line shift) on every line is 1 and a frame shift is 3. For brief explanation, a shift on every display color is disregarded, and the explanation is made with a R output monochrome. In FIG. 3, a white circle 31 indicates an ON pixel, and a inclination-lined black circle 32 indicates an OFF pixel.

Since the gradation is 1/7 where one time of ON is included in 7 frames, the register has a bit width same as the frames number. In addition, one piece of 1 indicating ON is included (of course, it may be also possible that ON is indicated as 0 and the number of 1 and 0 may be reversed).

After outputting the first row, the registers are shifted rightward by an amount of a line shift corresponding to a gradation which is a shift amount indication signal 26 based on a line sift control signal 25. As shown from (*a*) to (*b*) of FIG. 3, the register is shifted by one rightward. Also, in the second to third rows, as shown from (*b*) to (*c*), there is a shift by one in the third row with respect to the second row. This operation is repetitively performed from the first row to the last row. Namely, assuming that the line shift amount is L, the register output on the N-th row is equal to that obtained by shifting rightward by L bits from the register output on the (N−1)th row (where N is a natural number in a range of 2 or more and equal to or smaller than the number of display rows).

Meanwhile, the change in the register outputs from the last row of the first frame to the first row of the second frame becomes a result obtained by changing by the frame shift amount from the register output on the first row of the previous frame precedent by one frame as shown in FIG. 3 (change from (*a*) to (*d*)). In general, the output of the gradation register section 21 on the first row of the M-th frame results in that obtained by shifting rightward by a frame shift F from the register output of the (M−1)th frame (where M is a natural number of 2 or more, and when M=1, the initial value of the register is used).

As described above, the reason why the shift from the last row to the first row is different on every line is, to securely output all the bits of the gradation register section 21 with the frames number completing the FRC paying attention to one pixel, and to reduce flickers by random ON/OFF patterns by performing different shifts on every rows and every frames.

In order to display the gradation 1/7, since ON occurs one time in 7 frames, it can be securely expressed if the 7-bit outputs of the 7-bit gradation register are all in any order outputted in the 7 frames. In order to execute this, the shift processing of the registers is performed by the frame shift, and the frame shift control signal 24 for performing the frame shift is inputted every frame to thereby perform the shift of the gradation register section 21.

Figure 4:
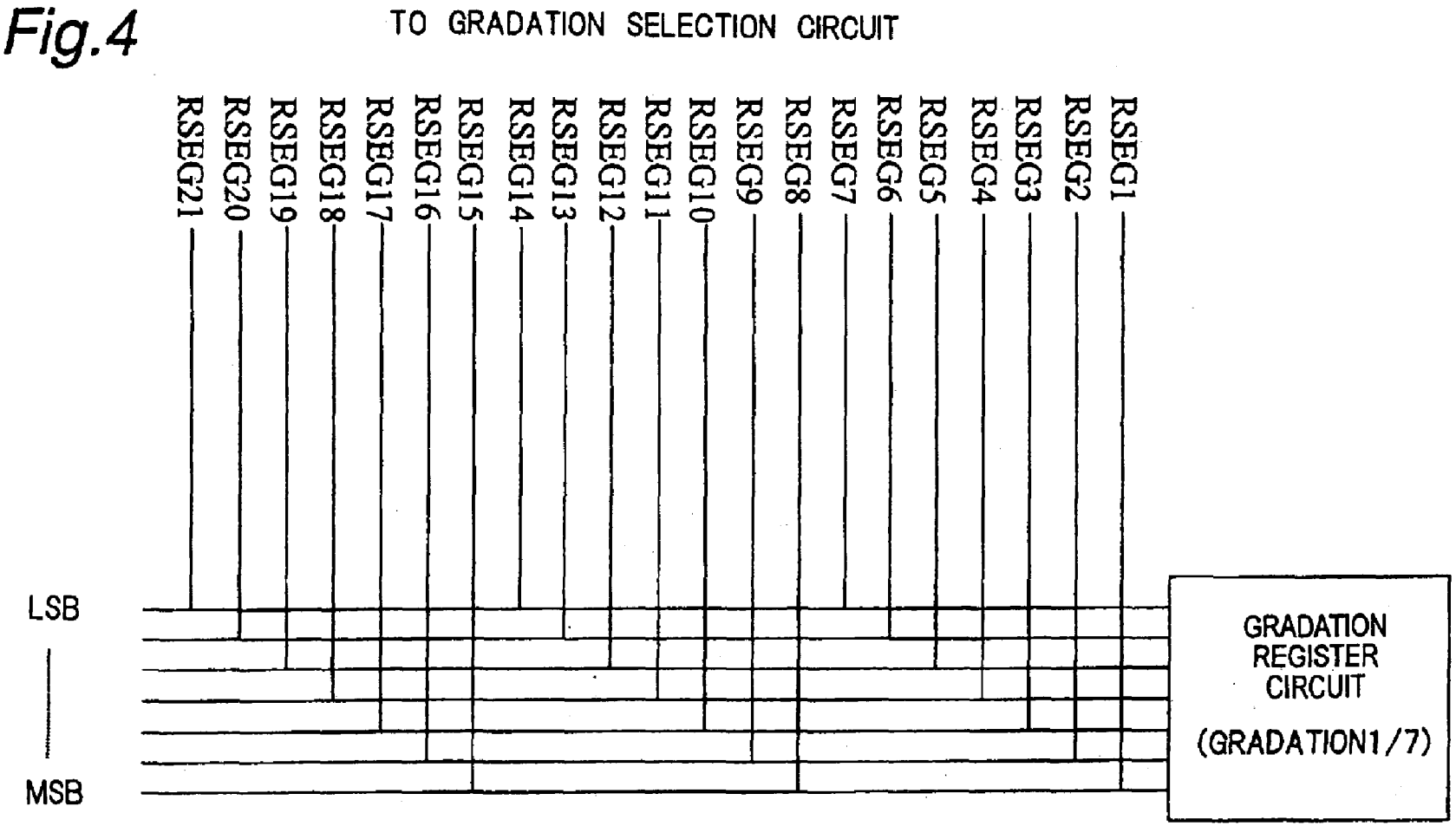
FIG. 4 is a diagram showing a construction of connecting outputs of the gradation register section shown in FIG. 2 to each row.

Moreover, a frame shift was performed as a means for spatially dispersing the ON/OFF patterns. As shown in FIG. 4, the outputs of the gradation register section 21 are arranged in a manner such that the most significant bit is connected as the first column and the second significant bit is connected as the second column, and so on to the i-th column in the case of an i-bit register. Next, the most significant bit is again connected as the (i+1)th column, and similarly connected in turn to the last column. Note that this is performed on every display color. By this arrangement, when watching the pixels on the same row, the ON/OFF patterns of the same ratio of the display gradation are dispersed to be displayed if the display columns number is a multiple of the bit number of the gradation register (in this case, it may be possible to connect to the first column from the least significant bit, instead of connecting to the first column from the most significant bit).

Figure 5:
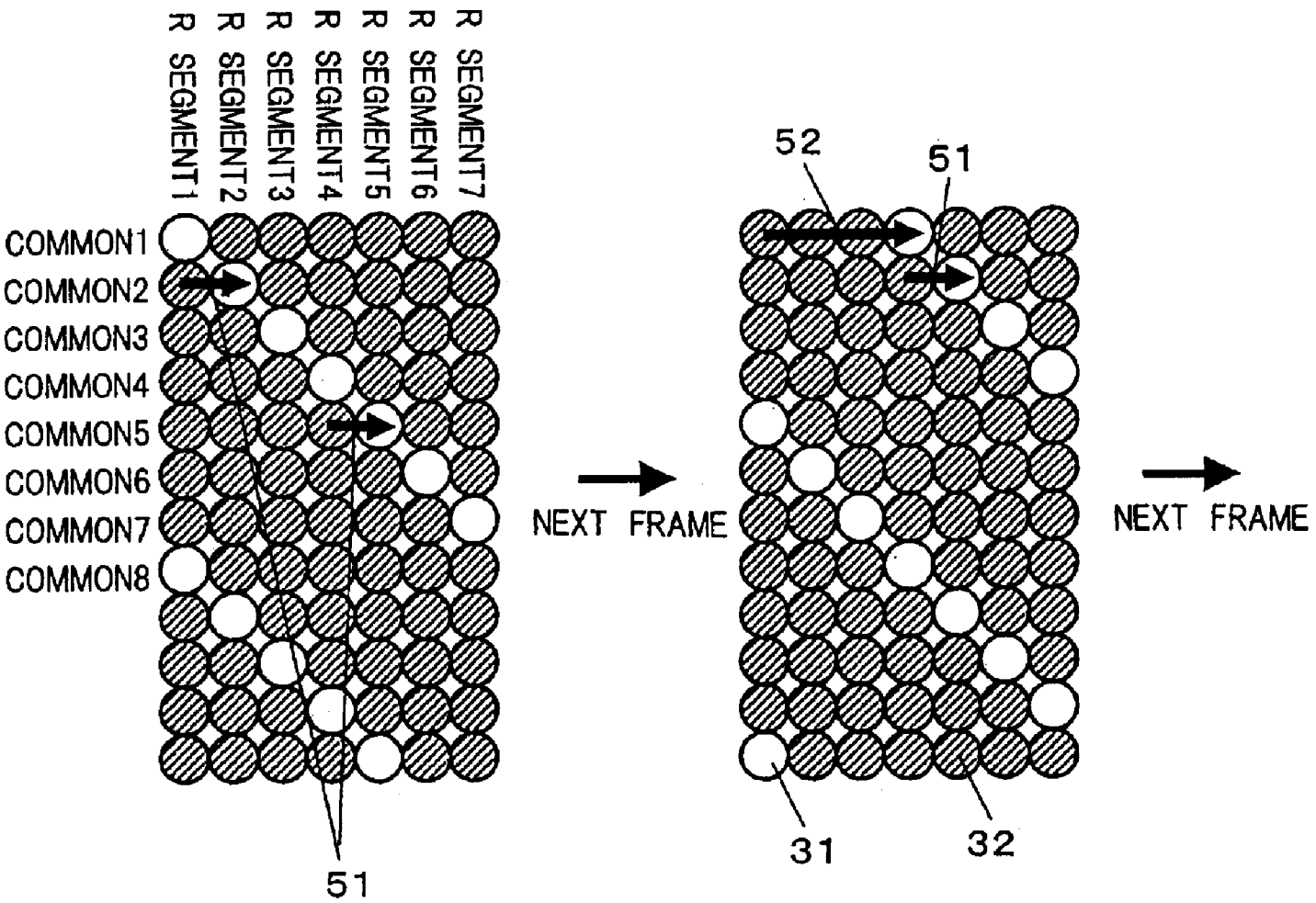
FIG. 5 is a diagram showing a dispersion arrangement of an ON/OFF pattern in the first embodiment of the present invention.

Moreover, it is possible to disperse the ON/OFF patterns by performing the line shift when paying attention to the pixels on the same column. This can be realized by inputting the line shift control signal 25 every one row. In the case where a line shift is not performed, although the ON/OFF pattern on the same column is not dispersed, by performing the line shift, it becomes possible to display the ON/OFF pattern at the same ratio of the display gradation also in the column direction in the case of performing the same gradation display on the entire screen as shown in FIG. 5. In FIG. 5, 51 indicates a line shift (i.e., 1 in this case), and 52 indicates a frame shift (i.e, 3 in this case).

By this arrangement, as shown in FIG. 5, it is possible to disperse the ON/OFF patterns in-plane and inter-frame. In addition, since the three primary colors display is performed on a color panel, pixels of red, green and blue or pixels of cyan, yellow and magenta are generally alternately adjoined, but the ON/OFF pattern of the pixels on a monochrome panel is shown in order to express the effect of the line shift and the frame shift.

In addition, since the bit length of the gradation register section 21 or the number of 1 indicative of ON are different on every gradation, different registers are prepared for these different gradations so that different patterns are outputted for each gradation as shown in FIG. 2.

In the patterns for each gradation, as shown in FIG. 1, each gradation is inputted to the gradation selection section 14 one by one bit, and the patterns corresponding to the gradation data sent from the video signal 13 are outputted to the display data lines 15 and sent to a display section. At this time, since the gradation 0 and gradation 1 are always OFF or ON, it is not necessary to spatially or time-basely disperse the pattern, and it is possible to response under the control by the gradation selection section 14, and therefore the patterns are not stored in the gradation register circuit 12. By this arrangement, the number of the input signal lines of each of the gradation selection sections 14 can be reduced and the circuit scale can be reduced.

Although the explanation is made by monochrome in the above description, the three primary colors are used to perform a color display in a color display device. Since the three colors are red, green and blue in many cases, the display device of the present invention is described using these three colors, but similar effects can be obtained also in a display device using three colors of cyan, yellow and magenta. Note that the present invention can be applied to two colors display of red, blue or the like. Also, the present invention can be applied in the case of four or more colors display such as red, green, blue and yellow.

Although it is considered that the flickers are reduced by shifting the ON/OFF timings of the pixels adjoining in the same color, the adjoining pixels are different colors in many cases in a display device performing a color display as shown in FIG. 6. In FIG. 6, 61 denotes a pixel displaying the first color, 62 denotes a pixel displaying the second color, and 63 denotes a pixel displaying the third color. Even in a stripe arrangement as shown in FIG. 6(*a*) and a delta arrangement as shown in FIG. 6(*b*), it is found that different colors pixels are adjoining in more cases compared to the same color pixels. Also, a method of laterally arranging the same color is similar in the stripe arrangement. Of course, even in the delta arrangement is similar.

The changing of the ON/OFF timings between the different colors pixels like this is effective for further reduction of the flickers. Therefore, as shown in FIG. 2, difference register outputs are performed for every display colors (for example, red, green and blue) in the same gradation. In the example shown in FIG. 2, upon receipt of the first register output (gradation pattern data) 23, the register value is used as it is for the red display pixel (referred to as "R" pixel, hereinafter), and then for the green color display pixel (referred to as "G" pixel, hereinafter), the output register value is shifted by a bit number designated by the G shift (shift amount designation signal 26*c*) and is outputted from the reference position changing section 22*a*. Similarly, for the blue color display pixel (referred to as "B" pixel, hereinafter), the output register value (gradation pattern data) 23 is shifted by a bit number designated by the B shift (shift amount designation signal 26*d*) and is outputted from the reference position changing section 22*b*.

This operation is separately performed for every gradation, and since the values of the G shift and B shift can be different on every gradations, it is possible to display with further reduced flickers. In addition, the shift processing is merely performed on the input value by the bits determined by the G shift and B shift in the reference position changing section 22, and therefore a latch processing is not necessary and a register is not necessary. The flicker occurrence degree is not different in comparison with the case of having three colors gradation register sections 21 for one gradation, and the number of the registers becomes one third and therefore an IC can be designed with a reduced circuit scale.

Figure 7:
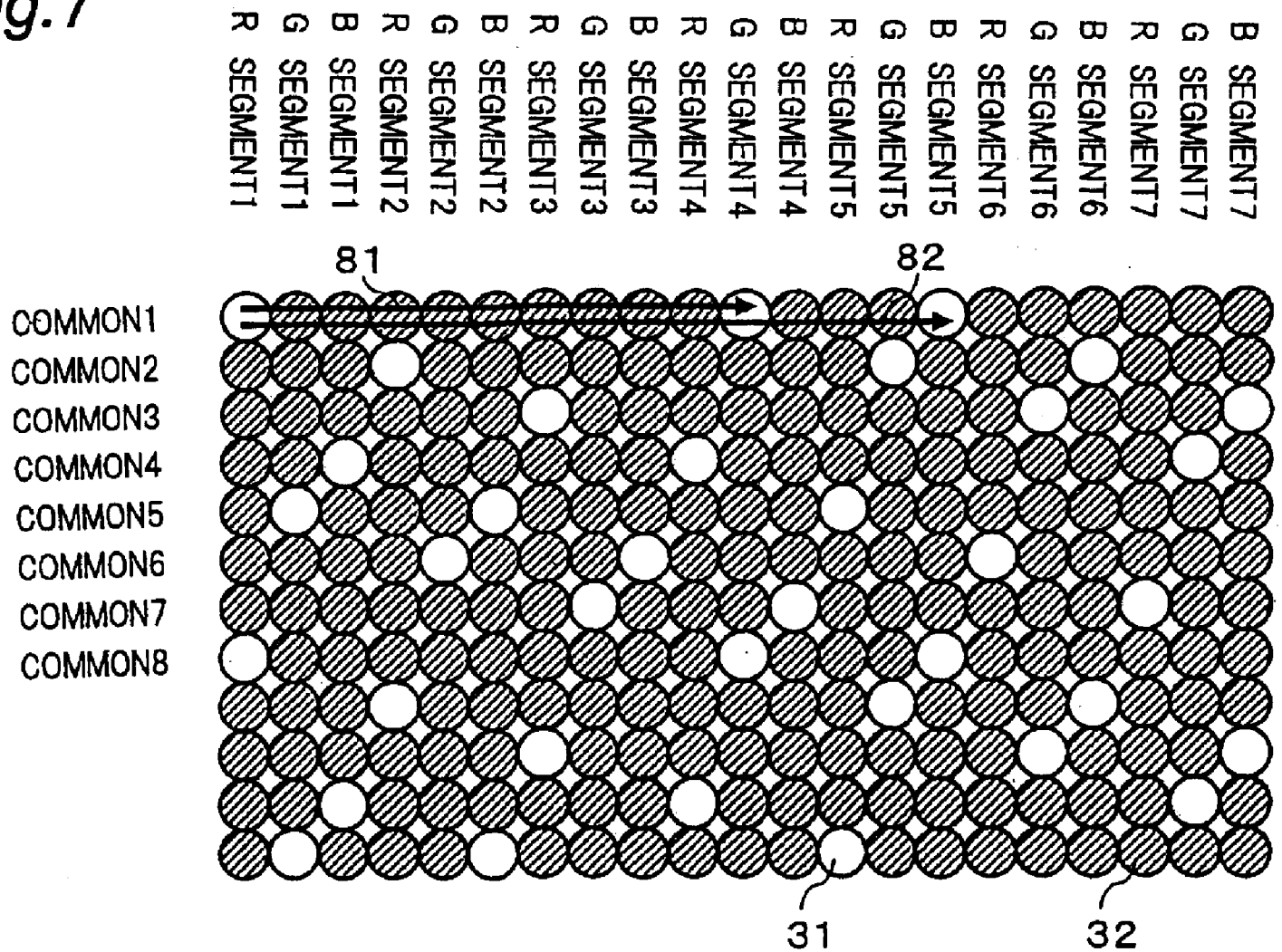
FIG. 7 is a diagram showing an ON/OFF pattern with respect to the three primary colors in a gradation 1/7 in any one frame in the first embodiment of the present invention.

FIG. 7 shows an ON/OFF pattern of the first frame in the case of entirely displaying the gradation 1/7 by the G shift and B shift. In this figure, 81 denotes the G shift (3 in this case), and 82 denotes the B shift (4 in this case). In comparison to the case of FIG. 8 where the G shift and B shift are not performed, the ON/OFF pattern can be made random.

Although the method for suppressing the flickers was described in the case of the gradation 1/7, flickers can be suppressed by using the line shift, frame shift, G shift and B shift similarly for another gradation. In general, in the case of performing a display of J/K gradation (here J and K are natural numbers having a relationship of J<K), the bit width of the gradation register section 21 is K, and it is sufficient that the number of bits indicating ON exists J pieces among them. Though the arrangement of the bits indicating the J pieces of ON is optional, it is desirable that the J pieces of ON are continuously arranged in the initial state of the register in order to reduce the flickers by a shift processing.

Regarding the shift except for a frame shift, the shift amount may be optional in a range from 0 to (K−1), but regarding the frame shift, all of the bits of the K-bit register are necessarily displayed one time on each pixel without fail before completion of FRC (K frames in this case) although the order thereof is optional, and therefore assuming that the frame shift value is F, when a value of F×X (X is a natural number) is equal to a common multiple, the minimum value of X must be K or more.

The gradation register section 21, shift amount designation signal 26 and reference position changing section 22 are prepared for each gradation as shown in FIG. 2, and an ON/OFF pattern corresponding to each display color of each gradation is outputted. The method of outputting the output to each segment signal line is as described in the case of the 1/7 gradation with reference to FIG. 4, the most significant bit is connected to the first column, the second significant bit is connected to the second column, and so on connected to the i-th column in the case of the i-bit register. Next, the (i+1)th column is connected with the most significant bit again, and thereafter connected in the order up to the last column.

In this manner, the register output corresponding to each gradation is sent to each segment signal line one by one bit. There is provided a gradation selection section 14 on each of the segment signal lines as shown in FIG. 1, so that ON/OFF data is outputted in accordance with the gradation of the video signal 13. Note that FIG. 1 shows the case of performing a 7-gradation display displaying gradations 0 to 6. The reason why there is no gradation register corresponding to the gradations 0 and 6 is because these gradations are all indicative of OFF or ON, and in the case where the gradation 0 is inputted to the inside of the gradation selection section 14 from the video signal 13, an OFF signal may be outputted to the display data line 15 irrespective of the output of the gradation register section 21, and in the case where the gradation 6 is inputted, an ON signal may be outputted to the display data line 15 irrespective of the output of the gradation register section 21, and it is possible to deal with the cases within the gradation selection section 14.

Figure 9:
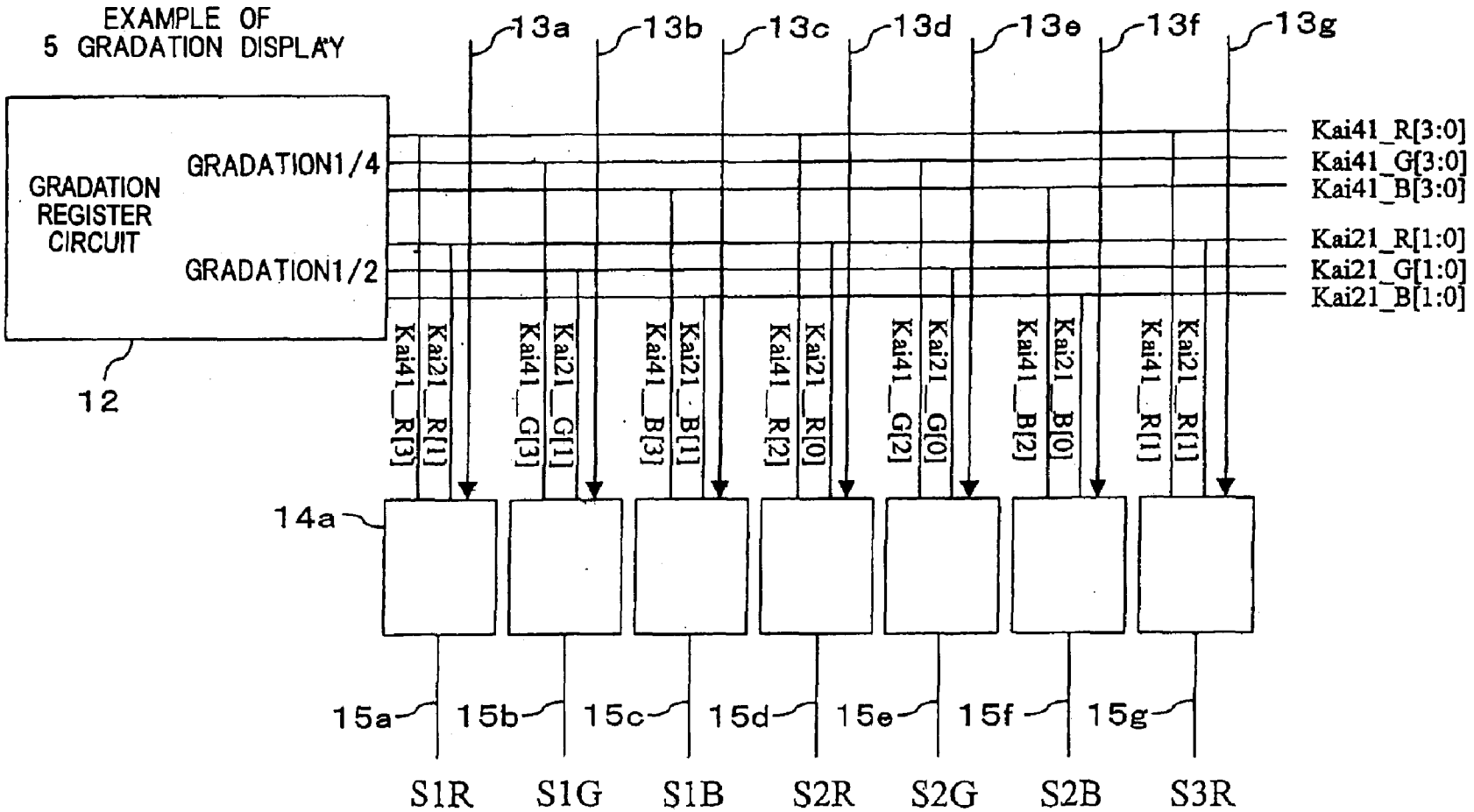
FIG. 9 is a block diagram showing a construction of a gradation control in the case of performing 5-gradation display in the first embodiment of the present invention.

FIG. 9 shows a relationship between the gradation register circuit 12 and the display data lines 15 when performing a 5-gradation display. Note that the respective gradations of the 5-gradation display are 0, 1/4, 1/2, 3/4 and 1. Note that, the third gradation may be 2/4, but the circuit scale for shift processing becomes large due to the bit width of the register being 4, and flickers easily occur because of increment of the frames number performing a FRC, and therefore 1/2 is preferable. In this manner, by independently shift-processing each gradation, a combination of FRC requiring frames number different for every gradations may be used. In addition, since the gradation 3/4 has an ON/OFF pattern inverse to ON/OFF of the gradation 1/4, the gradation register circuit 12 is commonly used and the gradation selection section 14 may decide whether the ON/OFF pattern to be outputted to the display data 15 is inverted or not. By this arrangement, the signal lines from the gradation register circuit 12 to the gradation selection section 14 are reduced in number, and the registers of the gradation register circuit 12 are reduced in number, so that the circuit scale can be reduced.

The outputs of the gradation register section 21 include three 4-bit outputs (Kai41_R, Kai41_G, Kai41_B) corresponding to each display color of the gradation 1/4 and three 2-bit outputs (Kai21_R, Kai21_G, Kai21_B) corresponding to each display color of the gradation 1/2. to the signal line outputted to the R pixel, the respective most significant bits of the respective gradation registers are inputted to the segment signal line 1 as the register output corresponding to the R pixel, and the lower bits lower one by one bit are inputted to the segment signal lines after the segment signal line 2 (the next of the least significant bit returns to the most significant bit again). The G pixels and B pixels are similarly arranged. In this manner, the ON/OFF data patterns are outputted to the respective signal lines.

Figure 10:
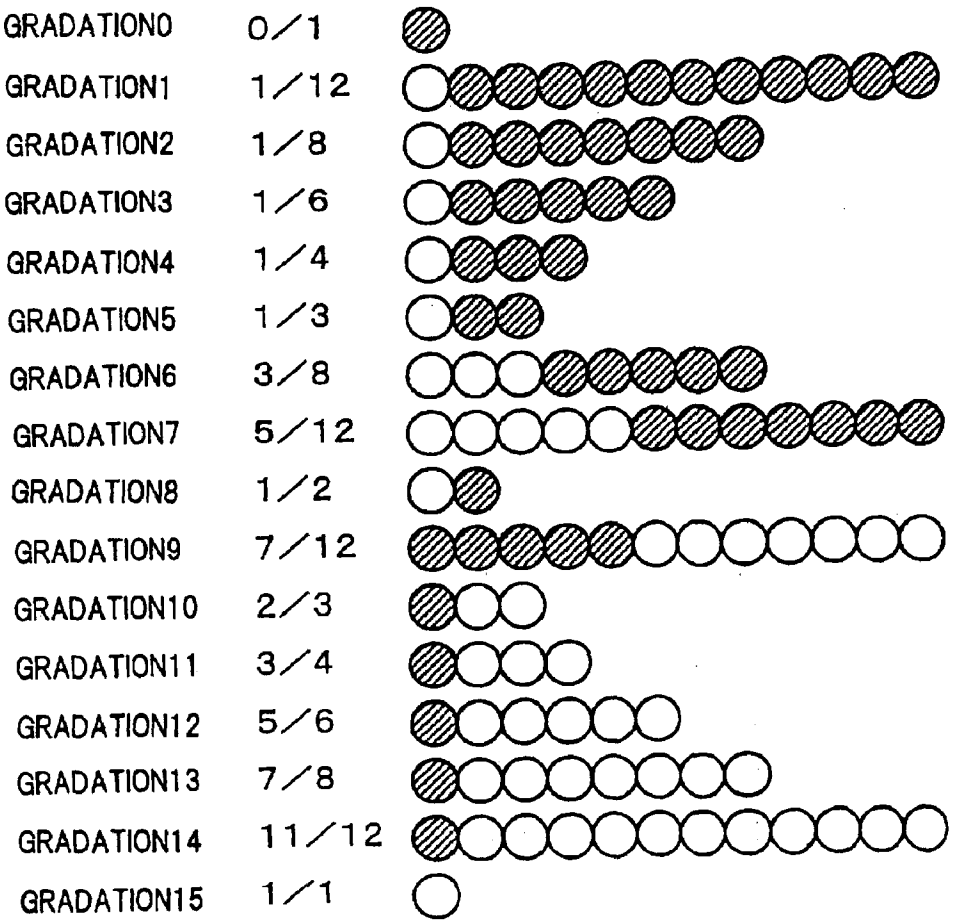
FIG. 10 is a diagram showing a gradation register used in the case of performing 16-gradation display in the first embodiment of the present invention.

FIG. 10 shows the initial values of each gradation register in the case of performing a 16-gradation display for each color, namely, 4096 colors display, using the invention described above. Although the minimum necessary frames in number for performing the 16-gradation display were conventionally 15 frames, the present invention can reduced to 12 frames. Moreover, though an increasing rates of ON rate are different between respective gradations, there is no obstacle for displaying Also, when 16 gradations are displayed, in a similar manner to the 5-gradation display, in order to reduce the number of the gradation register sections 21, common gradation register sections 21 are used between the gradations 1 and 14, 2 and 13, 3 and 12, 4 and 11, and 7 and 9, having the ON/OFF ratios reversed, so that the gradation selection section 14 determines which of ON and OFF is taken based on the input data when the value of the gradation register section 21 is 1, thereby reducing the circuit scale. By this arrangement, it becomes possible to perform a gradation display under the FRC.

(Embodiment 2)

In a simple matrix type liquid crystal display device, when performing a drive using a liquid crystal of a high-speed response characteristic for displaying a moving picture, there is a problem that contrast deterioration occurs due to a frame response.

Figure 11:
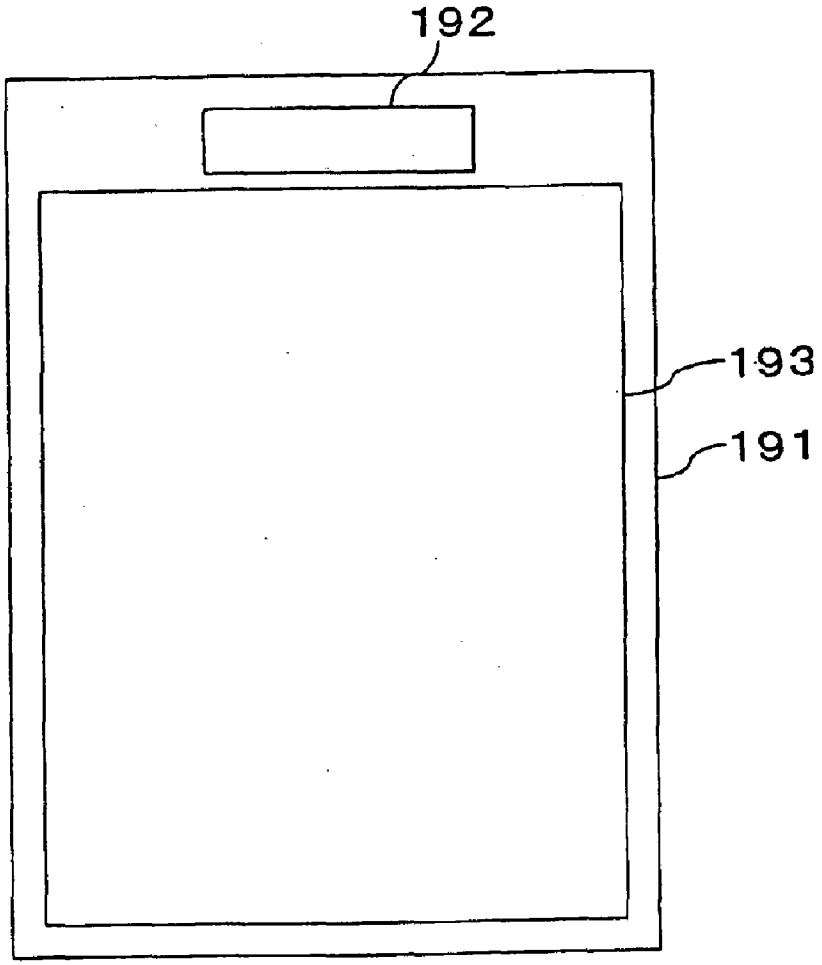
FIG. 11 is an illustration showing an arrangement relationship between a driver IC and a display section according to a second embodiment of the present invention.

As a method for solving this, a multi-line simultaneous selection method (Multi Line Selection Method: MLS) was proposed. In this method, common signal lines of multi lines (L rows) are simultaneously selected to apply a scanning voltage, and at the same time voltages in accordance with corresponding data are applied from the segment signal lines. This operation is performed until all of the common signal lines are selected, and further selection signals are applied at least L times from the common signal lines to one frame. Since the signals can be selected L times in one frame, it is possible to prevent the contrast from deterioration due to a frame response In addition, in a conventional line-sequential drive, in the case where 240-line display is performed using a liquid crystal having an ON voltage of 2.5 V, a voltage of the common signal line is 26.49 V and a voltage of the segment signal line is 1.71 V, and a voltage difference between the two signal lines is large. In the multi-line simultaneous selection method, the common signal line voltage is $26.49/L^{1/2}$(V) and the common signal line voltage is $1.71\times L^{1/2}$(V), so that the voltage difference between the common signal line and the segment signal line is reduced, and thus a circuit of the common signal lines and the segment signal lines can be designed in the same chip. Accordingly, as shown in FIG. 11, a driver IC 192 is mounted only at one side of a display section 193 on an insulation substrate 191, and the remaining three sides have no IC provided, to be advantageous that the display section is allowed to be placed symmetrically with respect to an equipment.

In the present invention, the gradation display was performed using a 4-rows simultaneous selection method (MLS 4). A voltage value in one frame period of each row of the common signal lines is decided by an orthogonal function shown in FIG. 12. The number of columns of this orthogonal function is equal to the number of the common signal lines, and the common signal line on the first column takes the first column values of the orthogonal function from the first row in the order in one frame to thereby output a voltage value corresponding to the data. Thereafter, the values of the second column indicate a change of the common signal line voltage of the second row, and the number of the columns indicates the number of the common signal lines. Meanwhile, time (sequence) is shown with respect to the row direction and one frame period is shown by the time ranging from the first row to the last row. Accordingly, the time of applying for one value is equal to (one frame period)/(rows number). Note that the present invention is not limited to the 4-row simultaneous selection method. For example, 2-row simultaneous selection method (MLS 2) may be used. That is, the present invention is applicable to any method of simultaneously selecting a plurality of rows.

Namely, the column corresponds to a change in time of a voltage waveform applied to the common signal line, and the row corresponds to the voltage waveform applied to the common signal line of the display device at one time.

Each element applies to the common signal line a positive selection pulse when 1, negative selection pulse when −1, and non-selection pulse when 0.

Figure 12:
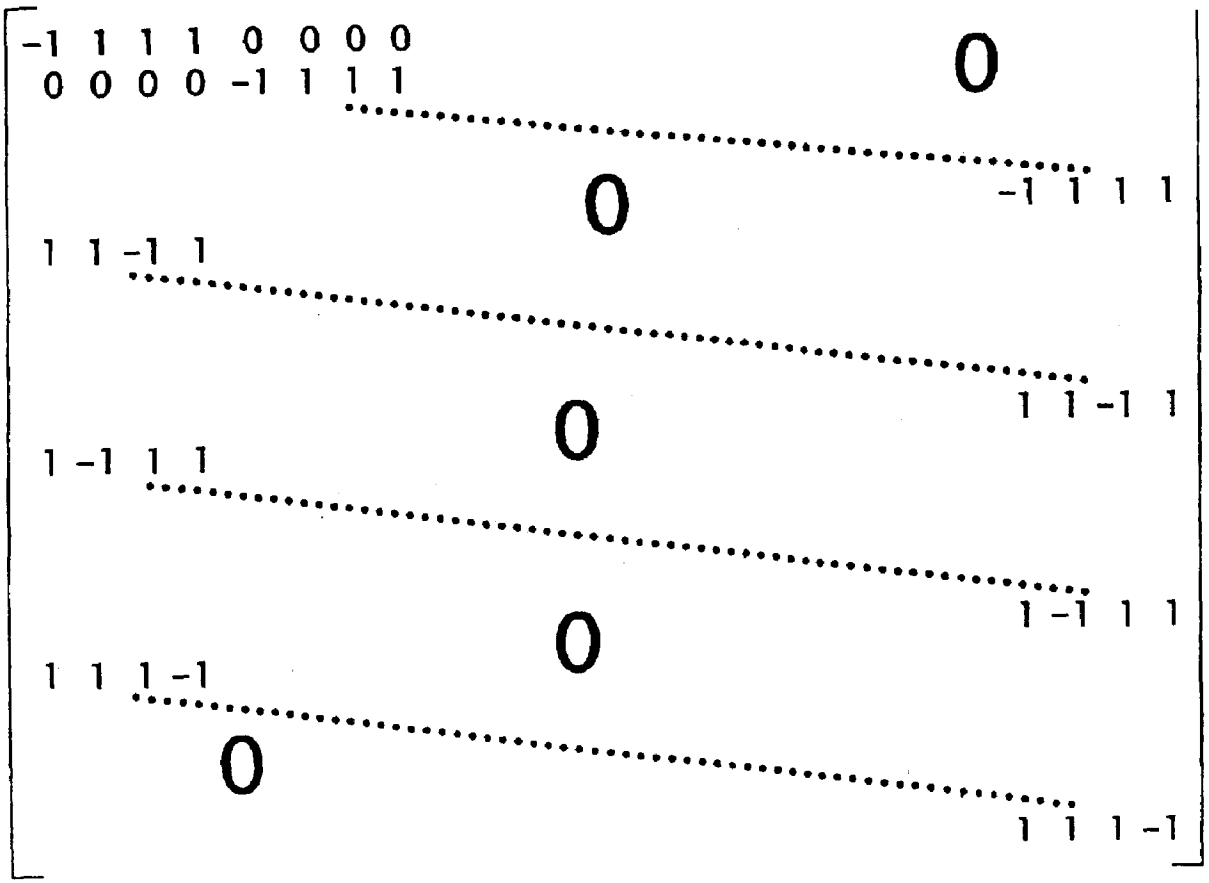
FIG. 12 is a diagram showing an example of an orthogonal function in the case of performing a drive by a simultaneous selection method of 4 rows in the second embodiment of the present invention.
Figure 13:
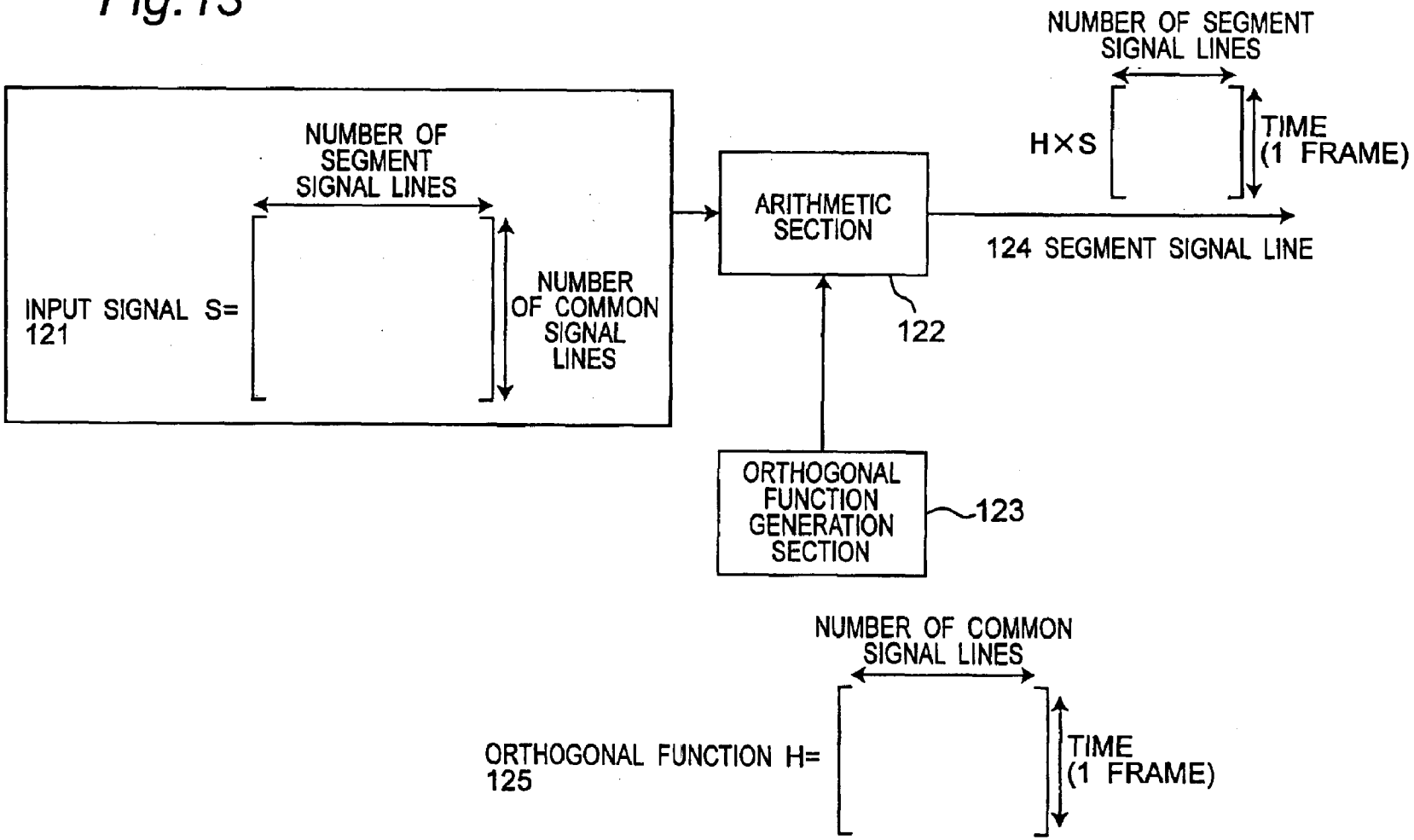
FIG. 13 is a diagram showing an arithmetic operation of an input signal and an orthogonal function in a multi-line simultaneous selection method in the second embodiment of the present invention.

Meanwhile, the voltage applied to the segment signal line is given by a multiplication result between a matrix of the input signal lines as shown in FIG. 13 and a matrix H of the orthogonal function shown in FIG. 12.

The input signal S121 has ON/OFF data corresponding to one frame, and is a matrix using binary values of −1 and 1 where −1 is ON and 1 is OFF. In addition, the number of rows is equal to the number of common signal lines, and the number of columns is equal to the number of the segment signal lines.

A voltage of five values is applied in accordance with the arithmetic result of H×S. The column corresponds to the number of the segment signal lines and the row corresponds to a time change of each of the segment signal lines.

The ON/OFF display of the pixels is performed in accordance with the voltage value applied in this manner between the segment signal lines and the common signal lines.

In order to calculate a voltage to be applied to the segment signal line at one time, respective elements of one row of the orthogonal function H125 and one column of the input signal S121 are required. Herein, as shown in FIG. 12, 0 is included in one row of the orthogonal function H125 except for 4 pieces, by taking an advantage of the fact that the arithmetic operation with the elements of the input signal S121 corresponding to 0 is always 0, a matrix calculation is performed between the pixel data performing the row selection and the elements of the selection signal. Thus, the circuit and time required for the calculation are reduce. Accordingly, in order to perform the segment signal output by the H×S matrix calculation, data of four rows amount is sent from the gradation selection section 14 and is multiplied with the orthogonal function in turn, and thereafter the sum of the data of four rows amount may be outputted. In addition, since a video signal is generally sent from upper or lower row in turn in a display region in many cases, it is desirable that the selected four rows are continuous four rows.

Figure 14:
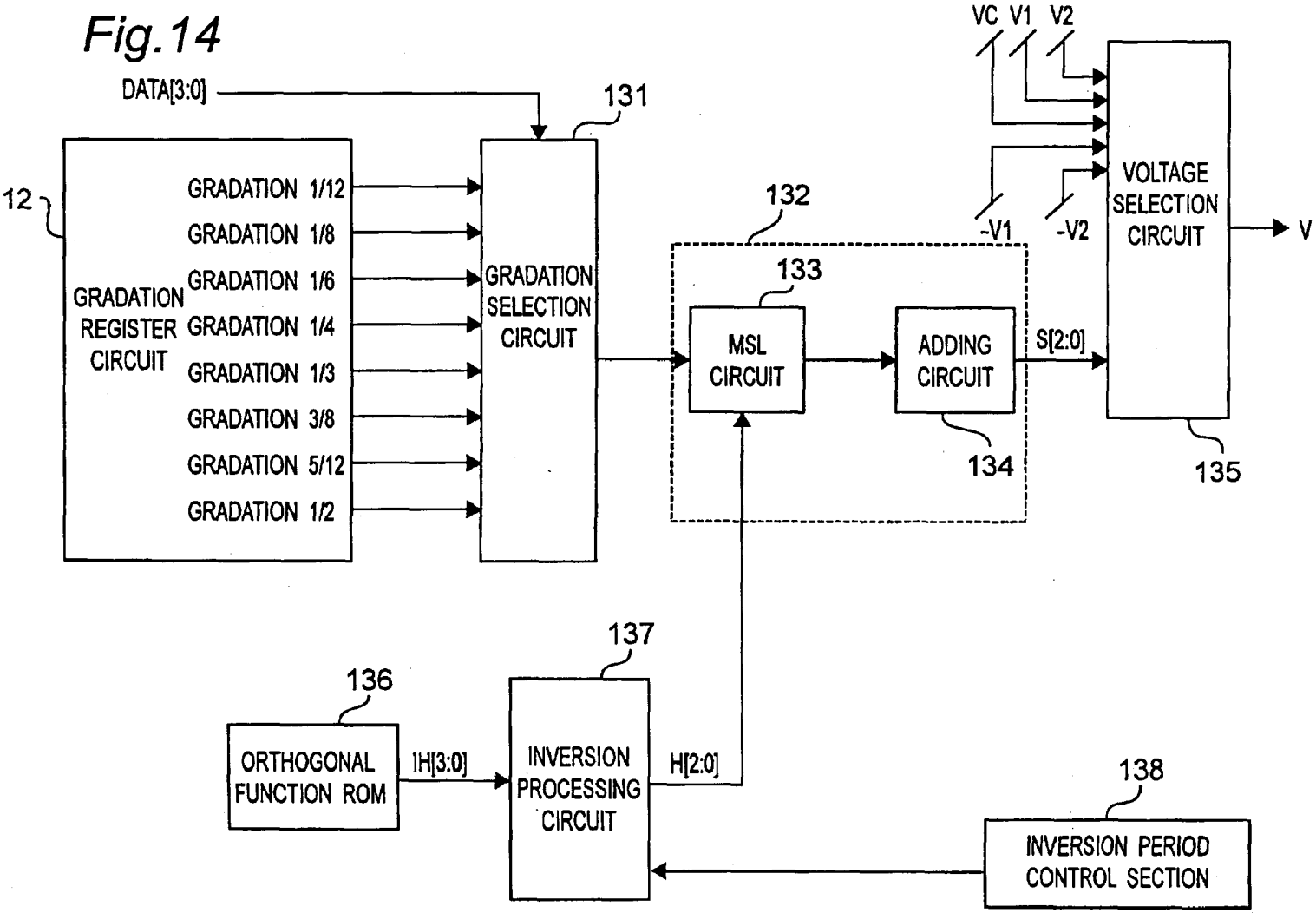
FIG. 14 is a block diagram showing an insertion position of an arithmetic section in the case of using a multi-line simultaneous selection method in the second embodiment of the present invention.

FIG. 14 shows a gradation register circuit 12, a gradation selection circuit 131, an arithmetic section 132 for performing a drive by the MLS, and a voltage selection circuit 135 for outputting a segment signal line voltage in accordance with the arithmetic result. Here, an inversion processing circuit 137 is provided for exchanging between a positive selection pulse 1 and a negative selection pulse −1 for applying an AC voltage to the display section.

After the data of four rows is sent from the gradation selection circuit 131 to the arithmetic section 132, there is an output from the arithmetic section 132, and therefore the data transfer from the gradation selection circuit 131 to the arithmetic section 132 may be performed either by a transfer at a transfer rate four times thereof or by a parallel transfer by simultaneously processing the four rows. In the present invention, an example of processing is described in the case of transferring at the four times of transfer rate.

The shift-processing was performed in the gradation selection circuit 131 and the gradation register circuit 12, and a gradation display was performed in the MLS drive under the FRC.

As a result, when V2, Vc or −V2 of the five values of the segment signal lines (voltage values V2(=2×V1), V1, Vc, −V1, −V2 in the descending order) is displayed, flickers and stripe-like unevenness along the segment signal line were conspicuous.

In the four-rows simultaneous selection method (MLS4), which voltage of the segment five values should be taken is decided based on the calculation between the input signal S121 and the orthogonal function H125 as shown in FIG. 13. the voltage values V2 in the case of the calculation result being 4, V1 in the case of 2, 0 in the case of 0, −V1 in the case of −2, and −V2 in the case of −4 are taken. When the orthogonal function H125 is given as shown in FIG. 12, in the case of the calculation result being ±4 or 0, the ratio of the ON and OFF pixels is 3:1 or 1:3 in the four pixels simultaneously selected.

When the ON/OFF pixels are dispersed as performed in FIG. 7, the ratio of ON and OFF pixels is apt to be 1:3 or 3:1 when paying attention to the continuous four rows (herein the rows are scanned in order from the first row). Especially, it is apt to be one of the gradation register sections 21 which turns ON (or OFF). In order to prevent this, there is a method of arranging the line shift values having the ON (or OFF) pattern located on the same column every two lines. In this method, there is a limit in values to be taken of the line shift, and the ON (or OFF) pattern is not located on the same column every two lines in such as a gradation 1/7 even if the line shift value is adjusted.

Therefore, the same ON/OFF pattern with even two rows and the same ON/OFF pattern with odd two rows are made among the simultaneously selected four rows, so that the ratio of the ON and OFF pixels is 2:2 or 4:0 (0:4) irrespective of the shift amount, and thus the flickers and stripe-like unevenness along the segment signal line were reduced.

Figure 15:
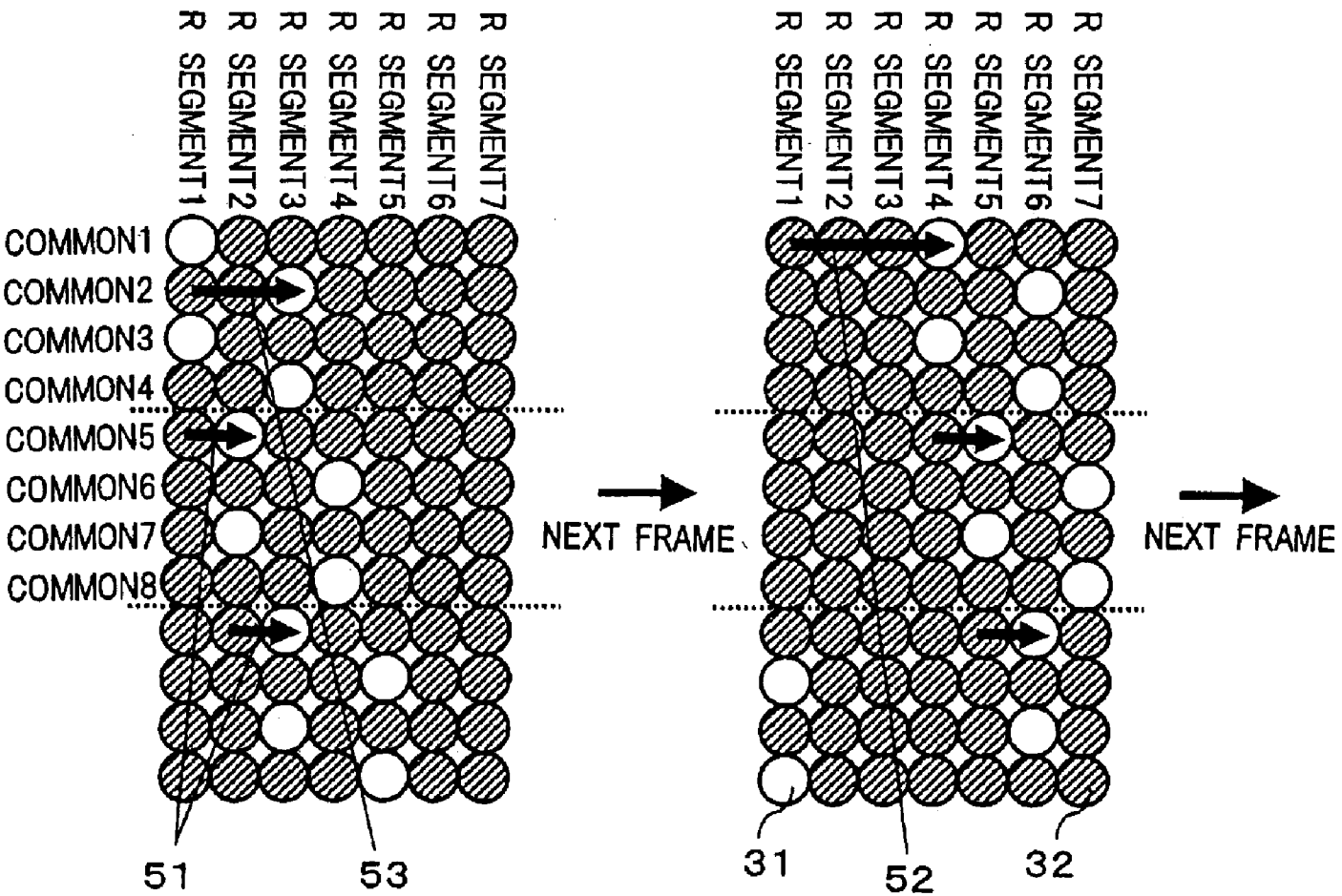
FIG. 15 is a diagram showing an example of an ON/OFF pattern in the second embodiment of the present invention.

FIG. 15 shows an ON/OFF pattern in the case of a gradation 1/7 of only R pixels. In this example, the explanation is made assuming that the common signal lines are selected every four rows from the first row in order. That is, the signal lines from common 1 to common 4 are first simultaneously selected, and then the lines of commons 5 to 8 are selected in the next period. When paying attention to the commons 1 to 4, the ratio of the ON and OFF pixels is 2:2 or 0:4 in the simultaneously selected four rows in each column, and therefore the voltage to be applied to the segment signal line is ±V1. In the G pixels or B pixels, since this pattern is merely shifted rightward (or leftward) entirely, the voltage to be applied to the segment signal line is ±V1 either in the G pixels or B pixels.

The shift changing the pattern of the even number rows among a set of the four rows to be simultaneously selected is even/odd shift 53. The line shift 51 is executed every change of a set of the four rows. A frame shift 52 is an amount of shifting the pattern in comparison with the previous frame pattern every change of the frame as is before.

Figure 16:
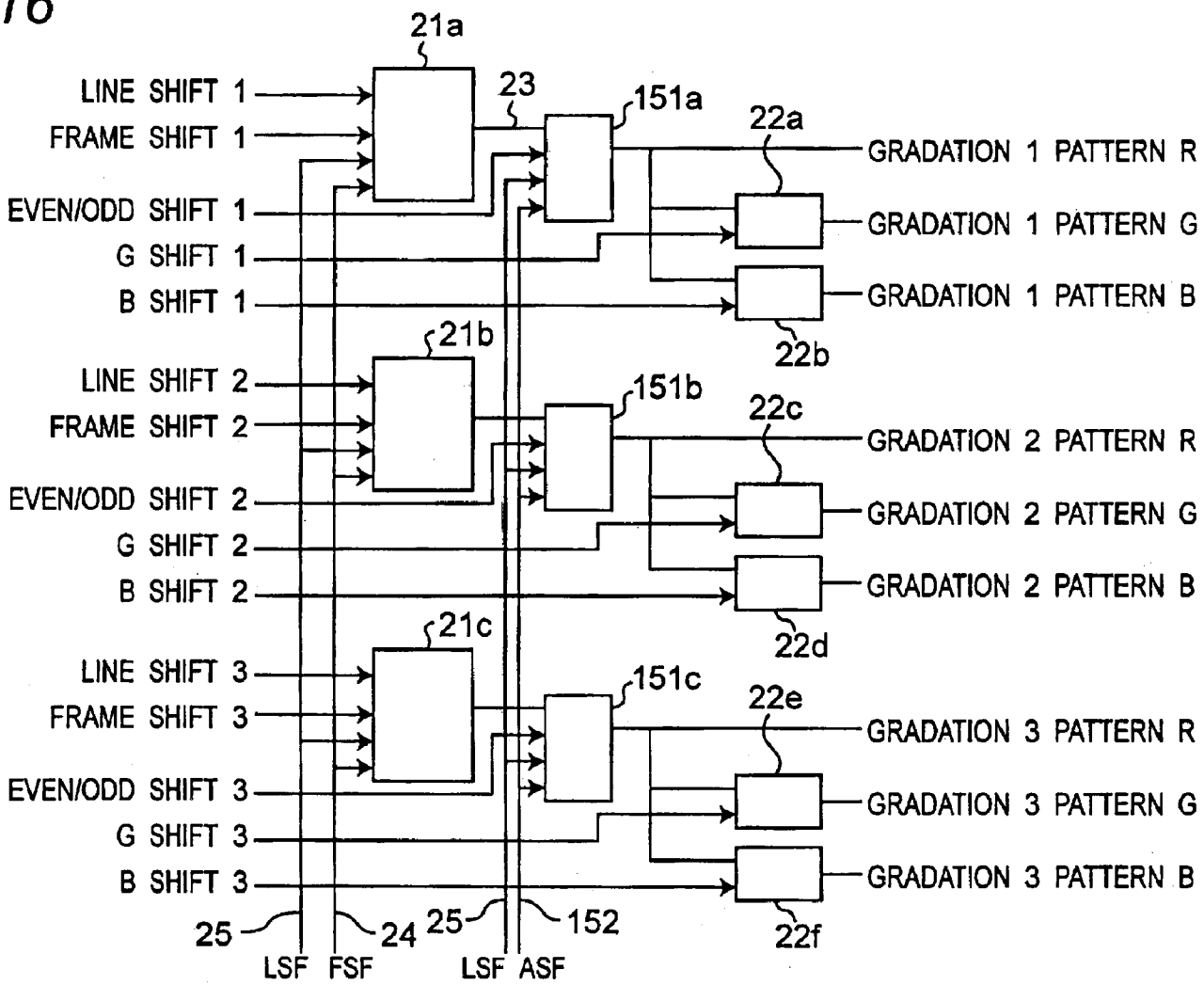
FIG. 16 is a diagram showing a configuration example of a gradation register circuit for generating the ON/OFF pattern shown in FIG. 15.

In order to realize the ON/OFF pattern like this, the configuration of the gradation register circuit 12 is changed from that shown in FIG. 2 to that shown in FIG. 16. The different points from FIG. 2 are that, in addition to the line shift control signal 25 and frame shift control signal 24 serving as one of the control signals for performing shift-processing of the registers, an even/odd shift control signal 152 is provided, and whereas the line signal control signal 25 generates a pulse every one row of the input video signal to perform a shift process in FIG. 2, the pulses are generated every four rows which the number is the number of the simultaneous selection rows and further a pulse is generated every one row on the even/odd shift control signal 152.

In addition, even/odd shift processing sections 151 are provided, and only when the outputs of the gradation register section 21 correspond to the even rows data among a set of four rows, the registers are shift-processed in accordance with the even/odd shift values.

Figure 17:
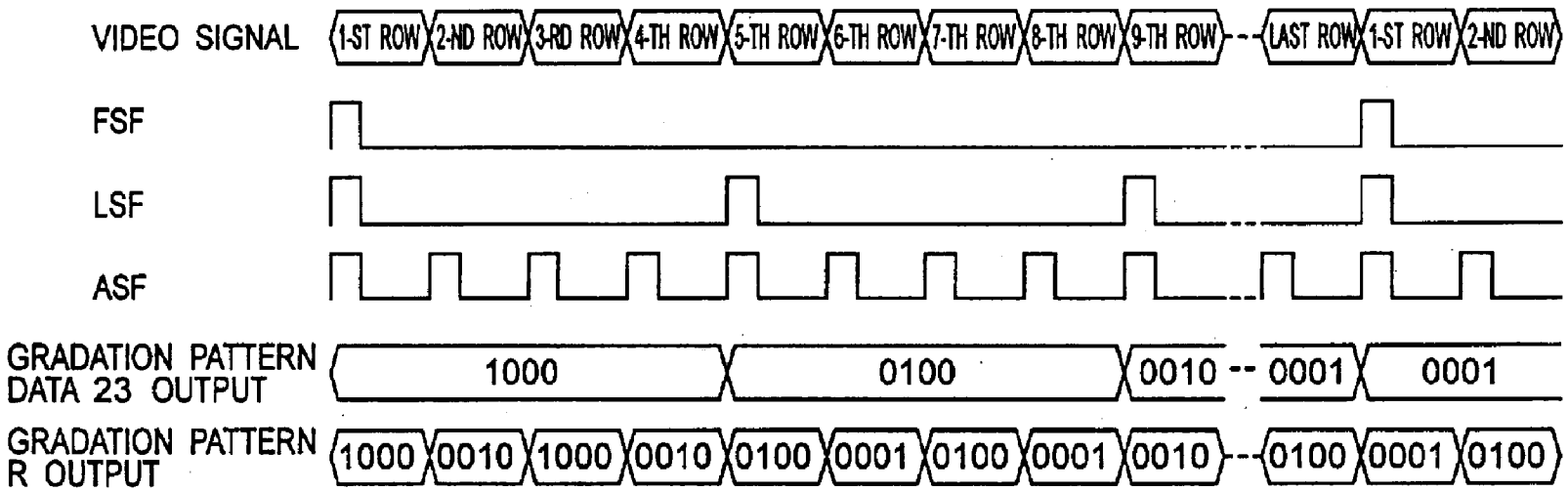
FIG. 17 is a chart showing input signal waveforms of control signals and register outputs in the gradation register circuit shown in FIG. 16.

FIG. 17 shows an input video signal and each of the control signals, and register pattern. In the gradation register section 21, when the frame shift control signal (FSF) 24 is inputted, the gradation register is shift-processed based on the frame shift amount. In addition, when the line shift control signal (LSF) 25 is inputted in the case of FSF 24 being not inputted, the gradation register is shift-processed based on the line shift amount. The frame shift for every frame and line shift for every four rows are thereby realized.

The even/odd shift-processing is performed in the even/odd shift-processing section 151 to detect the even number rows among the four rows simultaneously selected by the even/odd shift-processing signal (ASF) 152, and when the gradation pattern data 23 corresponding to the data of the even number rows is inputted, the gradation pattern data 23 is shift-processed in accordance with the even/odd shift value. In the case of the gradation pattern data 23 corresponding to the data of the odd number rows, the shift processing is not performed and the register is outputted.

The gradation pattern R is thereby outputted as shown in FIG. 17 in the case where the line shift is 1, frame shift is 3 and even/odd shift is 2 in the case of, for example, 1/4 gradation.

Figure 18:
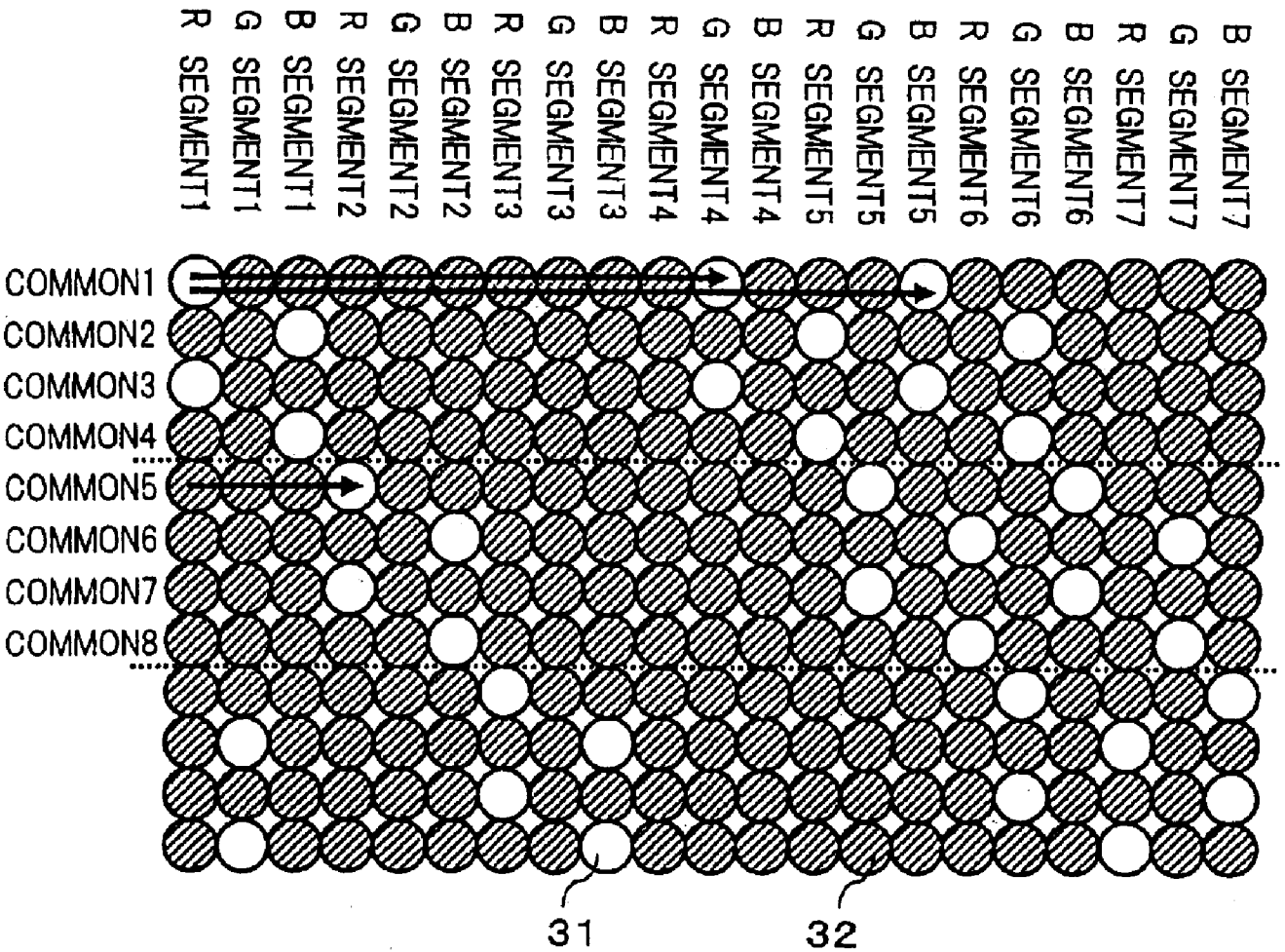
FIG. 18 is a diagram showing another example of an ON/OFF pattern in the second embodiment of the present invention.

FIG. 18 shows an ON/OFF pattern in one frame when performing a 1/7 gradation display for all of the three primary colors. Since the ON/OFF pattern is not 1:3 or 3:1 in the simultaneously selected four rows (commons 1 to 4, commons 5 to 8 and the like), ±V2 and Vc are not outputted and flickers and unevenness which may occur along the segment signal line can be reduced.

FIG. 19 shows values of the respective shift amounts when performing every color 16-gradation display (4096 colors display) using the gradation register shown in FIG. 10. When the shift like this is performed and the gradation control is performed under the FRC, it is possible to realize a display with few flicker at a frame frequency of 75 Hz.

Figure 8:
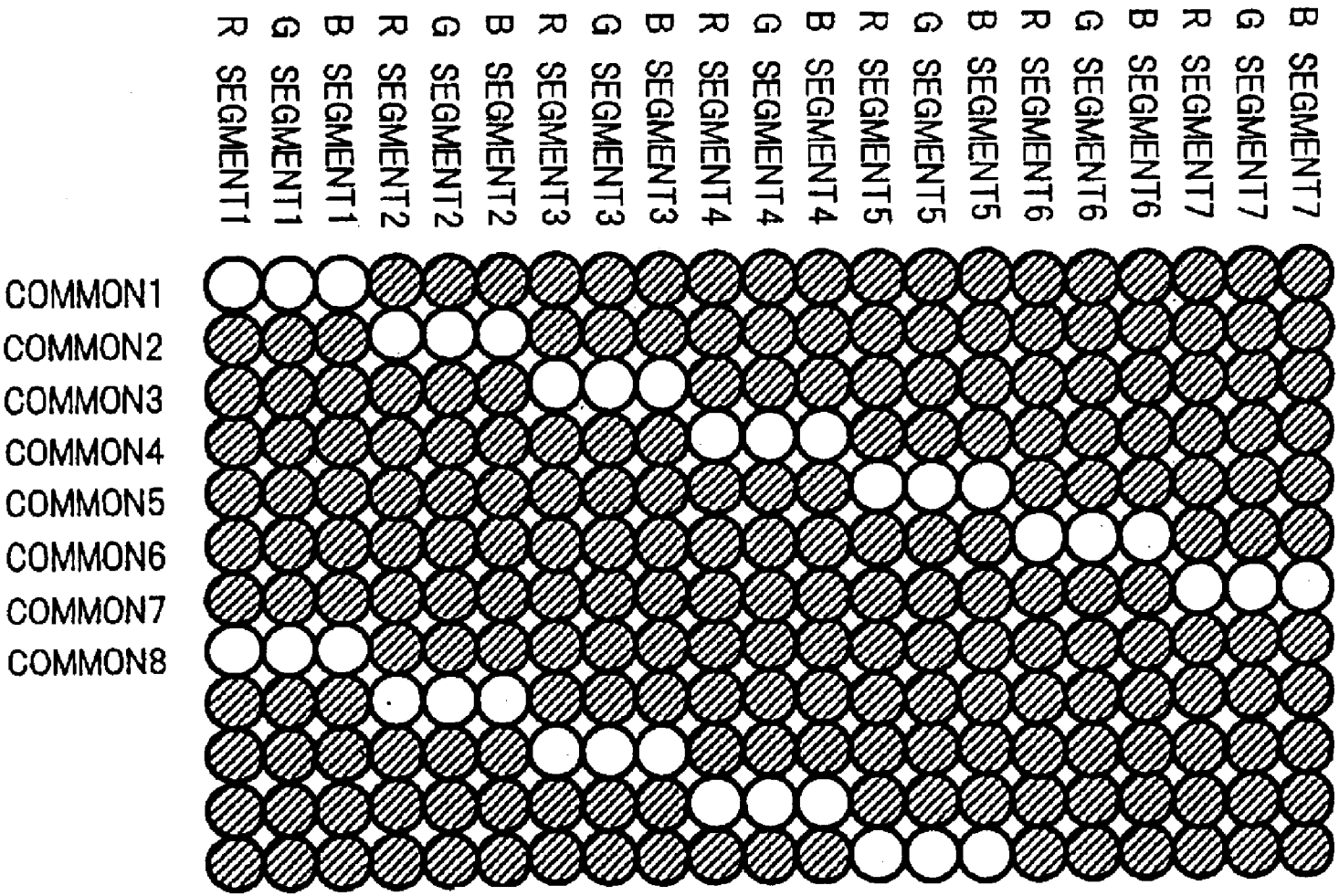
FIG. 8 is a diagram showing another example of the ON/OFF pattern in a gradation 1/7 in any one frame in the first embodiment of the present invention.

In the pattern of FIG. 18 compared to the pattern of FIG. 8, parameters for performing a shift are increased, and therefore the ON/OFF pattern can be made more random, so that a display with few flickers can be possible even at a low frame frequency.

The modified point for realizing the pattern of FIG. 18 is, as described with reference to FIG. 16, merely to increase a signal for controlling a shift amount by one and to provide the even/odd shift-processing section 151, and it is not always necessary to employ a multi-line simultaneous selection method. Execution is possible also in the conventional line sequential drive. In that case, the arithmetic section 132, orthogonal function ROM 136 and the like shown in FIG. 14 are not necessary, and it is only necessary to output the output of the gradation selection circuit 131 to the segment signal lines.

Figure 20:
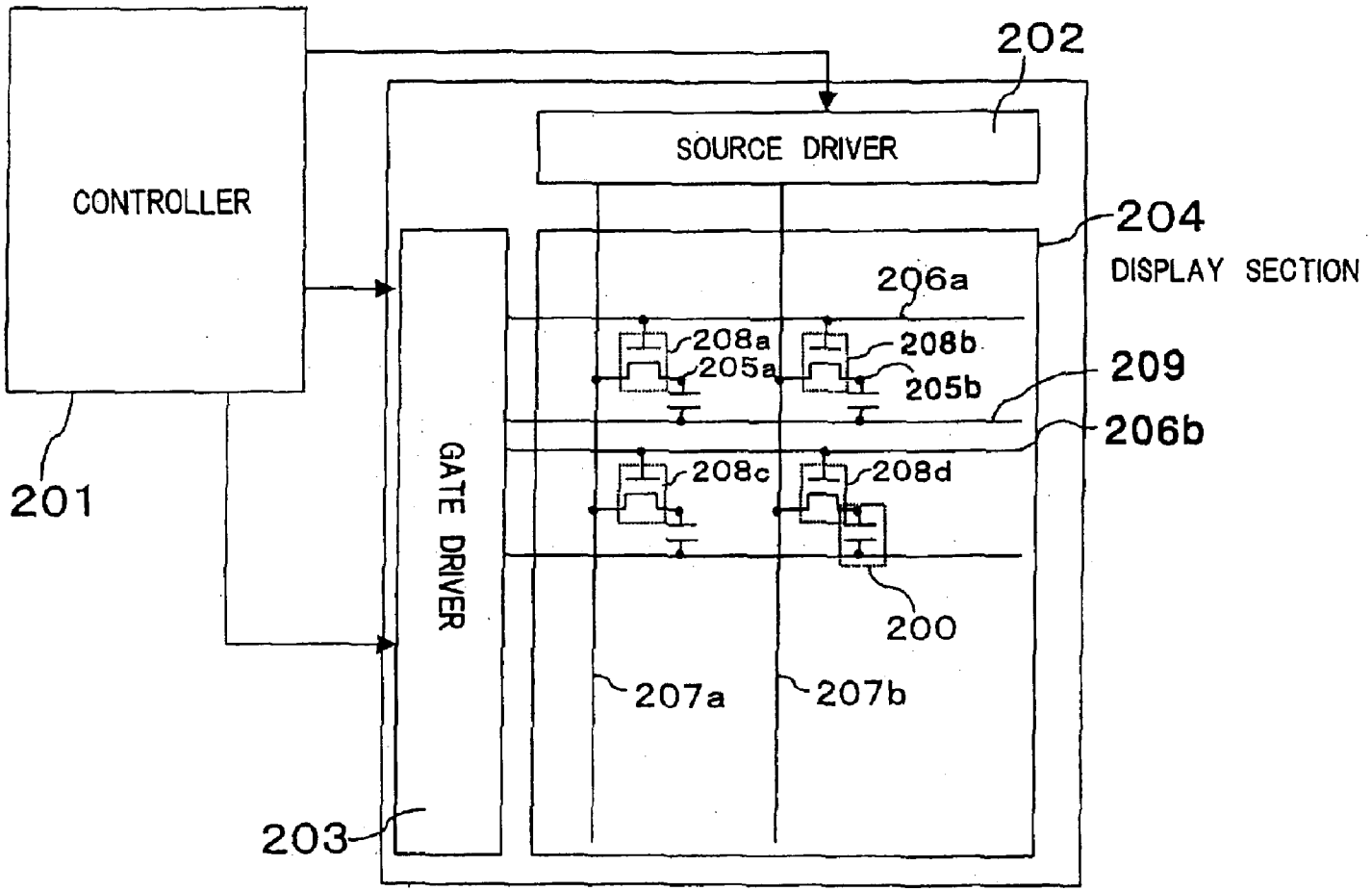
FIG. 20 is a diagram showing a construction of a display device in the case of using an active-matrix type display device in the second embodiment of the present invention.

As shown in FIG. 20, a gradation display under the FRC according to the present invention is possible also in an active matrix type display device using such as a thin film transistor (TFT). For example, this can be realized by outputting a voltage value corresponding to ON/OFF data outputted to the display data line 15 in accordance with a potential of an opposite electrode 209 in a source driver 202.

Moreover, as a display element, the present invention can be applied to not only a liquid crystal but also any display element which can express binary states of ON and OFF such as an organic light-emitting diode (OLED), light-emitting diode (LED), inorganic electro-luminescence (EL) element, plasma display panel (PDP), electric-field emission display (FED), and the like. Of course, if such as a MLS system is employed, the present invention can be also applied to a display element (display) which can express a state of 2 or more values.

Though the explanation is made as to the case of four-line simultaneous selection method of the multi-line simultaneous selection method, since L rows of the image data can be simultaneously transferred also generally in an L-line simultaneous selection, and therefore similar effects can be obtained by changing the pattern at every row.

If the display gradation number is increased by multi-coloring, the number of frames required for gradation display is increased in a gradation display under FRC, and flickers are easily generated. In order to suppress the occurrence of the flickers, it is necessary to increase the frame frequency. However, since the increase of the frame frequency results in increase of electric power consumption, it is desirable to drive at a possibly low frequency.

Therefore, a display is performed by a combination of a gradation display method under FRC with a pulse-width modulation method (PWM) or a pulse-height modulation method (PHM).

In this method in comparison to performing a gradation display using only the PWM, since the notching number of the pulse in one period is reduced, an effect of brightness difference due to waveform corruption caused by a resistance and floating capacity of a signal line or by a floating capacity of a load can be reduced to be advantageous.

In addition, in comparison to performing a gradation display using only a PHM, since the number of the voltage values required for the segment signal lines is reduced, a notching width between the gradations is increased so that an effect of a gradation inversion due to differences in output preciseness can be reduced. Moreover, it is also possible to delete an output digital-analogue converter and to selectively output one of the necessary voltage values by a selector.

(Embodiment 3)

Figure 21:
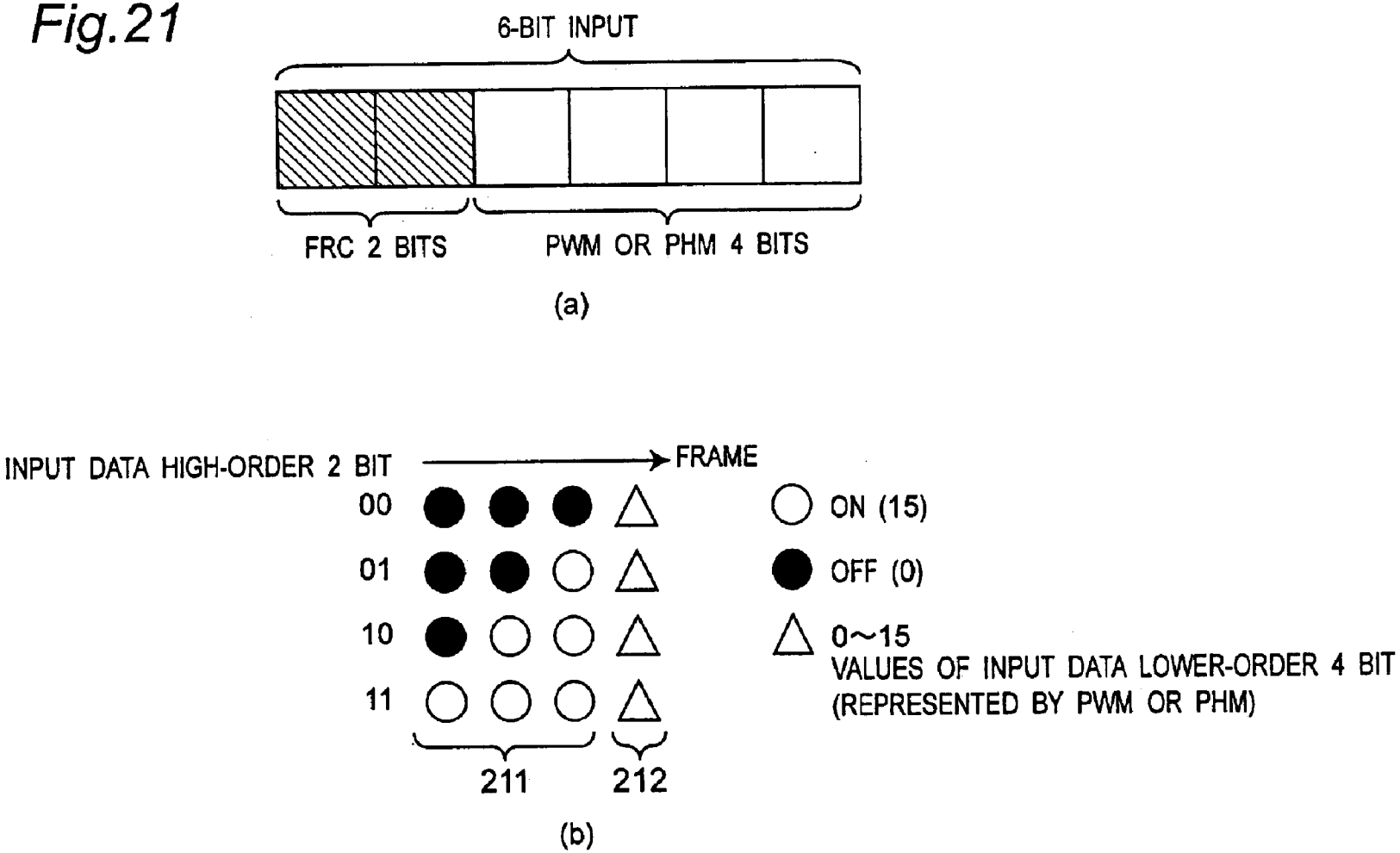
FIGS. 21(*a*) and 21(*b*) are illustrations showing an ON/OFF pattern of every frame in a gradation process according to a third embodiment of the present invention.

FIG. 21 shows a method of performing a gradation display using FRC together with PWM (or PHM) referring to 6-bit signal.

As shown in FIG. 21(*a*), assuming that, with respect to the 6-bit input, the more significant 2 bits are FRC-processed and the less significant 4 bits are subjected to PWM or PHM, since the FRC process is performed with 2-bit data, the number of frames required for FRC is three frames. The number of frames having ON and OFF among this is determined by the 2-bit data, so that an ON/OFF pattern like three frames shown by 211 in FIG. 21(*b*) is obtained. Note that a shift process for reducing flickers is not considered here and only a rate of ON and OFF is described. In fact, the frames to be ON are different according to pixels.

Next, the less significant 4-bit data is outputted as it is using one frame (212 in FIG. 21(*b*)).

By this arrangement, since four ways of gradations due to difference of the FRC and further sixteen ways of gradations due to the frames of 212 are respectively taken, it is possible to perform 64-gradation display.

Note that, this method is not limited to 6-bit input and is also executable to M-bit data, and PWM or PHM is performed with the less N significant bits (here M>N) and FRC is performed with the more significant (M−N) bits, so that displays of $2^{M-N}$ gradations under FRC and $2^{N}$ gradations under PWM or PHM respectively to a FRC pattern can be performed, and therefore $2^{M}$ gradations display can be performed.

Note that, referring to N value, M>N>0 is preferable, but when N is small, the number of frames is increased and the frame frequency is required to be raised for preventing flickers, and moreover there appears a gradation difference because of decrease of a horizontal scanning period due to increase of the frame frequency and decrease of one pulse width, and therefore a result of M−N<4 is desirable. At this time, since a 16-gradation display is performed under FRC, the display at a frame frequency of 75 Hz can be performed using the flicker processing method and the gradation registers described in Embodiments 1 and 2.

Figure 22:
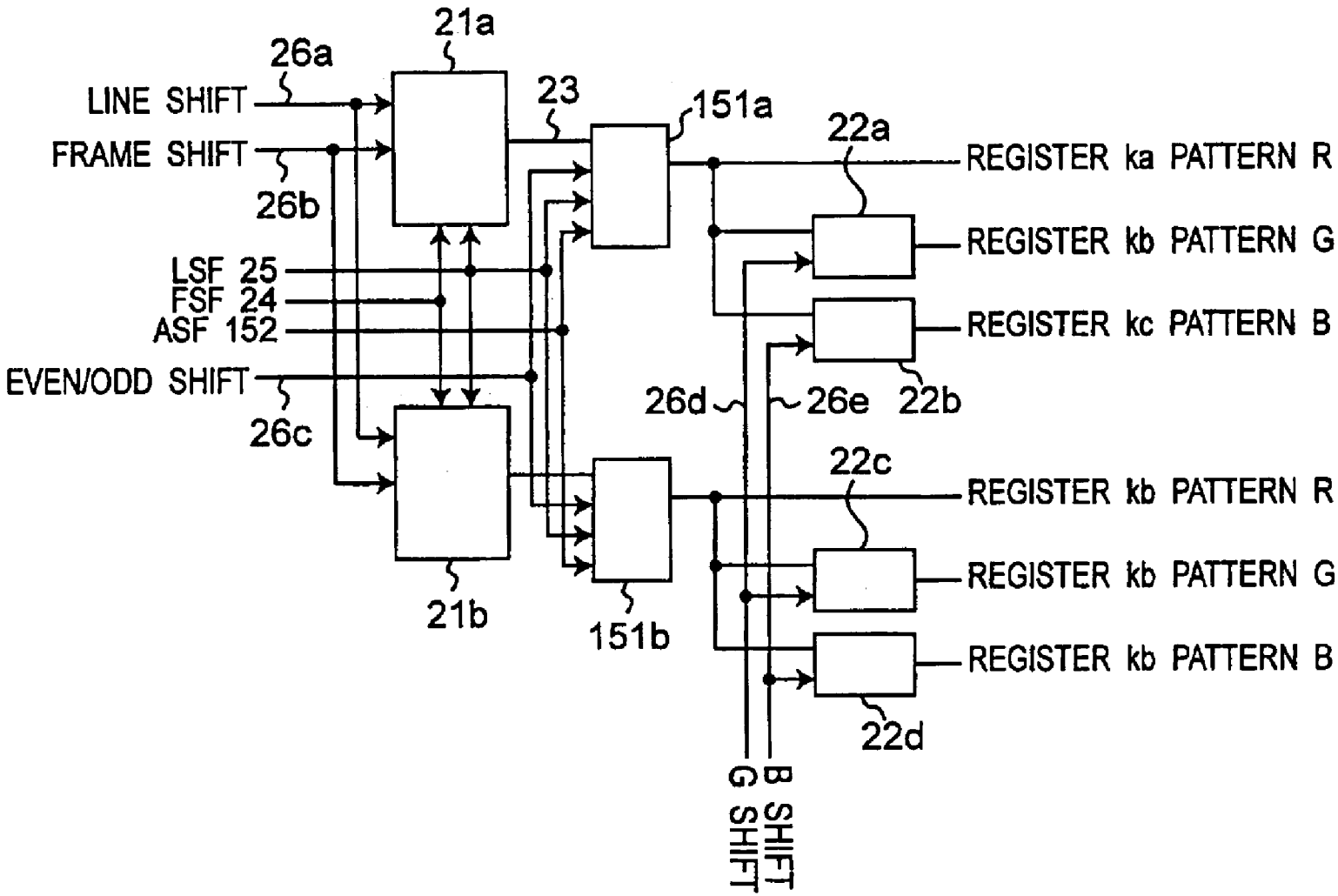
FIG. 22 is a diagram showing an internal configuration of a gradation register circuit in the case of performing the gradation display shown in FIG. 21.
Figure 23:
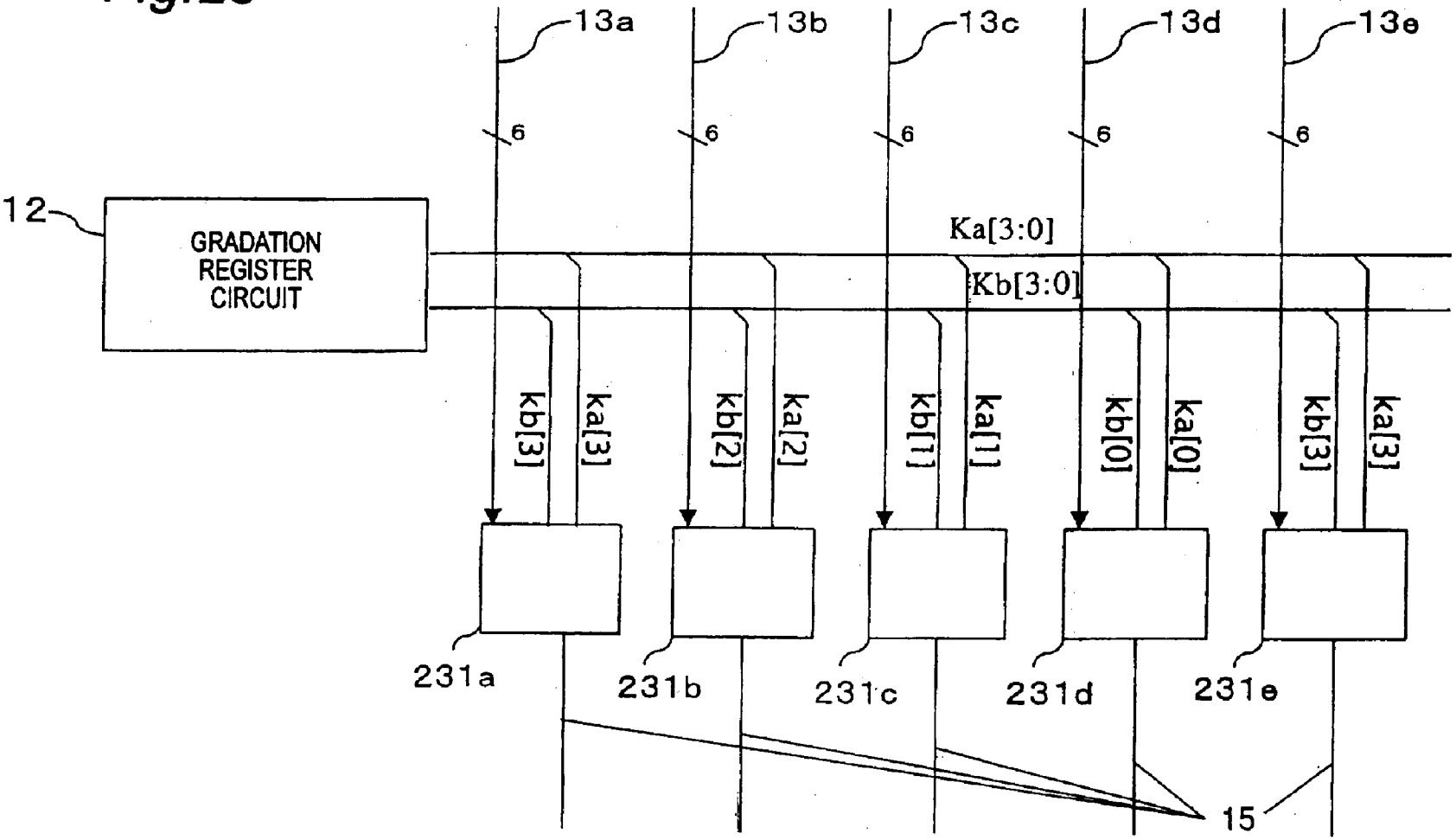
FIG. 23 is a diagram showing an arrangement relationship between the gradation register circuit and the gradation decoding section in the case of performing a video-signal processing as shown in FIG. 21.

FIGS. 22 and 23 show a method of realize the pattern as shown in FIG. 21 and a method of varying an ON/OFF pattern by the pixels within the same frame. The explanation is made here in the case where the video signal 13 is 6 bits and 16 gradations are expressed through PWM or PHM. The number of frames required for expressing the entire gradations is four frames as shown in FIG. 21(*b*). Accordingly, the bit length of the register stored in the gradation register section 21 is 4 bits.

In FIG. 23, in the case of the more significant 2 bits value of the video signal 13 being 0, only 1 bit among 4 bits is assumed to be 1 and the remaining 3 bits are assumed to be 0. The less 4 bits of the video signal 13 are outputted onto the display data lines 15 when 1. 0 indicative of OFF of FRC is outputted when 0. In the case where the value of the more significant 2 bits of the video signal 13 is 3, the less 4 bits of the video signal 13 are outputted onto the display data lines 15 when 1, and 15 indicative of ON of FRC is outputted when 0. The gradation register section 21 used at this time is assumed to be a register ka.

In the case where a value of the more significant 2 bits of the video signal 13 is 1 or 2, three patterns are generated in the 4 frames, i.e., outputting ON, OFF and the less significant 4 bits of the video signal. Accordingly, in order to determine the three patterns, three values of 0, 1 and 2 are necessary as the register values, and the gradation register section 21 is required to have a double bit width or to refer to two gradation register outputs.

If the gradation register section 21 has a double bit width, the circuit scale is increased due to increase of a latch portion and a shift-processing section. Also, the number of wirings from the gradation register circuit 12 to the gradation decoding section 231.

Therefore, in order to reduce the circuit scale, two gradation registers are used when performing the FRC of three values, and one of the gradation register sections 21 uses a register ka, and one gradation register is commonly used between different gradations. Thus, when the more significant 2 bits are 1 or 2, the process is performed using the register ka and register kb. In this method, as the gradation increases by one, the gradation register increases only by one, and therefore this is effective for reducing the circuit scale.

Figure 25:
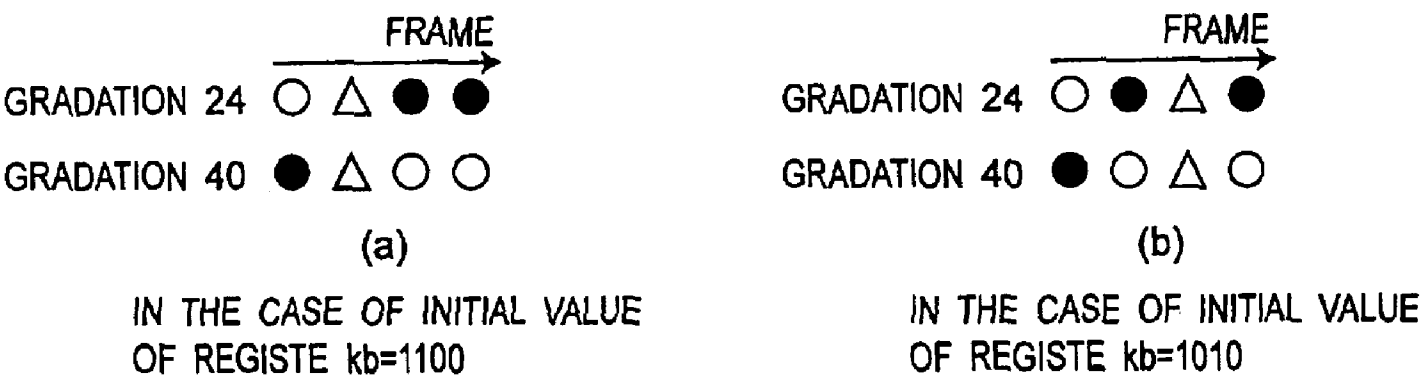
FIG. 25 shows ON/OFF patterns by the initial values of the gradation registers shown in FIG. 24, wherein (*a*) is an explanatory view in the case of ON and OFF being continuous, and (*b*) is in the case of alternating arrangement.

In order to realize the pattern shown in FIG. 21(*b*), the register kb has 2 bits to be 1 and 2 bits to be 0, and in the case where the more significant 2 bits are 1, OFF is outputted when the register ka and register kb are 0, and ON is outputted when the register ka and register kb are 1, and the less significant 4 bits of the video signal are outputted when the values of the register ka and register kb are different. FIG. 24 shows initial values of the gradation registers ka and kb. In the register kb, 0 and 1 are alternately arranged different from the case of Embodiments 1 and 2. This is because the value of the frame shift is only 1 or 3 due to 4-bit register, and is 1 and 0 are continually arranged, two times of ON or OFF are generated in the continuous frames as shown in FIG. 25(*a*). By an alternate arrangement, as shown in FIG. 25(*b*), ON and OFF can be generated on alternate frames. By the arrangement, in consideration under FRC of two values, this approximates to the FRC completed with two frames, and the frame frequency can be reduced. FIG. 26 shows an input/output relationship of the gradation decoding section 231.

In this case, each of the shift amount of the registers ka and kb must be always equal. This is because two registers are referred to in the case of the more significant 2 bits being 1 or 2, and the numbers of OFF, ON and the less significant 4 bits outputs are not changed.

FIG. 22 shows an inside of the gradation register section shown in FIG. 23. In comparison with the configuration shown in FIG. 16, the shift amount indication signal 26 for the gradation register section 21 is common to all of the registers.

As shown in FIG. 24, the fact that the initial value of the register kb is 1010 is equivalent to the arrangement having two of two 2-bit register values paralleled. Therefore, it may be possible that the register kb is modified from 4 bits to 2 bits to have its initial value of 10 so as to shift-process the register as much as the register ka. Also, regarding the wirings of the gradation display section in FIG. 23, kb[2] is replaced by kb[0] and kb[3] is replaced by kb[1], whereby the same value as that at the time of 4-bit register can be inputted to the gradation decoding section 231.

By this arrangement, the 4-bit shift-processing is changed to the 2-bit shift-processing in the register kb, so that the circuit scale can be reduced. In order to equalize the shift amounts both in the registers ka and kb, it may be arranged that, when the shift amount of ka is 0, 1, kb is also set to 0, 1, and when the shift amount of ka is 2, the shift amount of kb is set to 0, and when the shift amount of ka is 3, the shift amount of kb is set to 1.

Although the gradation 24 and gradation 40 are described with reference to FIG. 25, all of the gradations 16 through 47 referring to a register value kb similarly represent effects of reducing flickers. Similarly, in this case, OFF of two frames existing in the gradations 16 to 31 and ON of two frames existing in the gradations 32 to 47 can be dispersed by changing the initial value of the register kb, and therefore the flickers can be reduced.

Figure 27:
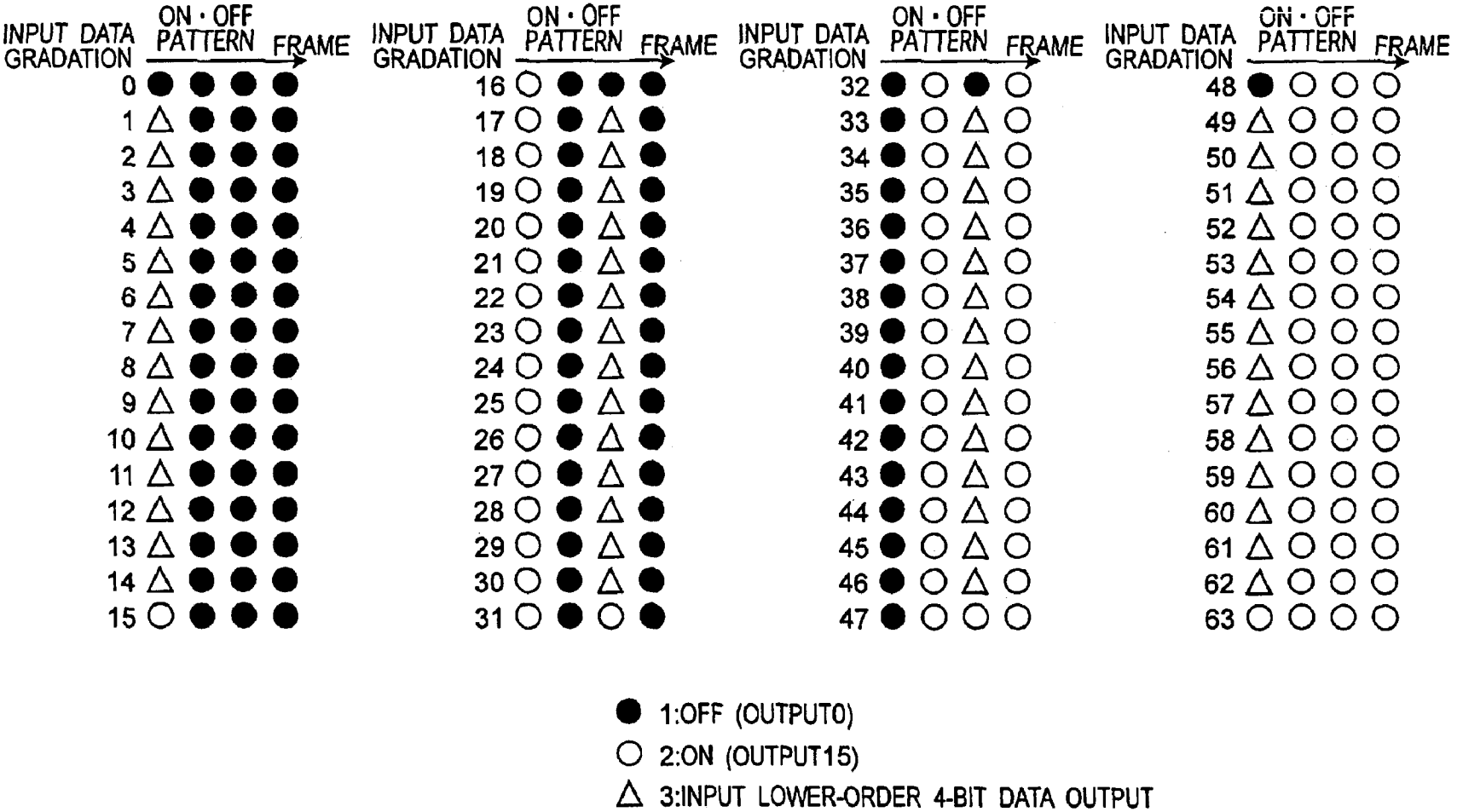
FIG. 27 is a diagram showing another example of an ON/OFF pattern in the case of performing a gradation display in the third embodiment of the present invention.

FIG. 27 shows ON/OFF patterns of every frame in each gradation in one pixel when performing 64 gradations using a configuration of FIGS. 22 to 24 and 26. In the gradations 0 to 15, data different from OFF is outputted in one frame of four frames. This different data draws near to ON 15 as the gradation rises, while data near OFF is generated when the gradation is small, and therefore flickers are remarkable as the gradation rise higher. Similarly, in the gradations 48 to 63, flickers are remarkable as the gradation is smaller. In the gradations 16 to 31, ON/OFF/any value of 0 to 15/OFF is displayed. As the gradation rises, the display draws near to a FRC of two frames completion as ON/OFF/ON/OFF, and therefore the flickers become unremarkable. Similarly, in the gradations 32 to 47, as the gradation is lowered, the flickers become unremarkable. Therefore, the most remarkable gradations are 15, 16, 47 and 48 among the entire gradations. These gradations are completed under the 2-state FRC and four frames. Accordingly, the frame frequency eliminating flickers is 60 Hz similarly to the 4-frame FRC.

Figure 28:
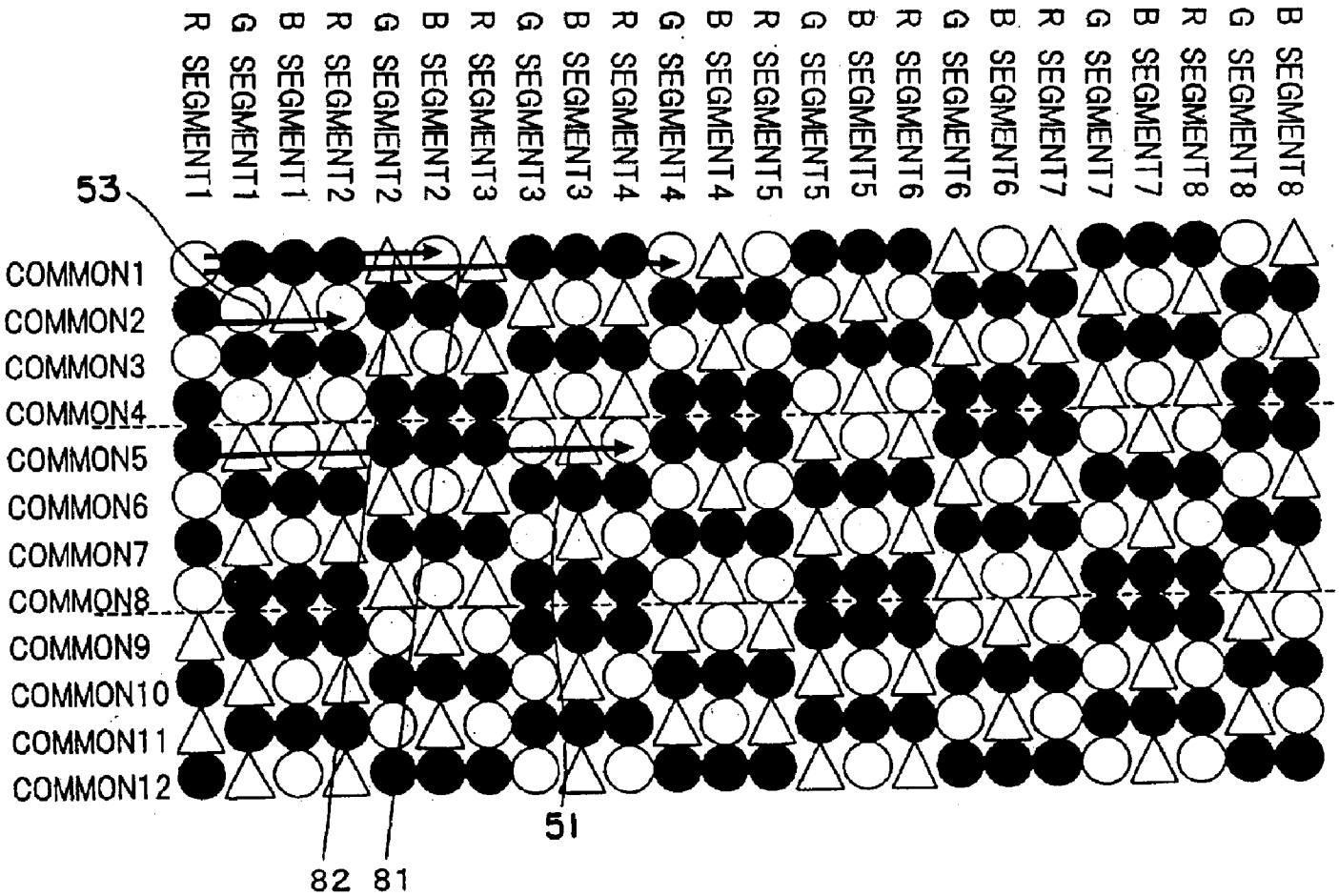
FIG. 28 is a diagram showing another example of an ON/OFF pattern in the case of performing a gradation display in the third embodiment of the present invention.

At this time, the frame shift value is 1, line shift value is 3, even/odd shift value is 1, G shift value is 3 and B shift value is 1. FIG. 28 shows an ON/OFF pattern in one frame.

In the case of performing a display only by a pulse-width modulation, there occurs a crosstalk in some segment signal line voltages, and a gradation display only under FRC requires 180 Hz, and accordingly a crosstalk-less drive of a low power can be realized by a combination.

In addition, in the case where a 4-bit display data line 15 outputted from the gradation decoding section 231 like this is outputted to a segment signal, even if 16 gradations are displayed by a pulse-width modulation or a pulse-height modulation, there is no effect in occurrence of flickers.

Figure 29:
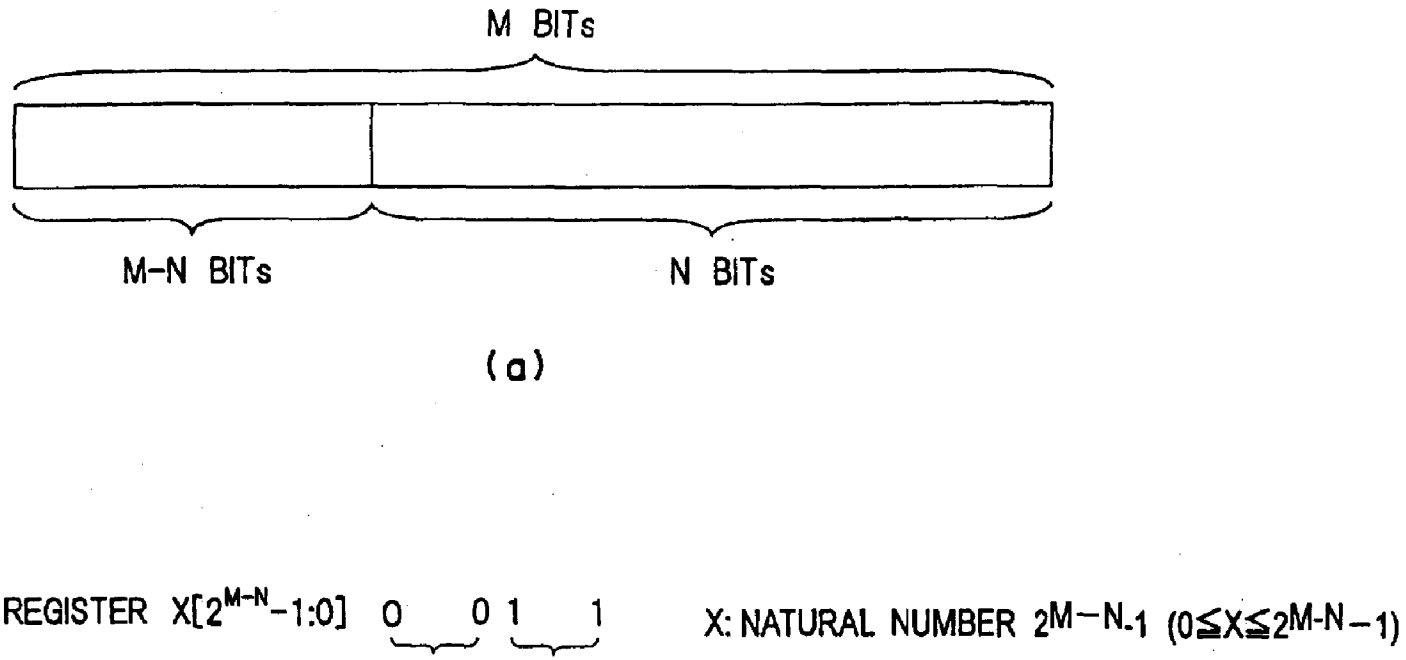
FIGS. 29(*a*) and 29(*b*) are initial values of a gradation register in the case of performing different gradation displays by dividing for a M-bit input into high-order M–N bits and low-order N bits.
Figure 30:
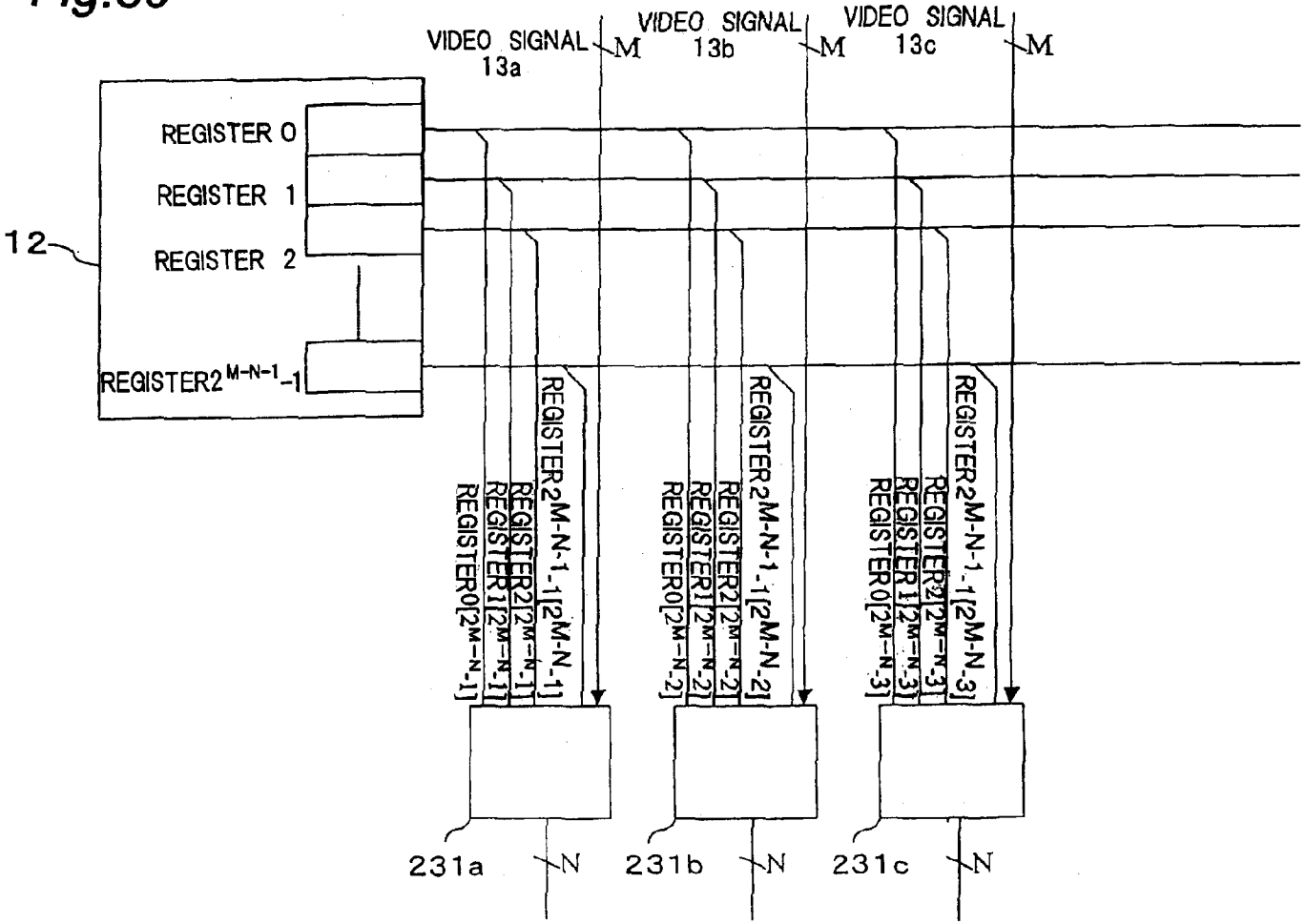
FIG. 30 is a diagram showing an arrangement example of a gradation register section and a gradation decoding section in the third embodiment of the present invention.

Generally, with respect to a video signal of M bits, which is separated into more significant M−N bits and less significant N bits, as shown in FIG. 29(*a*), in the case where a gradation display is performed under FRC using $2^{M-N}-1$ frames and further a gradation display is performed by a PWM or PHM within one frame, the gradation register circuit 12 requires at least $2^{M-N-1}-1$ registers as shown in FIG. 30. These registers are designated as Register 0, Register 1 and Register 2 in the order from fewer pieces of 0. Bit lengths of each of the registers are all in the same length where 0 and 1 are arranged in Register X as shown in FIG. 29(*b*).

FIG. 30 shows a relationship between the gradation register circuit 12 and the gradation decoding sections 231. In FIG. 30, since only pixels of the same display color are displayed, only one output is described among three registers corresponding to the three primary colors outputs.

For a video signal 13 of M bits, the more significant M−N bits data is referred as shown by the gradation decoding section 231 in FIG. 31, and in accordance with the output of the gradation register corresponding to each of the segment signal lines corresponding to the data, it is selected as to whether the N bits outputs are all set to 0, 1 or values of the more less significant N bits are outputted.

The gradation register circuit 12 has a configuration similar to that of FIG. 22, and a difference is mere that the number of the registers and the output bit widths of the registers are different. The shift amount designation signals 26 of all the registers have the same value among the registers. Note that if the values of the line shift, frame shift, even/odd shift, G shift and B shift are the same of all the registers, each value can be freely established.

In order to reduce the number of the frames required for FRC for suppressing flickers, the bit length of the gradation register can be reduced, but in this case, regarding a gradation register X and a gradation register X−1, it is necessary that a bit length of one of the registers can be just divided by a bit length of the other register and the quotient must be an integer. As to a shift amount of a gradation register having a bit length reduced, when the shift amount exceeds the bit number, a value obtained by subtracting the bit length from the shift amount is used. If the value exceeds the bit number even in this case, the subtractions by a bit length are repeated until a value smaller than the bit number is obtained, which is used as the shift amount of the gradation register.

The display data line 15 serving as a N-bit output signal of the gradation decoding section 231 is applied to a segment signal line by PWM or PHM to thereby perform a gradation display.

As to selection of using PWM or PHM, there is no difference in a degree of flicker occurrence but a configuration is varied according to a driving method. For example, when performing PWM in an active matrix type display device, it is necessary to store data by a number of pulses counted by PWM in a row-selection period for every pixel, resulting in reduction of a scanning time of one row. In addition, there is a problem that, if a waveform becomes uneven due to such as a wiring capacity, a predetermined signal can not be stored in a pixel. Moreover, there is a method of performing a row scanning at random in order to increase the scanning period, but a construction of a gate driver is complicated. Accordingly, it is preferable to perform a gradation display using a PHM system.

Figure 32:
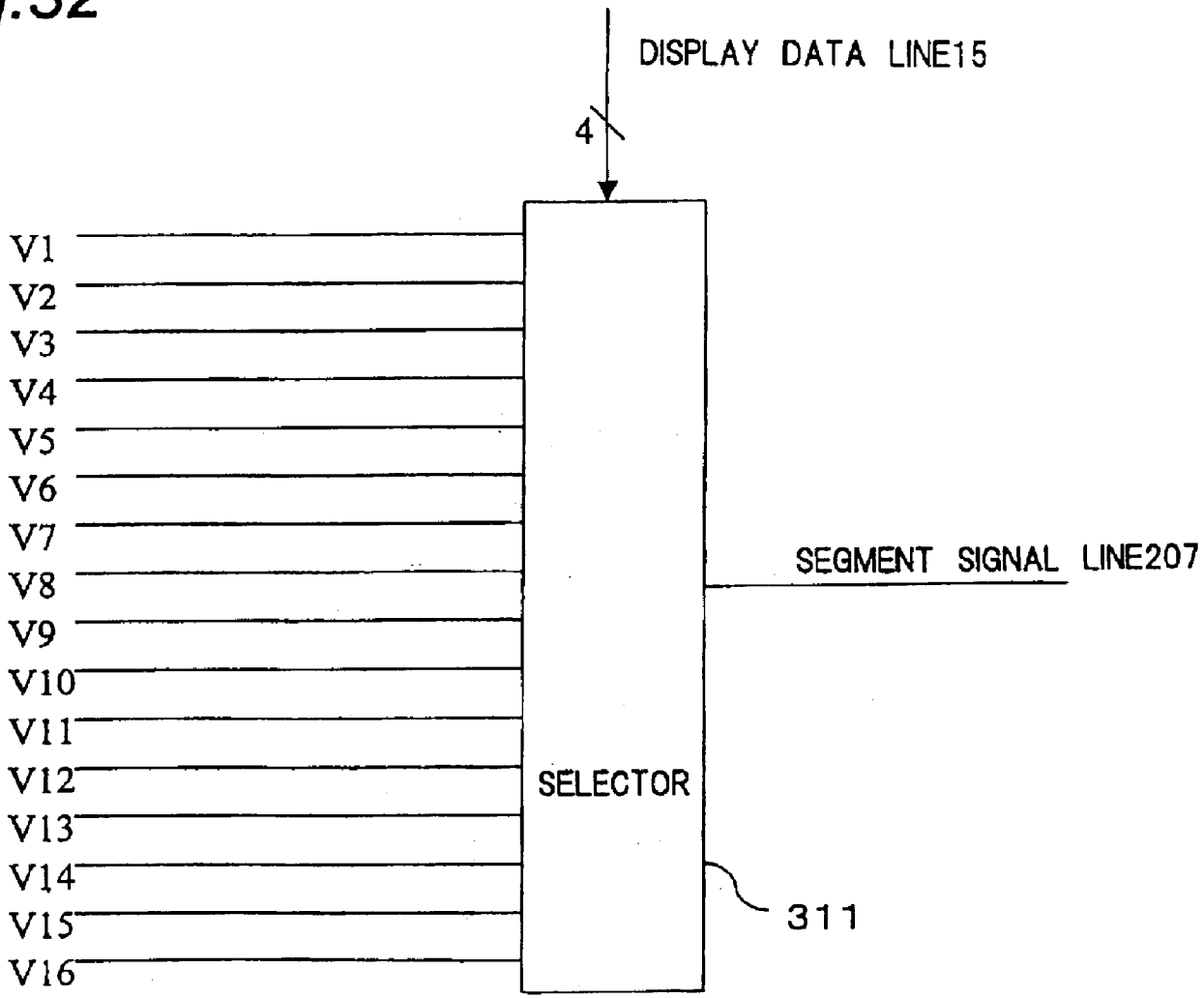
FIG. 32 is a diagram showing a segment signal line output section in the case of outputting the N-bit output through pulse-height modulation in the third embodiment of the present invention.

In addition, in the case where a gradation display is performed by PHW as shown in FIG. 32, in response to a display data line 15 of N bits, there is a method in which an analog signal is obtained using a digital-to-analog converter to be outputted to a segment signal line 207, and in the case of, for example, N=4, there is such a method in which voltages of 16 values are prepared in accordance with gradation characteristics of display elements, so that one of the 16-value voltages is outputted to the segement signal line 207 by operating a selector 311 in accordance with the display data line 15. By incorporating these functions into the source driver 202 shown in FIG. 20, a gradation display method according to the present invention can be realized in the active matrix type display device. Note that the source driver 202 may be formed on the same substrate as the display section 204 using a low temperature or high temperature polysilicon. Of course, also the gate driver can be formed using a polysilicon technique. This matter can be also applied in a simple matrix type display device.

In the case of a passive matrix (simple) type display device, when a gradation display is performed by PHM by varying the voltage value of the segment signal line, it is necessary to apply a compensation parameter in order to make an effective value of a non-selection pixel, and therefore the circuit is complicated. Therefore, it is preferable to use a PWM system.

In order to use the PWM system, there is a method for dividing ON state periods and OFF state periods by dividing a pulse applied to the segment signal line in one horizontal scanning period into e.g. 2 N pieces or by dividing the pulse by a number of bits in accordance with the weight of each signal line bit. Thus, it is possible to perform a $2^N$-gradation display for N-bit data.

Figure 33:
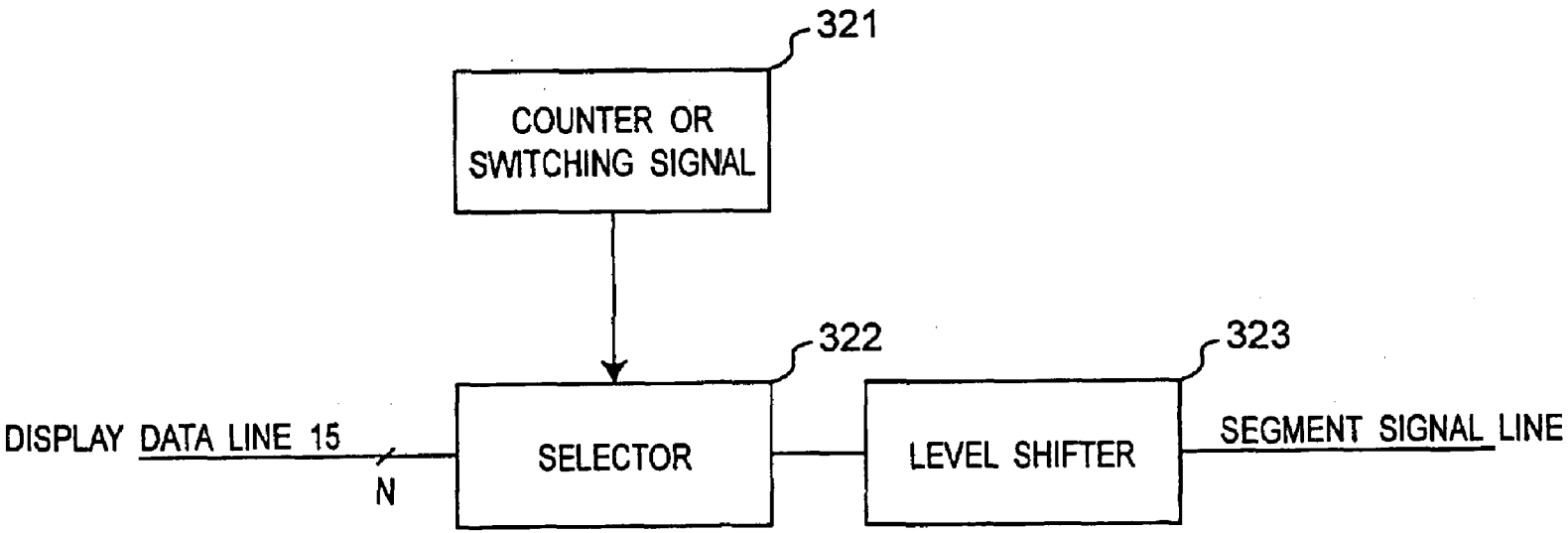
FIG. 33 is a diagram showing a segment signal line output section in the case of outputting the N-bit output through pulse-height modulation in the third embodiment of the present invention.

In response to a display data line 15 of N bits, as shown in FIG. 33, ON/OFF data of each bit is detected by a selector 322, so that the ON/OFF data of one bit is outputted by using a counter or a switching signal 321 based on ON/OFF information of each bit in accordance with the weight of the bit.

Moreover, the data is converted into a voltage value required for a display element through a level shifter 323 so as to be outputted onto the segment signal line to thereby display ON/OFF in accordance with the voltage value applied between common signal lines.

A display device is generally a capacitive load, and when a pulse is applied, a waveform rounding is watched at the rising and trailing times. In addition, repetition of ON and OFF is to perform charge and discharge of an electric charge to and from a panel, as the repetition of ON and OFF increases, a consumption of electric power increases and is remarkable as the pulse number increases. Therefore, the pulses indicative of ON and pulses indicative of OFF are adjoined as much as possible, and in order to constitute a display device in which a gradation performance is increased with reduction of an electric power consumption by reducing a difference of brightness of a display region due to the waveform rounding and by reducing the times of charges and discharges to the display device due to repetition of ON and OFF, the pulses are applied in the order from higher or lower segment 5-value voltages.

Figure 34:
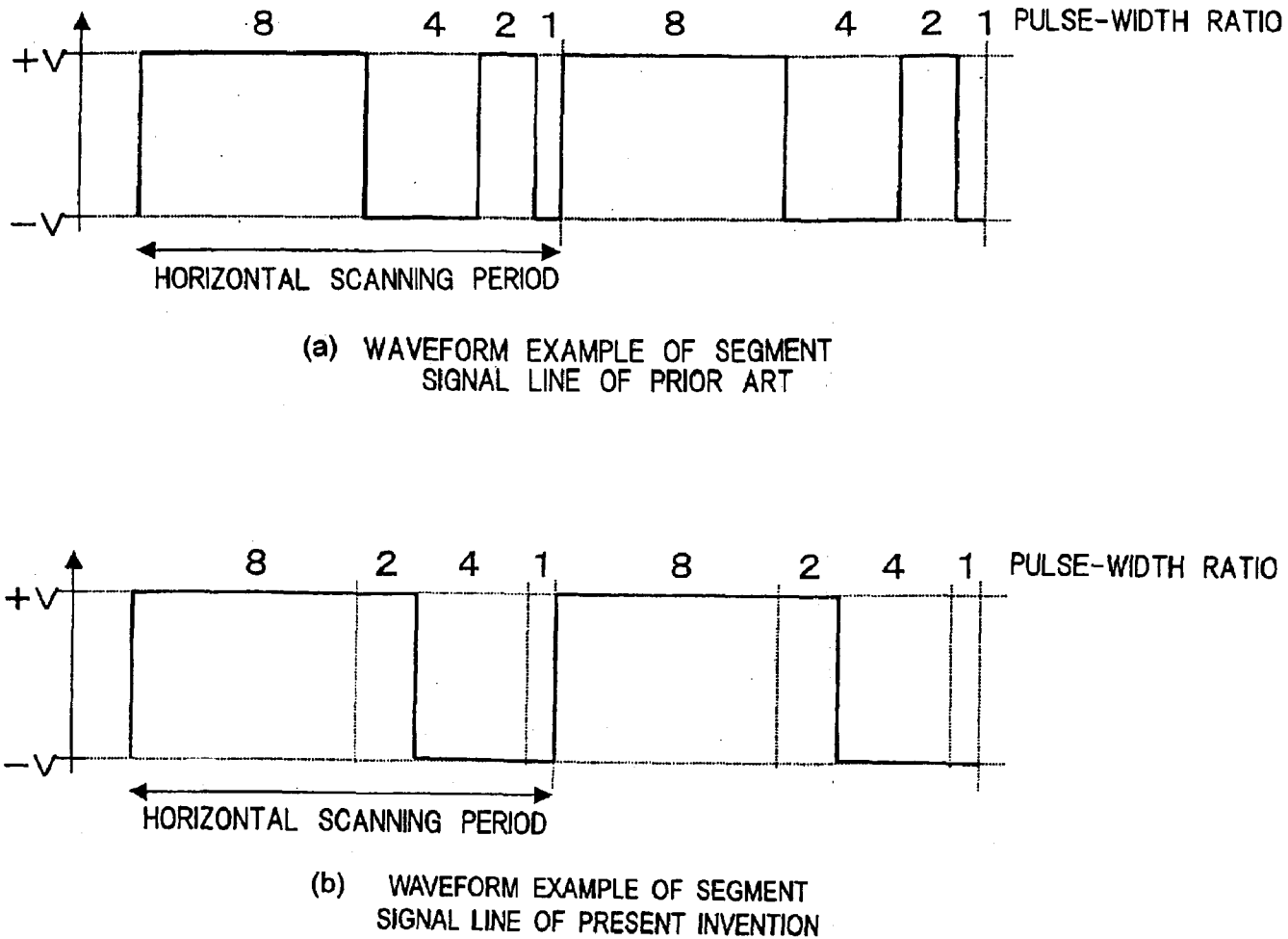
FIG. 34(*b*) is a waveform of a segment signal line at the time of pulse-width modulation in the third embodiment of the present invention, and (*a*) is a view showing a comparison with a conventional example thereof.

Therefore, as shown in FIG. 34(*b*), the pulse is not applied to the segment signal line in the order corresponding to each bit data but the pulse is applied in the order of the voltage values so that the charging times are reduced. FIG. 34(*a*) shows a conventional case as a comparative example where a pulse is applied in the order of the pulse width.

As a method for preventing this, in the present embodiment, as shown in FIG. 35(*b*), the pulse application order is differentiated every segment signal line and the timings of changing voltages of the segment signal lines are shifted so that the differential waveform is not applied to the common signal line.

In the case of performing a drive by MLS, the obtainable voltage value of the segment signal line is a number of simultaneous selection rows+1. In the 4-row simultaneous selection time, voltage values of 5 values are generated. Accordingly, application of pulses in the order of the voltage values is effective for reducing the charging times.

In the case of performing a display by MLS, an arithmetic unit is required for calculating data corresponding to a number of rows simultaneously selected below the display data line 17, and it is necessary to modify the configuration.

Figure 36:
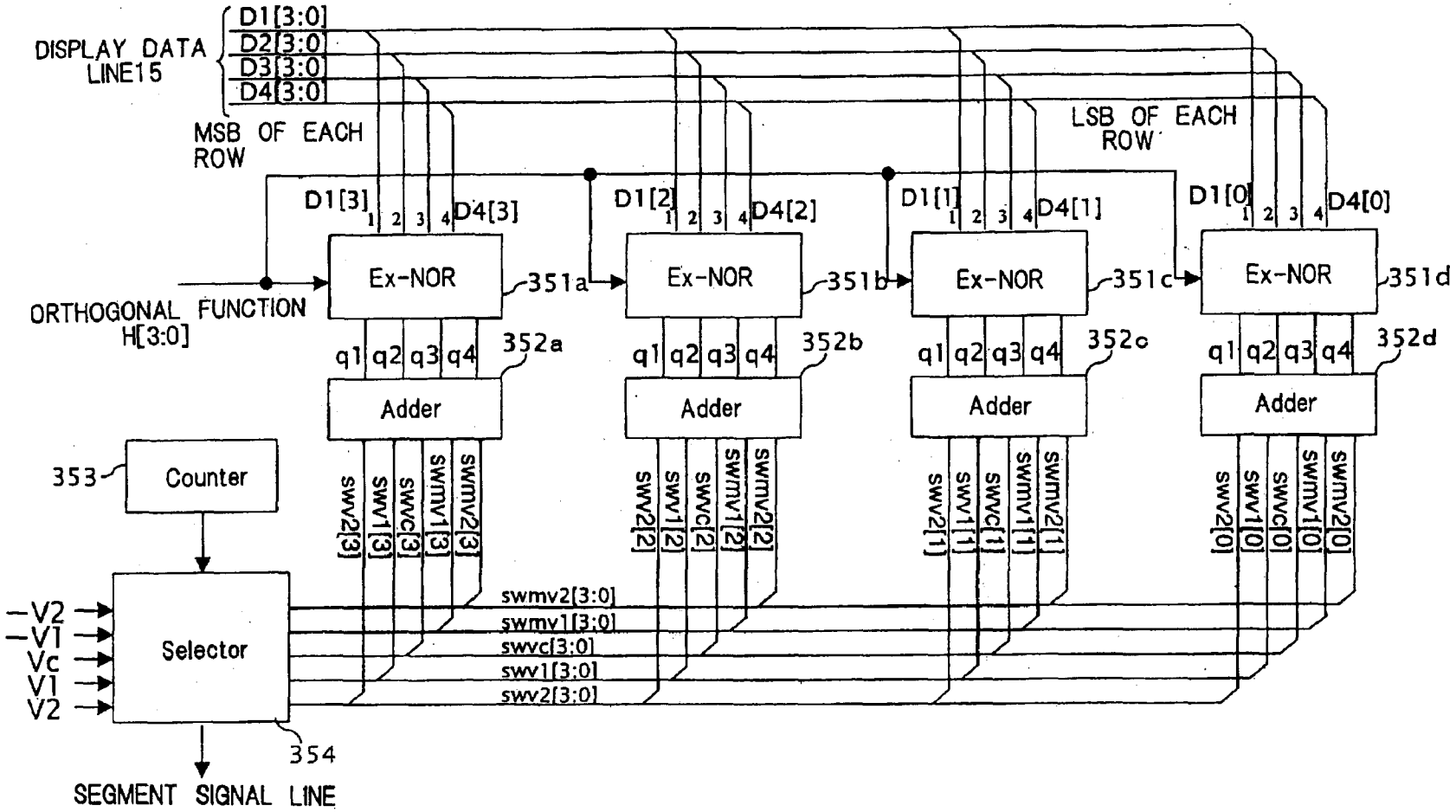
FIG. 36 is a block diagram showing an arithmetic section for realizing a multi-line simultaneous selection method in a PWM display in the third embodiment of the present invention.

FIG. 36 shows a block diagram from the arithmetic section to the segment signal line output in the case where the bit width of the display data lines 15 is 4 bits and in the case of performing a 4-row simultaneous selection.

Although the display data lines 15 of 4-bit data are arranged in parallel corresponding to four rows, the four rows may be serially transmitted. In this case, a latch is required in an Ex-NOR 351 or Adder 352.

In the case of performing a gradation display by PWM, in response to an input signal of a plurality of bits, a MLS calculation is performed every bit of the same weight, and the output period of the calculation result is varied in accordance with the weight of the bits to thereby realize the display.

A calculation required for MLS, which is a matrix calculation H×S between the orthogonal function H125 and the input signal S121 performed in FIG. 13, is a multiplication between elements 1 or −1 of the orthogonal function and the data 1 or −1 corresponding to the elements. Since the calculation is performed every bit, the even case of an input signal being N bits is the same, and the arithmetic sections are merely N pieces (alternatively, may be serially processed at a rate of N times higher). When 1 and −1 of the orthogonal function are decoded to 0 and 1, respectively, and −1 (indicative ON) and 1 (OFF) of the input signal are decoded to 0 and 1, respectively, the multiplication between the 1-bit signals results in equal to an exclusive NOR. This is performed in the Ex-NOR 351. Since there are four numerals with which the orthogonal function becomes 1 or −1 in the 4-rows simultaneous selection method, four results of the exclusive NOR are outputted (as q1, q2, q3 and q4). Next, the four calculation results of the exclusive NOR are added and one of the five values of the voltages is outputted in accordance with the calculation results. This addition is executed by Adders 352. The voltages of −V2, −V1, Vc, V1 and V2 are allocated in the order from the smaller value of q1+q2+q3+q4. Note that the outputs of the display data lines 15 are used as the elements of the input signal S121 in FIG. 14.

The outputs of the four Adders 352 may be outputted to the segment signal line in accordance with the weight of the bits. In this case, with respect to the output period of Adder 352*d* which is a calculation result of the least significant bit, Adder 352*c* is made twice, Adder 352*b* is made four times, and Adder 352*a* is made eight times so as to be outputted in this order.

In this method, however, the segment signal lines are not always outputted in the voltage order. In order to modify to the voltage order, it is necessary to detect the output value of each Adder 352 to selectively output.

By detecting the outputs of Adder 352 and based on the detection results, the time for applying each of the voltage values is determined, and a Selector 354 is provided for outputting to the segment signal line.

Conventionally, there was employed a method that the Selector 354 of selects one of the five voltages −V2 to V2 according to the values 0 to 4 of the Adder 352 to output the segment signal voltage, in this method, however, if the voltage waveforms are applied to the segment signal line in the voltage order, all of the values of the outputs of the Adder (outputs of four Adders in FIG. 36) of each bit are referred to, and rearranged in the order of the voltage values and the output times to the segment signal line are changed in accordance with the weight of the bits. Since this requires to repeat this algorithm every voltage values of −V2 to V2, the circuit scale becomes considerably large as the bit number inputted to the selector increases.

In order to simplify the configuration of the Selector section, though the original output of the Adder 352 is 2 bits, the bit number is changed to 5 bits which is a number of employable voltage values. FIG. 37 shows a relationship of the input/output of the Adder 352. The outputs of 5 bits correspond to the voltage values to be applied, and only one bit thereof is 1 according to the calculation results of q1+q2+q3+q4 and the remaining four bits are 0. Regarding each output of the Adder 352, when paying attention to e.g. swv2, the swv2 of the four Adder sections 352*a* to 352*d* is inputted to the Selector 354 as the 4-bit width. At this time, each bit value of a bus of swv2[3:0]is determined in the order of the calculation results of the most significant bit of the input data. The remaining four outputs are also similarly treated. FIG. 36 shows a connections from the Adder 352 to the Selector 354.

Thus, in the Selector 354 five 4-bit signals are referred to in the order from swv2 or swmv2 to thereby decide the time for applying the voltage to the segment signal line, so that the circuit construction of the Selector 354 can be simplified.

FIG. 38(*b*) shows an example of the output voltage waveform of the segment signal line in the case of using the configuration shown in FIG. 36. In comparison to a conventional configuration (FIG. 38(*a*)), the times of voltage changes can be reduced and the electric power for charge of the segment signal line voltage can be reduced.

In the above description, although the explanation is made in the case of 4-line simultaneous selection method in the multi-line simultaneous selection method, since image data of L rows are simultaneously transferred also in a general L-line simultaneous selection, the inputs of the Ex-NOR 351 become L lines, and also the calculation results become L pieces of q1 to qL, and also the output signal lines of the Adder sections become L+1 lines because the obtainable values of the segment signal voltages are L+1 pieces. That is, general L-row simultaneous selection can be also realized, similarly.

Note that, as a display device, not only a liquid crystal but also an organic light emitting element (OLED), plasma display panel, inorganic EL element and the like so long as the display device performs a plurality gradation expressions, the display device can be realized by applying the present invention similarly to the gradation display section.

(Embodiment 4)

In the gradation display method of the present invention, when inputting e.g. 6 bits as shown in FIG. 27, the same brightness is obtained on the boundary between two gradations where different FRC processes are performed. In FIG. 27, pairs of gradations 15 and 16, 31 and 32, and 47 and 48 are the cases.

Namely, the gradations are reduced by the number of the boundary lines. This coincides with the number of the frames to be subject to FRC, and since $2^{M-N}-1$ frames are used in FRC if a N-bit display is performed through PWM or PHM in general at the time of inputting M bits, this means that $2^{M-N}-1$ gradations are reduced with respect to $2^{M}$ gradations.

For example, if a display is performed with 4 frames at the time of inputting 6 bits, 64 gradations become 61 gradations. In this case, even if a portrait or the like is displayed, the reduction in gradations can not be confirmed from the picture. Meanwhile, if a display is performed with 4 frames at the time of inputting 4 bits, the gradations become from 16 to 13 in gradation display, and the reduction in gradation number can be confirmed in watching even such as a portrait.

As a reason of decreasing the display gradations, an explanation will be made using an example when performing the gradation expression with four frames at the time of displaying 64 gradations. FIG. 27 shows ON/OFF patterns of each gradation of input 64 gradations. When paying attention to the gradations 15 and 16, the ON/OFF pattern of the gradation 15 become less significant output (15), OFF (0), OFF(0), and OFF(0) (where the values in parenthesis are 4-bit values outputted from the gradation decoding section). Regarding the 16 gradations, which become ON(15), OFF (0), less significant 4-bit output (0), and OFF(0), and 4-bit output values are the same among four frames between the two gradations, and therefore the corresponding output gradations are reduced. In FIG. 27, also between the other gradations 31 and 32, and gradations 47 and 48, similarly, the outputs are the same with respect to different input gradations. Such a phenomenon is generally generated between gradations before and after the more significant M−N bits values are varied. As a result, the output gradations are reduced by an amount of $2^{M-N}-1$ gradations compared to the input.

An examination was carried out regarding a method of preventing such a reduction in gradations number mentioned above. In this description, an explanation is made with respect to the case of performing a gradation display with 4 frames using input 4 bits for brevity. FIG. 39(*a*) shows the output values of the gradation decoding section 231 in each input gradation. In this case, the frames 1 to 4 are allocated for the convenience, and it is sufficient to select one time each frame of 1 to 4 among the four frames and the order may be changed.

By performing such decode outputs, the pulse widths of each of the frames are in a relationship as shown in FIG. 39(*b*). Since three frames of four frames take a value of either 0 or 3 in the entire gradations, only pulses having a pulse width 3 are prepared for the three frames, and since the remaining one frame takes any value of 0 to 3, two pulses having pulse widths 1 and 2 are prepared. Accordingly, only 13-gradation expression from 0 to 12 can be performed using four frames by ON/OFF of each pulse. This is because the sum of the pulse widths of each frame is 3+3+3+2+1=12.

In order to perform a 16-gradation expression, the pulse width 3 is changed to 4 in the three frames of a pulse width 3 only. As to the remaining one frame, it is sufficient to prepare pulses having pulse widths of 1 and 2. In this case, however, the length of each frame become different. In order to coincide the length of each frame, a pulse having a pulse width 1 is further added to the frame having pulse widths 1 and 2 existing. FIG. 39(*c*) shows a relationship of the pulse widths. By this arrangement, 4+4+4+2+1=15 is obtained and a 16-gradation display can be realized. FIG. 40 shows a relationship of each frame outputs in response to the input data at this time. Note that the order of the frames to perform outputs of ON, OFF and less significant 4 bits is optional.

A signal input which does not raise the brightness should be performed in one insertion period of a pulse width. Three types of this method were carried out.

(Embodiment 4-1)

In FIG. 39(*c*), also in the frames 391 to 393 of a pulse width 4, it is regarded that pulses having a pulse width 1 are inserted to the pulses having a pulse width 3. By this arrangement, a frame to be subject to PWM in one frame is comprised of three periods of a period 411 of "a" having a pulse width 2, a period 412 of "b" having a pulse width 1, a period 413 of "c" for inserting data 0 in a period of performing PWM.

Also in a frame to be subject to FRC, three periods (a, b, c) are provided corresponding to that. There is no difference of data in the three periods, and data indicative of ON is outputted in the three periods in the case of ON, and data indicative of OFF is outputted in the three periods in the case of OFF.

The different point from Embodiment 3 is only that the pulse width for use in PWM becomes 3/4. Since any value of 0 to 3 is outputted in the frame in PWM, data 0 may be outputted as the data in the c period 413 of a pulse width 1 newly inserted.

Figure 41:
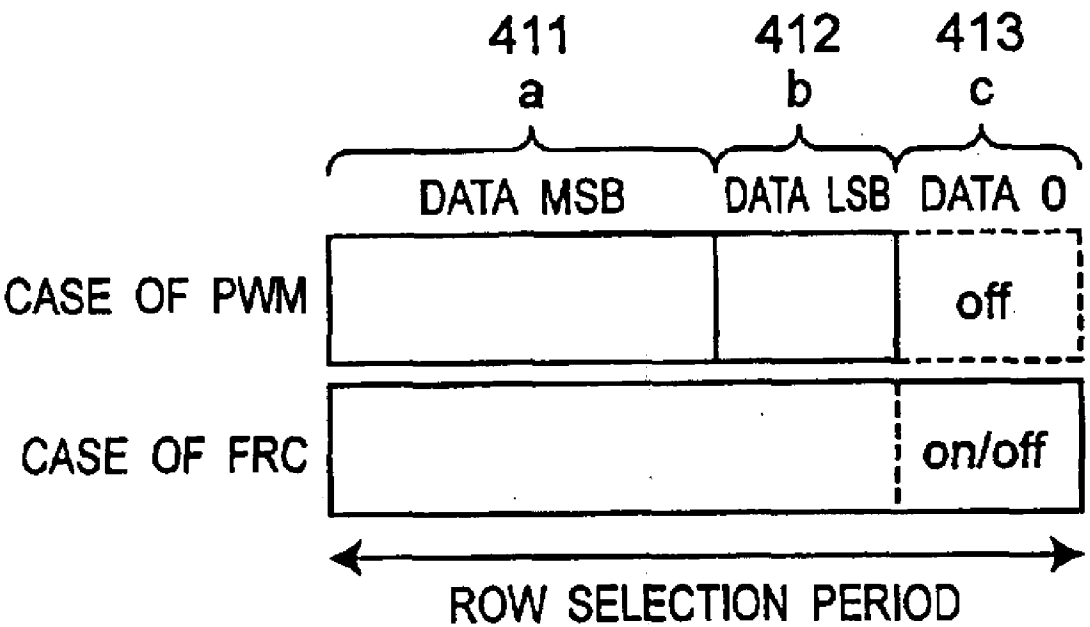
FIG. 41 is a view showing a relationship of each pulse of PWM in a row selection period in the fourth embodiment of the present invention.
Figure 43:
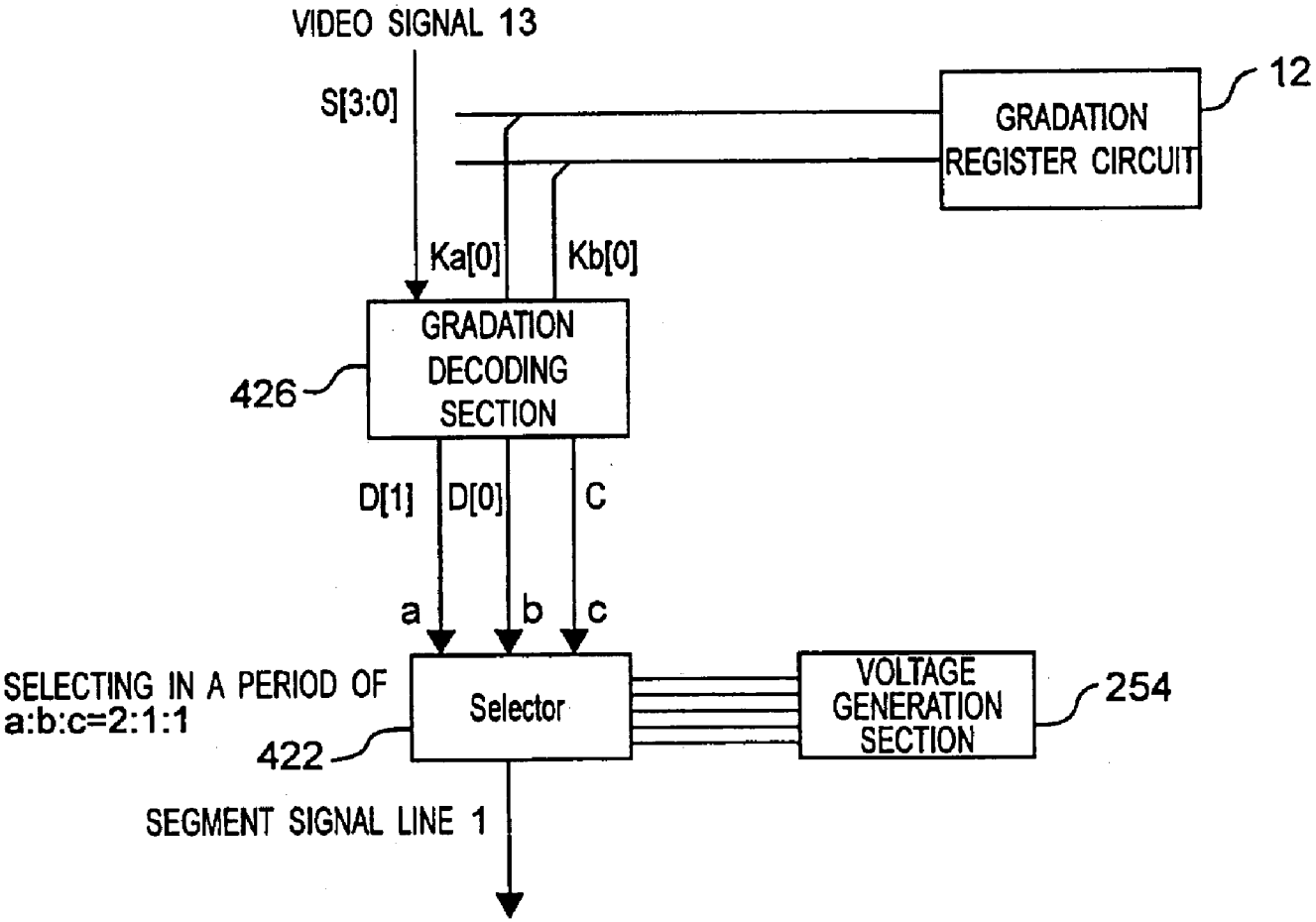
FIG. 43 is a block diagram showing a construction from any one column video signal to a segment signal in the fourth embodiment of the present invention.

In order to output the data of three periods, the output of the gradation decoding section 426 shown in FIG. 43 is added by one bit (output C). FIG. 42 shows a relationship of the values of C in response to the input data of the gradation decoding section 426. The values of C correspond to the data outputted in the period c 413 shown in FIG. 41, and 0 is outputted in the frames outputting OFF in FRC and the frames of PWM, and 1 is outputted in the frames outputting ON in FRC. Thus, the outputs in the period a and period b are performed with the data D of the gradation decoding section 426, and the output in the period c is performed with the value of C.

FIG. 43 shows a block diagram from a video signal 13 of one column to a segment signal line (first column in this case) in the case where FRC is performed using more significant 2 bits and PWM is performed using less significant 2 bits with respect to a 4-bit signal when selecting one by one row. The gradation register circuit 12 is the same as that of Embodiment 3. The gradation decoding section 426 outputs data based on Tables shown in FIGS. 39(*a*) and 42 in accordance with the outputs of the gradation register circuit 12. Selector 422 selects a signal (D[1]) corresponding to the period a, a signal (D[0]) corresponding to the period b, and a signal (C) corresponding to the period c in a rate of 2:1:1 in accordance with the periods in FIG. 41, and outputs onto the segment signal line. A voltage corresponding to the segment signal line is produced by the voltage generation section 254, and is outputted after subjecting to a level shift.

Figure 44:
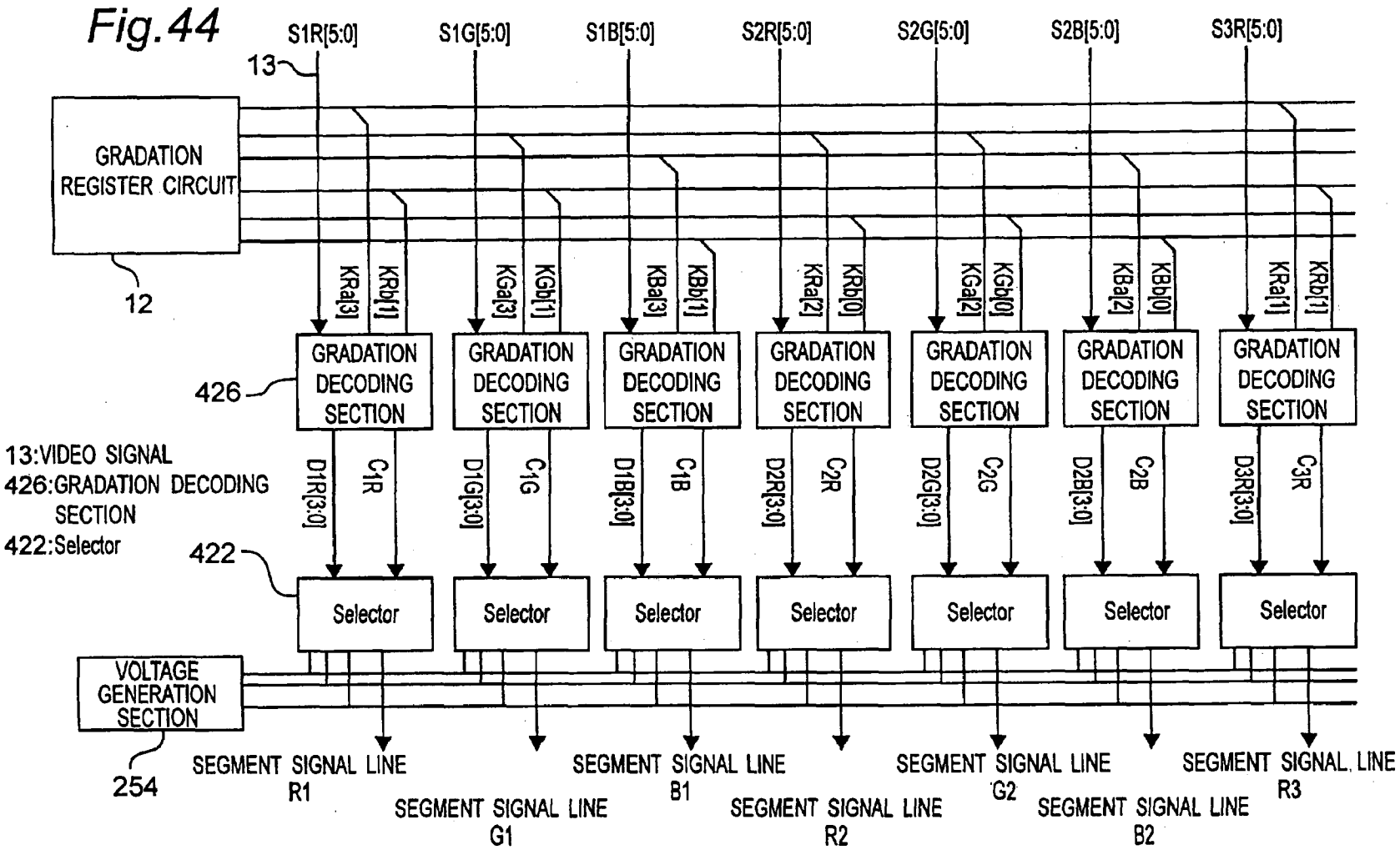
FIG. 44 is a block diagram showing a construction example of a gradation processing section in the fourth embodiment of the present invention.

Thus, a 16-gradation display can be performed in response to the 4-bit input. Moreover, FIG. 44 shows a block diagram performing a 4-bit output from a video signal in the case of performing a three primary colors display with a 6-bit input. In a similar manner to that in Embodiment 3, by shifting the gradation register circuit 12, the drive can be performed at a frame frequency of 60 Hz. A $2^M$-garadation display can be made in response to M-bit input irrespective of the input bits number.

Figure 45:
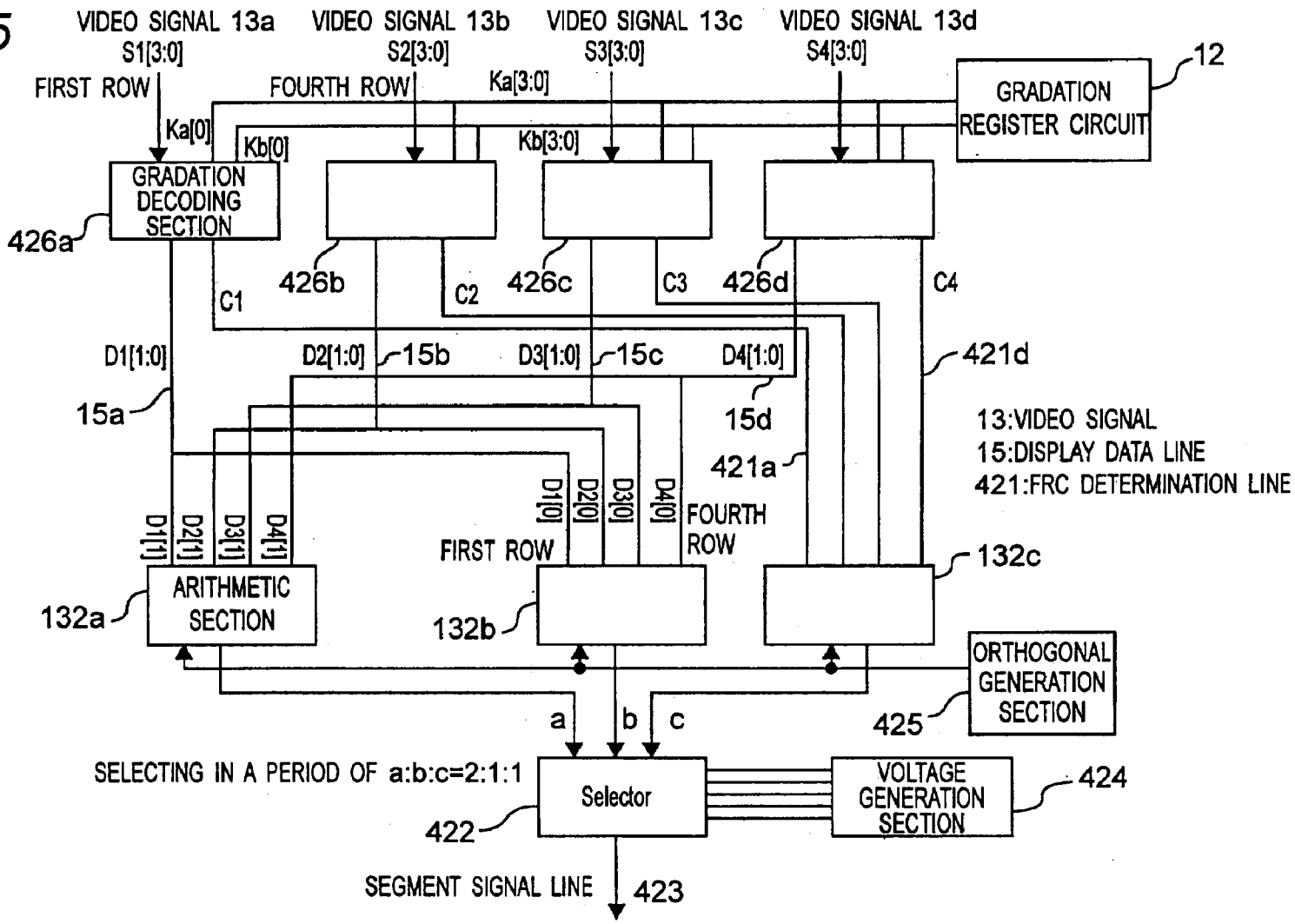
FIG. 45 is a block diagram showing an arrangement relationship of the gradation register circuit, gradation decoding section, arithmetic section and selector section in the fourth embodiment of the present invention.
Figure 46:
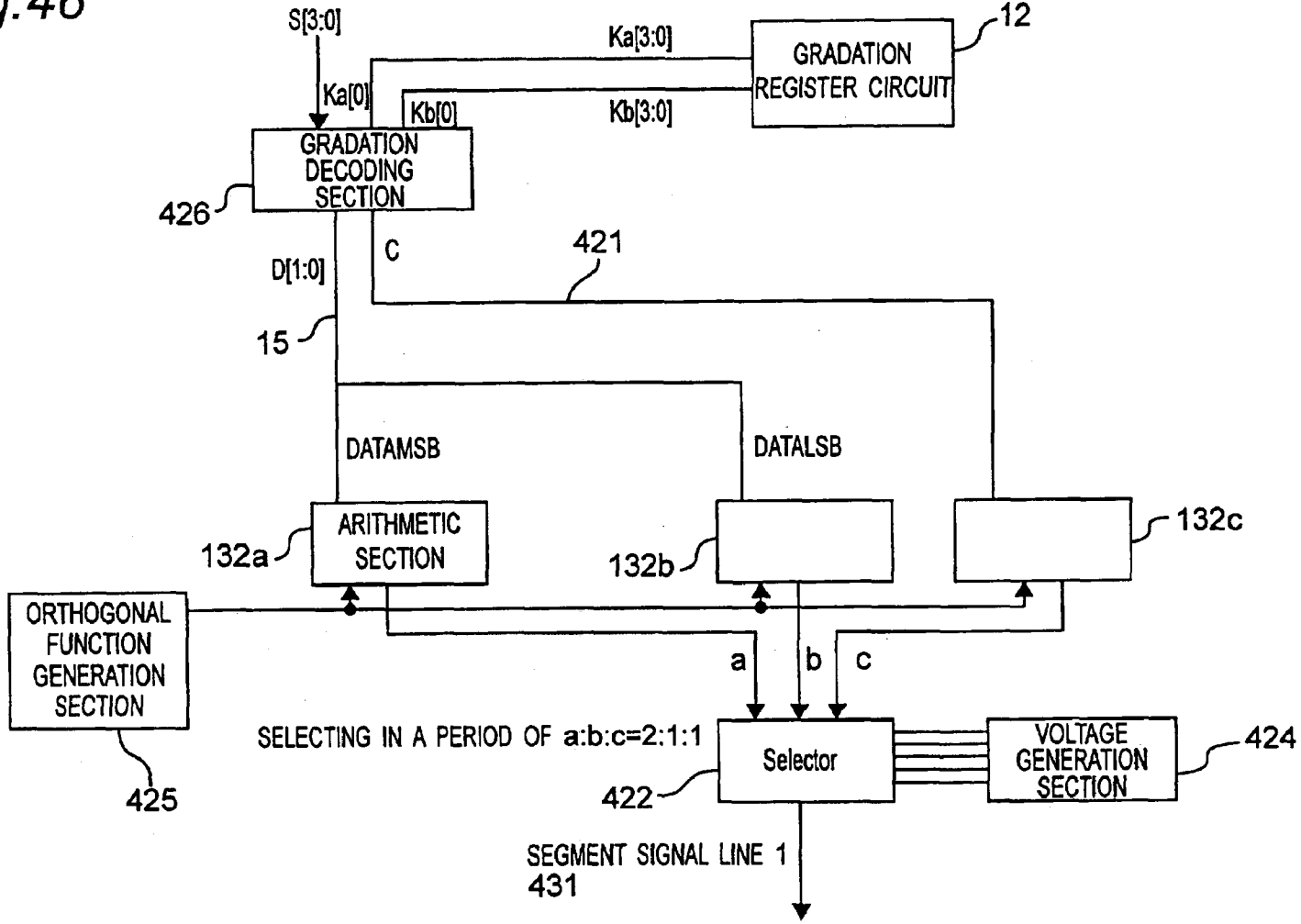
FIG. 46 is a diagram showing another example of an arrangement relationship of the gradation register circuit, gradation decoding section, arithmetic section and selector section in the fourth embodiment of the present invention.

In the multi-line selection method, since it is necessary to calculate with each element of the orthogonal function, there is provided an arithmetic section 132 performing a calculation of a bit number corresponding to a line number to be selected as shown in FIG. 45 or FIG. 46.

FIG. 45 shows a relationship of the gradation register circuit, gradation decoding sections, arithmetic sections, and selector in the case where data of four rows to be simultaneously selected by the multi-line simultaneous selection method are simultaneously transferred so that the same gradation output is not generated with respect to different input gradations in the case of performing FRC and PWM display of 2 bits, and FIG. 46 shows a relationship of the gradation register circuit, gradation decoding section, arithmetic sections, and selector in the case where data of four rows are transferred in turn so that the same gradation output is not generated with respect to different input gradations in the case of performing FRC and PWM display of 2 bits.

FIG. 45 shows the case where the gradation decoding sections 426 are provided by a number of simultaneous selections and the data of four rows are simultaneously inputted to the arithmetic sections 132 to perform the calculations, and FIG. 46 show a method in which the data of four rows are sequentially processed by the gradation decoding section and the calculations are performed by the arithmetic sections one by one sequence and the calculation results are latched to thereby output the data corresponding to each period shown in FIG. 41. The gradation display can be realized either by serially transferring the data or by transferring the data in parallel. The different point from Embodiment 3 resides in that the calculation is performed not only with the output data but also with the data for the period c 413 of a pulse width 1 to be newly inserted. Therefore, one arithmetic section 132 is increased in comparison to Embodiment 4. One of the calculation results is selected by the selector 422 in the period of a:b:c=2:1:1, and a corresponding voltage is selected among the voltage generation section 424 and is outputted to the segment signal line to thereby obtain a gradation display.

Figure 47:
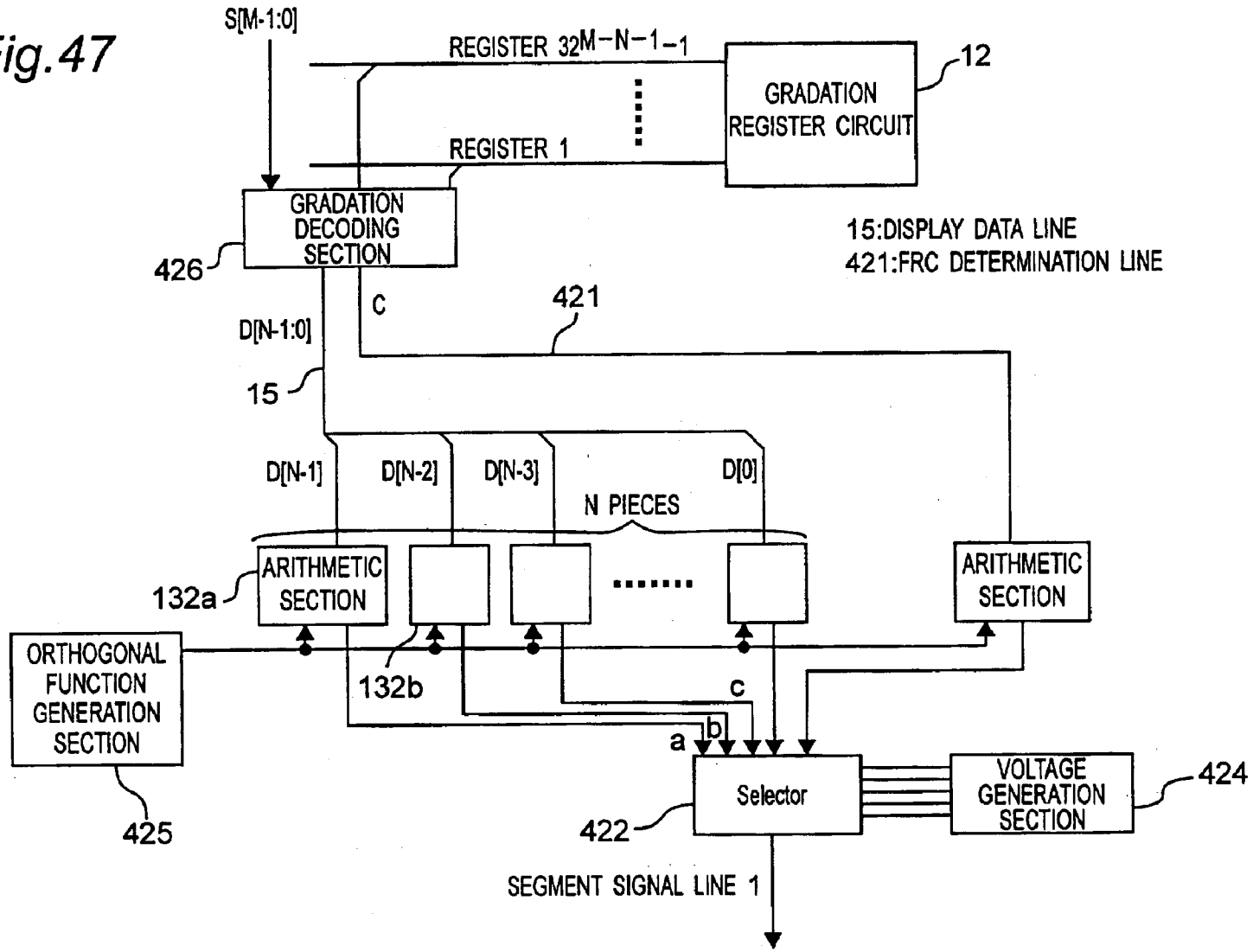
FIG. 47 is a block diagram showing another construction example of a gradation processing section in the fourth embodiment of the present invention.

Although the explanation is made in the case of 2-bit expression by PWM, in the general case where N-bit output is performed by PWM in response to the M-bit input, at least $2^{M-N-1}-1$ pairs of the registers pair are prepared to be outputted from the gradation register circuit 12 as shown in FIG. 47, and any one of the input less significant N-bit signal, all N bits 0 and all N bits 1 is generated as the N-bit output of the gradation decoding section 426, so that the N-bit output of 1 is outputted as the output of the FRC determination line (signal C) 421 when all N bits are 1, and when in the other case, 0 is outputted. N+1 pieces of the arithmetic sections are prepared to perform calculations with orthogonal functions, and the N+1 pieces of calculation results are all selected in turn by the selector within the horizontal scanning period. When assuming that a period of selecting the output of the FRC determination line (signal C) 421 is 1, the selection periods of the N-bit data calculation results are 1 with respect to the least significant bit, 2 with respect to the second bit from the least, and so on the selection period is increased by doubles as the bit rises by one bit in the following. By this operation, a gradation display is performed by FRC with M−N frames in response to the M-bit input, and a $2^N$-gradation display is performed by PWM using further one frame, and thus in this method the $2^N$-gradation display is realized.

(Embodiment 4-2)

In the case of the configurations in FIGS. 43, 45 and 46, since the number of the output terminals of the gradation decoding section 426 is increased and the number of the arithmetic sections is increased in the multi-line simultaneous selection method, the circuit scale becomes large to be problematic. Therefore, it is considered that the operation of the selector is modified in the frames subject to FRC and frames subject to PWM (similarly PHM) so that the output of the FRC determination line (signal C) 421 is made unnecessary.

Figure 48:
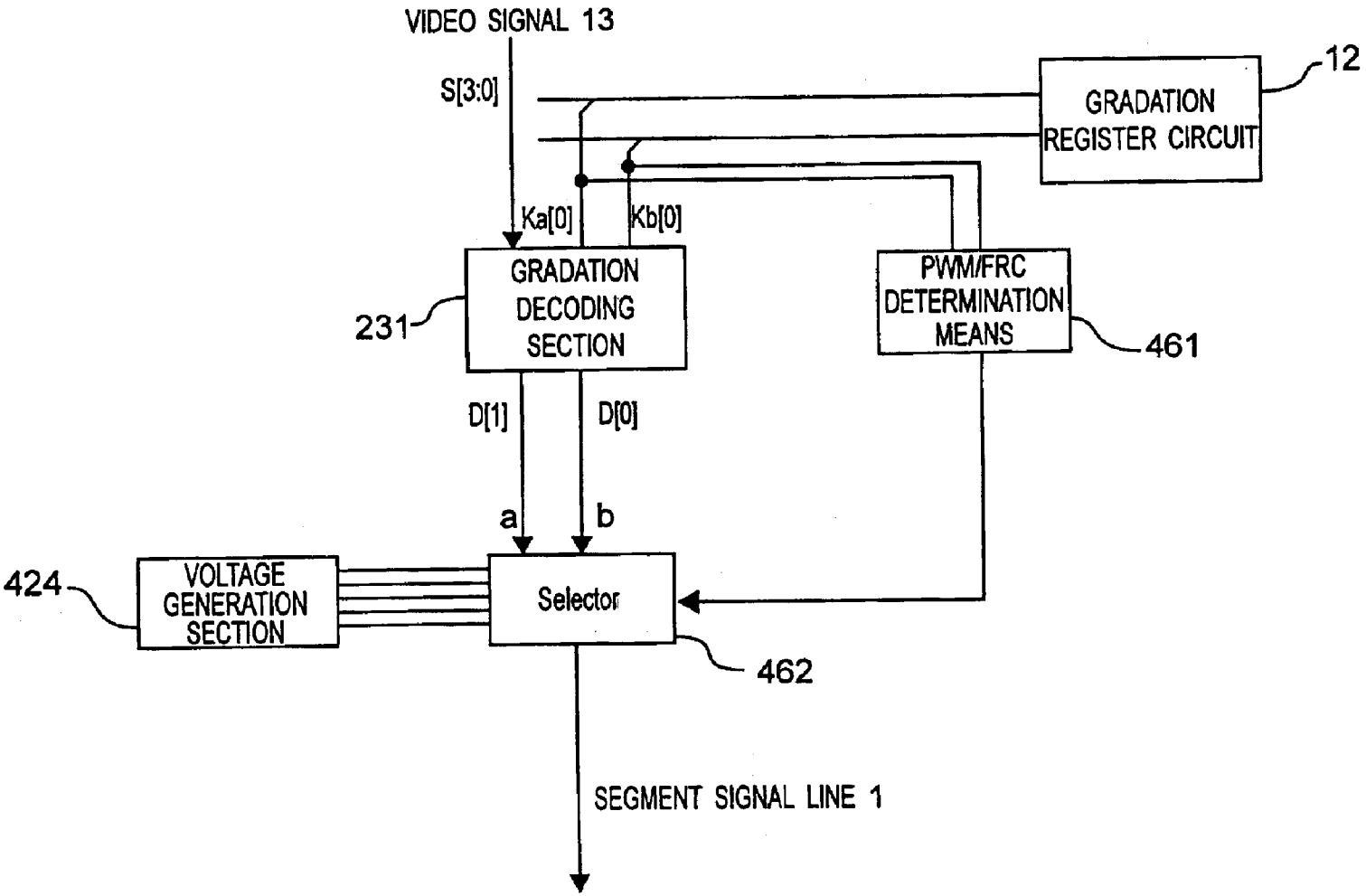
FIG. 48 is a block diagram showing another construction example from any one column video signal to a segment signal in the fourth embodiment of the present invention.

In specific, the explanation is made in the case where FRC is performed in the block diagram of FIG. 48 in each of the periods a, b and c in one frame shown in FIG. 45.

FIG. 48 shows a configuration from a video signal of one column to a segment signal when controlling the selector using a PWM/FRC determination means in the case where FRC is performed using the more significant 2 bits and PWM is performed using the less significant 2 bits for a 4-bit signal when selecting one by one row. The value of the input a to the selector 426 is selected and the output is performed in the entire periods of a through c (or b may be selected when performing FRC because the inputs a and b have the same value so long as the output of the FRC determination line (signal line C) 421 is not selected) Meanwhile, in the case of performing PWM, the input a to the selector 462 which is a data MSB output is selected in the period a, and input b to the selector 462 is selected in the period b, and data 0 is selected in the period c, and the data a, b and 0 are outputted to the segment signal line In order to judge whether the input signal to the selector 462 is through FRC or through PWM, the PWM/FRC determination means 461 performs the judgment using the data of the gradation register circuit 12, and the results thereof are sent to the selector 462 to thereby perform the judgment.

In the case of not performing a multi-line simultaneous selection, the 0 output can be performed by outputting a corresponding voltage and can be realized without increasing the circuit scale because it is not necessary to receive the output from an external since 0 is fixed in the period c.

Figure 49:
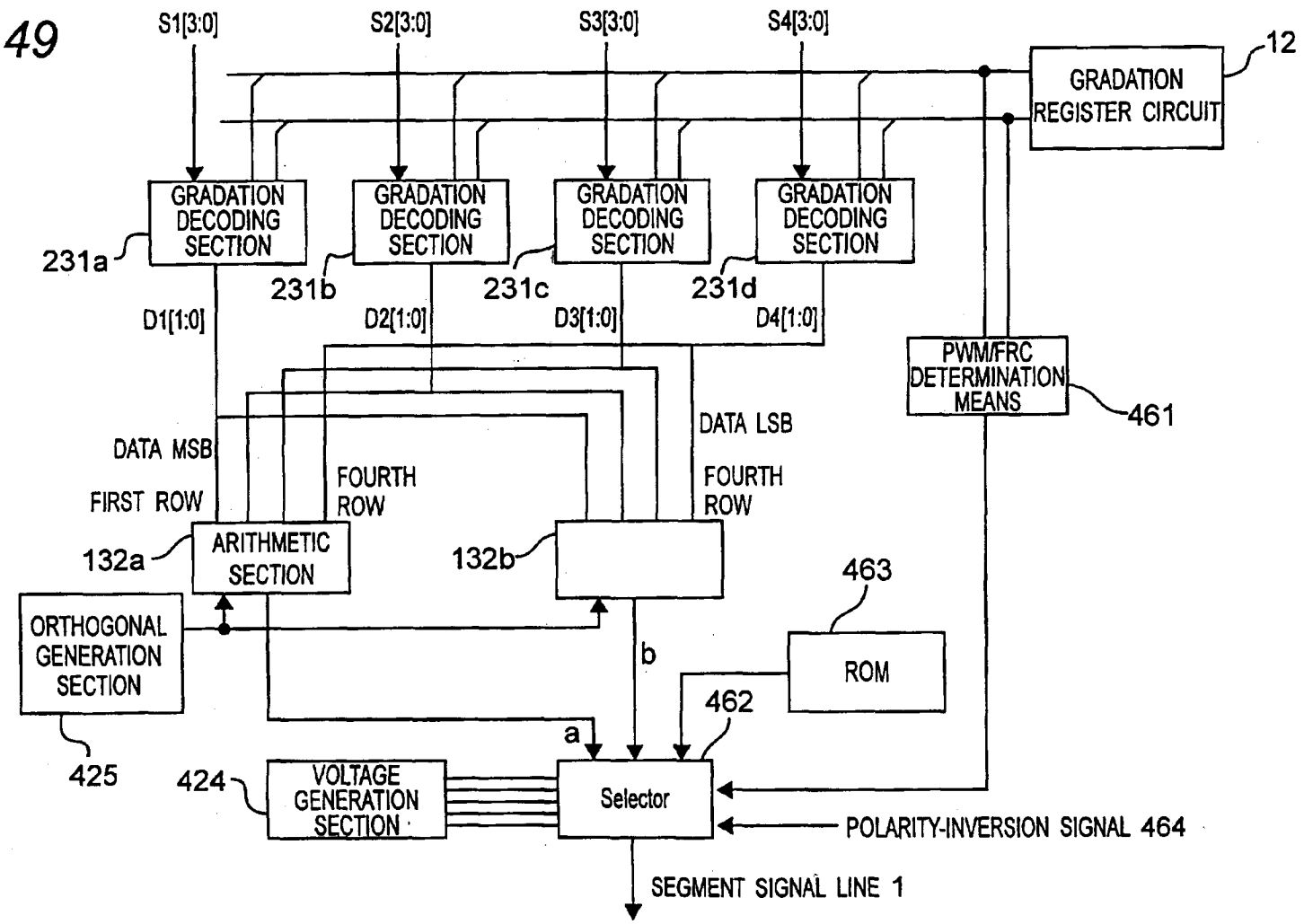
FIG. 49 is a block diagram showing further another construction example from any one column video signal to a segment signal in the fourth embodiment of the present invention.

FIG. 49 shows a configuration below the gradation decoding sections in the case of using a multi-line simultaneous selection method. In FIG. 49, shown is a configuration from a video signal of one column to a segment signal in the case of providing an insertion period of data 0 when controlling the selector using the PWM/FRC determination means in the case where FRC is performed using the more significant 2 bits and PWM is performed using the less significant 2 bits for a 4-bit signal when performing a 4-row simultaneous selection.

In the multi-line selection method, a calculation is necessary in order to input data 0. Moreover, it is necessary that the rows to be simultaneously selected are all PWM data or all FRC data. The matrix elements of the orthogonal function used in the calculation comprise values of 1 and −1 in a rate of 1:3 or 3:1, for example, in the 4-row simultaneous selection method, and therefore the calculation results are two ways. Accordingly, these two ways of the calculation results are stored in the selector 462, and the selection between the two ways can be performed by inputting a signal for changing the rate of 1 in the elements of the orthogonal function. In this case, since the signal for changing the elements of the orthogonal function is a polarity-inversion signal 464, this polarity-inversion signal 464 is inputted to the selector 462.

In addition, since the distinction of PWM and FRC is performed according to the output of the gradation register circuit 12, the method of the selector is changed by the PWM/FRC determination means 461. When in PWM, a voltage corresponding to a is outputted in two-quarter periods, a voltage corresponding to b is outputted in one quarter period, and a value corresponding to the polarity-inversion signal of the voltages of the two ways stored in the selector is outputted in one quarter period. When in FRC, a voltage corresponding a (or a voltage corresponding to b, generally any one of the outputs of the calculation results) is outputted in one frame period for realization.

In a passive matrix type display device, a gradation is determined according to an effective value of a voltage to be applied in one frame. In the multi-line simultaneous selection method, since a non-selection voltage of the common side signal line is coincident with a center voltage (assuming to be Vc) among segment multi-value voltages, the voltage Vc can be also applied to the segment signal line in the period c 413 shown in FIG. 41 when in PWM. The effective value on the selection pixels is 0 in this period c and there is no influence on the display gradation. Moreover, since the voltage value of Vc is sufficiently small with respect to a peak value of the selection pulse also in a non-display screen, there is no influence on the display.

Figure 50:
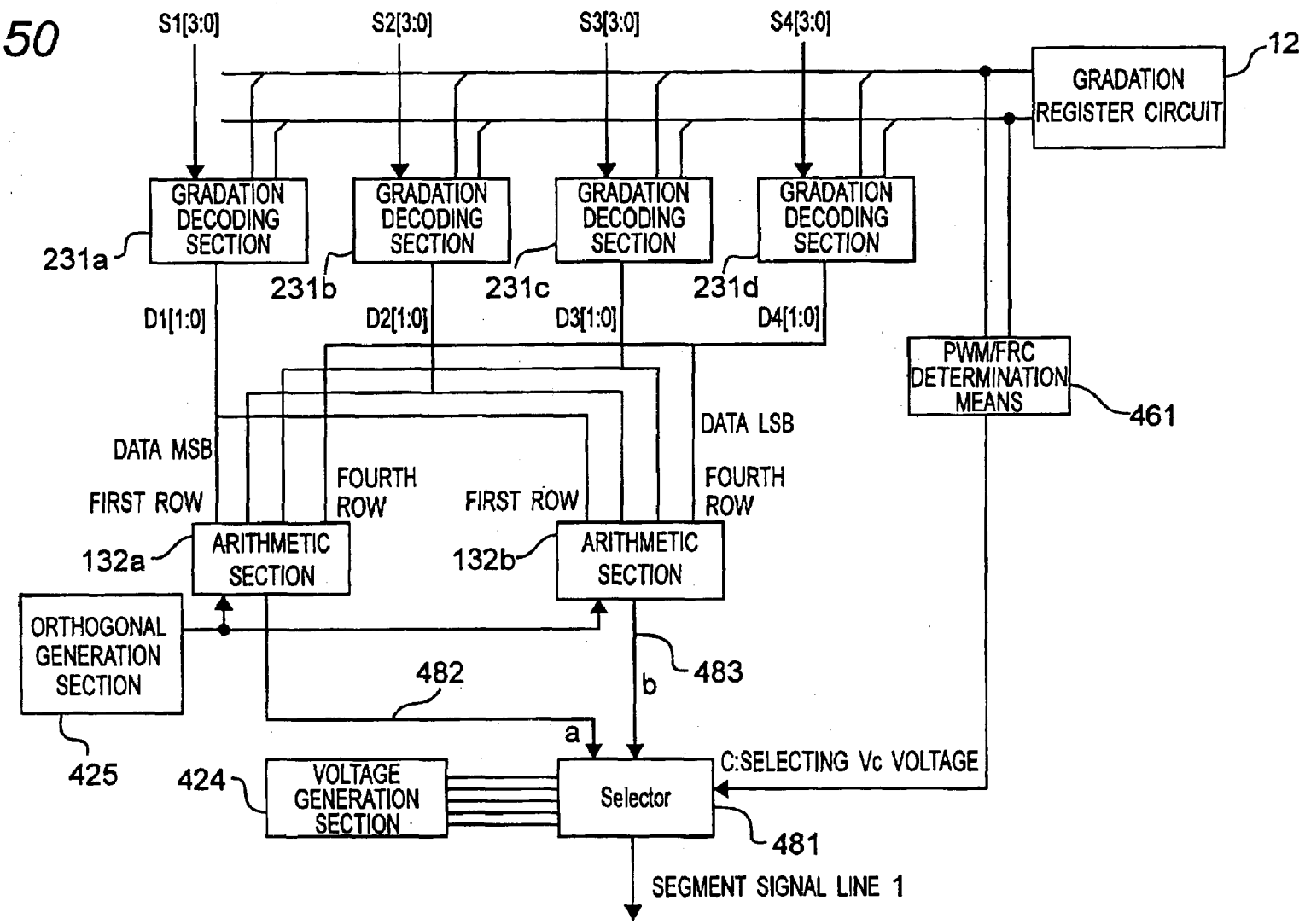
FIG. 50 is a block diagram showing further another construction example from any one column video signal to a segment signal in the fourth embodiment of the present invention.
Figure 51:
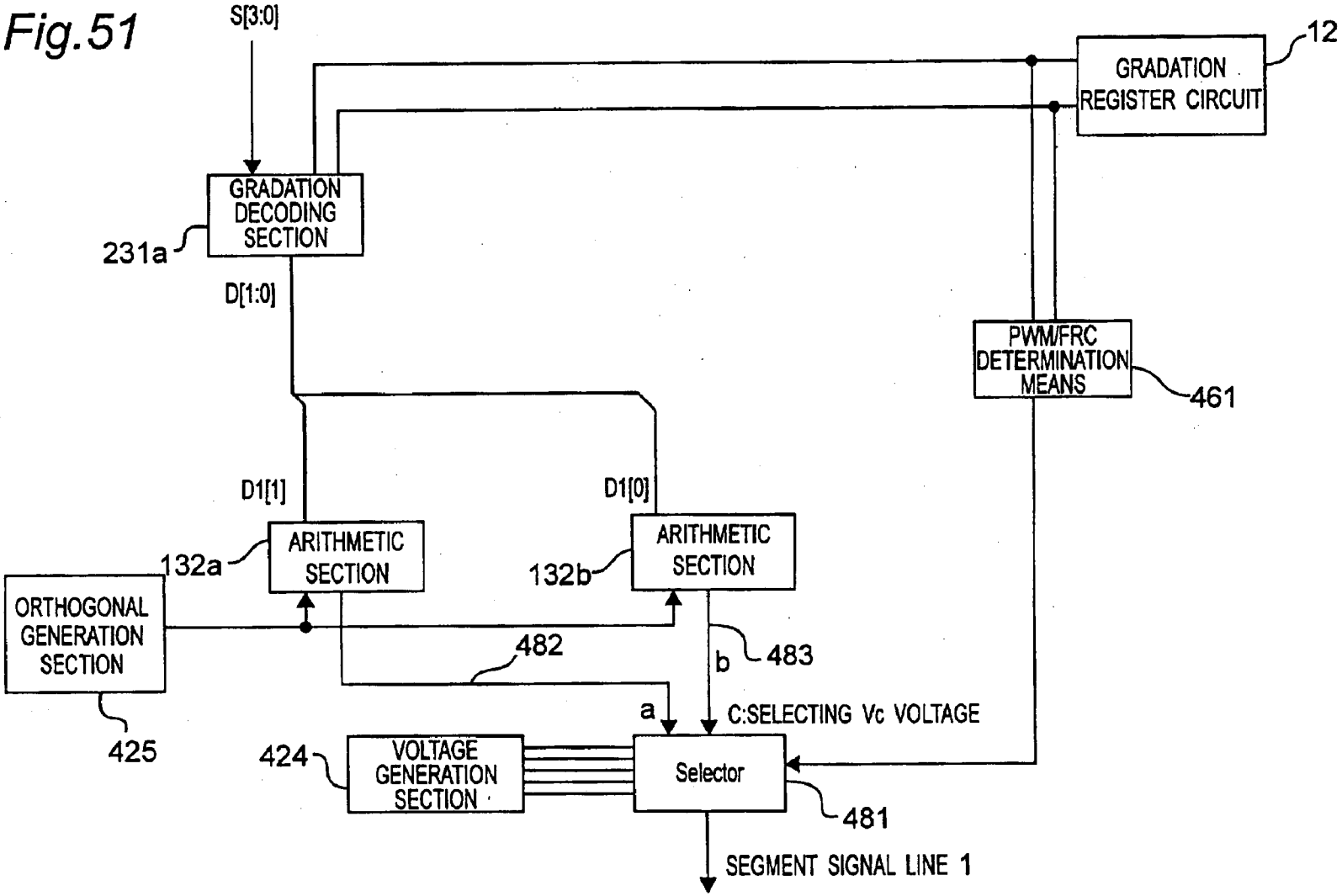
FIG. 51 is a block diagram showing further another construction example from any one column video signal to a segment signal in the fourth embodiment of the present invention.

FIGS. 50 and 51 show the configuration below the gradation decoding sections according to this method. In FIG. 50, shown is a configuration from a video signal of one column to a segment signal in the case of providing a period for applying a segment voltage so as not to apply a voltage to the display section when controlling the selector using the PWM/FRC determination means in the case where FRC is performed using the more significant 2 bits and PWM is performed using the less significant 2 bits for a 4-bit signal when performing a 4-row simultaneous selection, and in FIG. 51 shown is a configuration from a video signal of one column to a segment signal in the case of providing a period for applying a segment voltage so as not to apply a voltage to the display section when controlling the selector using the PWM/FRC determination means when the gradation display is performed by combination of FRC and PWM in the case where the 4-row data to be simultaneously selected by the 4-row simultaneous selection method is sequentially transferred.

That is, FIG. 50 shows a method of performing a calculation by providing the gradation decoding sections 231 in parallel corresponding to the number of the rows to simultaneously transfer the elements of four rows to the arithmetic sections 132 in the case where the 4-row data are simultaneously transmitted from the video signals, and whereas in FIG. 51 the 4-row data are transferred in turn and sequentially gradation-processed by the gradation decoding section 231. The 4-row data are sequentially transferred to the arithmetic sections 132 and are latched after subject to an exclusive NOR performed in the arithmetic sections to thereby obtain a sum of the 4-row data. In other words, this is a difference whether the data of 4 rows are serially transferred or transferred in parallel.

The selector 481 varies the voltage to be applied to the segment signal line based on the result of the PWM/FRC data determination means 461, and selects a voltage corresponding to a value of the 482 from the voltage generation section 424 and outputs the voltage in the row selection period in the case of FRC. In the case of PWM, a voltage corresponding to the value of the 482 is applied in two-quarter periods, a value corresponding to the 483 is applied in one quarter period, and a Vc voltage is applied in one quarter period, of one frame. Thus, a 16-gradation display can be performed at the time inputting 4 bits.

When performing a pulse-width modulation with N=2, three pulses are applied in one frame as shown in FIG. 41. As a method for suppressing an electric power increment due to charge and discharge, a pulse a is first entered, and then a voltage equal to the pulse a among b and c is applied, and finally the remaining is entered, so that the electric power increment due to charge and discharge can be reduced.

Figure 52:
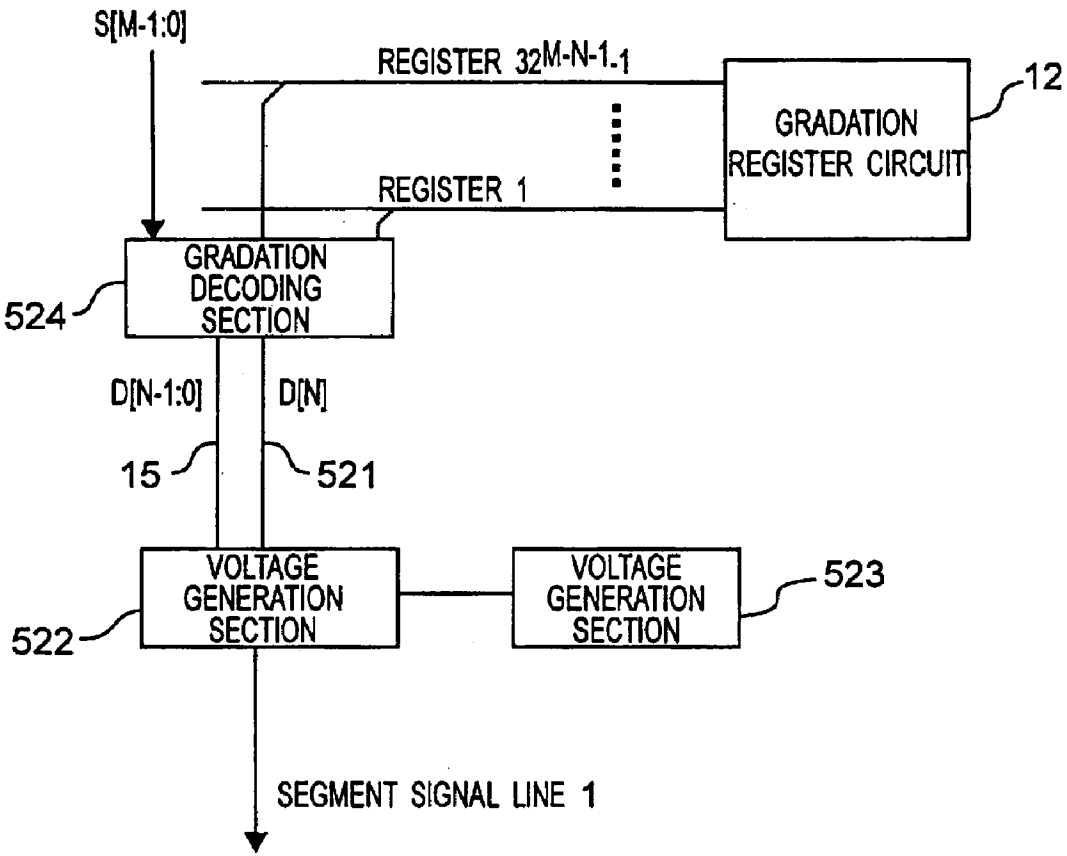
FIG. 52 is a block diagram showing another construction example of a gradation processing section in the fourth embodiment of the present invention.

Whereas the explanation was made in the case of displaying the frame outputted with the input less significant N bits through PWM, in the case of the pulse-height modulation the realization is also possible in a manner that the number of the voltage values to be outputted is increased by one, and the minimum voltage value or maximum voltage value is outputted when in FRC, and any voltage except for the maximum voltage value is selected when in PWM. For example, as shown in FIG. 52, in addition to the N-bit output (display data line 15) of the gradation decoding section 524, an ON determination line (D[N]) 521 is outputted, and the outputs are shown in a relationship as in FIG. 53. The D[N] outputs 1 when FRC is in ON state in the decoding process, and outputs 0 in the other periods.

As the D[N] is outputted like this, when the input less significant N bits are outputted from the gradation decoding section 524, a voltage outputting section 522 outputs a voltage value corresponding to each of the gradations (voltage V0 in Gradation 0, voltage V1 in Gradation 1, and the like). That is a light-on pattern shown by Δ in FIG. 21(*b*). When OFF of FRC is outputted from the gradation decoding section 524, the voltage outputting section 522 outputs a voltage V0 corresponding the gradation 0. In these patterns, it is sufficient to output a voltage value corresponding to the display data line.

Whereas, in the ON period of FRC, it is necessary to output gradations expressible by N bits plus one next gradation (FIG. 39(*c*)). That is, a voltage value corresponding to (the output value of the display data line 15)+1 is required in this case.

In the two cases as mentioned above, it is necessary to add a change to the value of the display data line 15 and to the output value. This is distinguished by using the D[N] signal line to perform different processes to thereby perform a gradation display. FIG. 54 shows an input/output relationship of the voltage outputting section 522. When in ON state under FRC, a voltage value corresponding to a gradation higher by one than the other gradations is outputted, and FRC is performed using $2^{M-N}-1$ with respect to the M-bit input, and further in the case of performing a $2^N$-gradation display with one frame, a display of $2^M$ different gradations can be made.

When the data is outputted to the segment signal line, one of the outputs of the voltage generation section 523 may be selected by the voltage outputting section 522 to be outputted, or a digital-to-analogue converter may be used instead of the voltage outputting section 522.

(Embodiment 5)

Frames subjecting to PWM or PHM are displayed with reduction by one gradation than the other frames, so that a display of different $2^M$ gradations is performed with respect to the M-bit input.

In the present embodiment, the reduction of a driving voltage and improvement of gradation performance are carried out using the corresponding value of the reduction of one gradation.

If the $2^N$-gradation display is performed in the frames subject to PHM or PWM, a $2^M+1$ gradation display can be made with respect to the M-bit input. By taking $2^M$ dots optimum for the gradation display among the available $2^M+1$ dots, the gradation performance can be improved. Moreover, in the case where display elements having different brightness-signal intensity characteristics are arranged, by taking different $2^M$ dots every display elements having different characteristics, the brightness can be made equal when a signal of the same intensity is inputted. For example, in the case where only display elements of red color are lower in brightness with respect to the signal intensity, the signal intensities of 1 to $2^M$ are taken in the display elements of green and blue colors while the signal intensities of 2 to $2^M+1$ are taken in the display elements of the red color, so that the difference in brightness among the display colors can be compensated.

If the gradations of the signal intensities of 2 to $2^M+1$ are taken in the whole display device, the brightness as the whole of the display device is raised. By taking advantage of this, also when using the 2 to $2^M+1$ gradations, in order to make the brightness similar to the brightness when using the 1 to $2^M$ gradations, the voltage values of the segment signal line and common signal line are reduced. Thus, the driving voltage can be reduced even in the same brightness.

In addition to changing a way of taking gradations, by applying a constant voltage all the time in a period of unused one gradation data in one frame under performing PWM or PHM, the voltage applied to the display section can be increased so that the voltages of the segment and common signal lines can be reduced corresponding to the increased amount. Thus, in the 4-row simultaneous selection method, many common signal lines among the selected plural common lines are supplied with a voltage of a maximum amplitude having a polarity inverse to the applied voltage polarity, so that the voltage of the common signal line can be reduced by nearly 1 V, and the voltage of the segment signal line can be reduce by 0.2 V.

Furthermore, this can be utilized for adjusting the brightness of the screen. By using the 1 to $2^M$ gradations when reducing the screen brightness, and by using the 2 to $2^M+1$ gradations when raising the screen brightness, a change of the brightness corresponding to one gradation can be performed.

Note that, in the present invention, although the segment signal lines are arranged in an example of a display device performing a color display using the three colors of red, green and blue, it is not limited to the three colors of red, green and blue, and three colors of cyan, yellow and magenta may be used. In this case, it may be defined such that the G shift and B shift correspond to cyan and yellow and magenta are a shift amount. In addition, it is possible to use colors other than the three colors, and by defining a pattern shift amount of the other colors with respect to one color, the G shift, B shift and the like can be similarly realized. Accordingly, even with the three primary colors of red, green and blue, it is not always necessary to shift green and blue, and it is sufficient that the patterns of the other two colors are shifted with respect to one color when performing ON and OFF.

Note that, in the present invention, although the explanation was made in the case of using a thin-film transistor as an example of an active-matrix type display device, a MOS transistor, MIS transistor, thin-film diode, MIM and the like can be similarly performed.

In addition, the present invention can be also applied to an organic EL display (OELD), inorganic EL display, FED, PDP and the like panel (display) other than liquid crystal.

Industrial Applicability

As described above, according to the present invention, in the case of performing a gradation display by a frame rate control method, ON/OFF patterns are differentiated every frame, every line, every display color and between even rows and odd rows, so that a gradation display can be made at a low frame frequency with reduction of flickers.

Moreover, with respect to a M-bit video signal, a gradation display is performed by a pulse-width or pulse-height modulation using less significant N bits with one frame, and further a gradation display is performed under a frame rate control of the present invention using more significant M−N bits with $2^{M-N}-1$ frames, the frames number necessary in the frame rate control is reduced so that the frame frequency is reduced to thereby realize a gradation display with reduction of flickers at a lower electric power.

Furthermore, in the case of performing a gradation display in combination of a gradation display under a frame rate control with a pulse-width or pulse-height modulation, since $2^{M-N}-1$ pieces of gradations have the same outputs as the other gradations with respect to different input signal gradations, against the substantial reduction in the number of the display gradations, $2^N+1$ gradation display can be made in a frame performing a gradation display by a pulse-width or pulse-height modulation using a M-bit signal, so that the same signal output is not generated in response to different input gradations, thereby preventing reduction of the displayable gradations number due to the combination.

What is claimed is:

1. A matrix type display device performing gradation display under a frame rate control to display at least two different colors, comprising:

a gradation register section;

shift processing sections for shift-processing said gradation register section every row or every frame based on a control signal and changing the outputs of said gradation register section every display color by the shift processing by a number of the shift processing sections which the number is equal to a number of the display colors−1; and gradation selecting circuits provided on every segment signal lines, connected with the outputs of said shift processing sections or said register section, wherein said gradation selecting circuits perform the gradation display with display patterns different every display color, using the outputs of said shift processing sections or said register section at the same time.

2. A method for driving a matrix type display device performing gradation display under a frame rate control, comprising:

shift-processing every N rows or every frame of gradation registers provided for every gradation;

connecting shift sections to the outputs of said gradation registers and further shift-processing for the data corresponding to even number rows among the N rows, and outputting the outputs of said gradation registers without any change for the data corresponding to odd number rows;

performing gradation processing by gradation selecting circuits provided on every segment signal lines, using the outputs of the gradation registers at the same time; and displaying ON/OFF patterns different between the even number rows and the odd number rows among a set of N rows.

3. A method for driving a matrix type display device performing gradation display under a frame rate control to display at least two different colors, comprising:

shift-processing every N rows or every frame of gradation register sections based on a control signal;

connecting a first shift section to the outputs of said gradation registers and further shift processing for the data corresponding to even number rows among the N rows, and outputting the outputs of said gradation registers without any change for the data corresponding to odd number rows;

performing the shift processing to said first shift section every display color by a number of second shift processing sections which the number is equal to a number of display colors−1; and performing gradation display with display patterns different between the even number rows and the odd number rows among a set of further N rows every display color, using the outputs of said shift processing sections or said register sections at the same time, by gradation selecting circuits provided on every segment signal lines.

4. A matrix type display device, comprising:

gradation registers;

a shift processing control section for shift-processing said gradation registers every row or every frame;

a first shift section performing the shift-processing for data of even number rows among a set of N rows for the outputs of said gradation registers, wherein the outputs of said first shift processing section are distributed according to display colors (X colors);

a second shift section performing the shift-processing for at least X−1 pieces of the outputs among the distributed X pieces outputs of said first shift section; and gradation selecting circuits provided on every segment signal lines, connected with the outputs of said second shift section or said first shift section, wherein said gradation selecting circuits perform the gradation display using the outputs of said first shift section or said second shift section at the same time, to thereby perform the gradation display with display patterns different every N rows, every frame, between even number rows and odd number rows of a set of N rows, and every display color.

* * * * *